US011136210B2

(12) United States Patent
Haraguchi

(10) Patent No.: US 11,136,210 B2
(45) Date of Patent: Oct. 5, 2021

(54) FRICTION TRANSPORT DEVICE AND PAPER SHEET TRANSPORT DEVICE

(71) Applicant: Japan Cash Machine Co., Ltd., Osaka (JP)

(72) Inventor: Kohei Haraguchi, Osaka (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 0 days.

(21) Appl. No.: 16/636,874

(22) PCT Filed: May 7, 2018

(86) PCT No.: PCT/JP2018/017664
§ 371 (c)(1),
(2) Date: Feb. 5, 2020

(87) PCT Pub. No.: WO2019/030998
PCT Pub. Date: Feb. 14, 2019

(65) Prior Publication Data

US 2020/0180886 A1 Jun. 11, 2020

(30) Foreign Application Priority Data

Aug. 8, 2017 (JP) ..... JP2017-153161

(51) Int. Cl.
*B65H 9/16* (2006.01)
*B65H 5/06* (2006.01)

(52) U.S. Cl.
CPC ..... *B65H 9/16* (2013.01); *B65H 5/06* (2013.01)

(58) Field of Classification Search
CPC . B65H 9/00; B65H 9/10; B65H 9/106; B65H 9/16; B65H 9/14; B65H 9/166
See application file for complete search history.

(56) References Cited

U.S. PATENT DOCUMENTS 5,049,948 A * 9/1991 Brown ..... B65H 9/16 271/251
5,335,904 A * 8/1994 Ryuzaki ..... B65H 5/062 271/236

(Continued)

FOREIGN PATENT DOCUMENTS

JP S5912031 A 1/1984
JP S62-197643 U 12/1987

(Continued)

OTHER PUBLICATIONS

Machine translation of JP2011-143995. (Year: 2011).*

(Continued)

*Primary Examiner* — Thomas A Morrison
(74) *Attorney, Agent, or Firm* — Masuvalley & Partners

(57) ABSTRACT

To correct a posture of a paper sheet inserted from various positions and angles to a normal transport state without causing any deformation due to contact with a side wall while transporting the paper sheet continuously and non-intermittently. A drive-side unit (20) includes at least one drive roller (25) that is supported rotatably about a shaft orthogonal to a normal paper-sheet transport direction and axially movably, an elastic biasing member (40) that elastically biases the drive roller in an axial direction, and a cam mechanism (50) that transmits a driving force from a driving source to the drive roller, and operates when an external force exceeding a predetermined value in a direction other than a normal transport direction is applied to the paper sheet transported by the drive roller, so as to change an axial position of the drive roller against an elastic biasing force, and a driven-side unit (100) includes a driven roller that changes a transport grip between the drive roller and a paper sheet according to a change of an axial position of the drive roller.

12 Claims, 24 Drawing Sheets

(56) References Cited

U.S. PATENT DOCUMENTS

| | | | | | |
|---|---|---|---|---|---|
| 5,362,041 | A * | 11/1994 | Ryuzaki | B65H 9/006 | 226/19 |
| 6,273,418 | B1 * | 8/2001 | Fujikura | B65H 9/103 | 271/227 |
| 6,712,356 | B2 | 3/2004 | Daout et al. | | |
| 6,805,347 | B2 * | 10/2004 | Kuramoto | B65H 9/06 | 271/242 |
| 7,063,472 | B2 * | 6/2006 | Matsuda | B65H 5/38 | 271/229 |
| 8,036,588 | B2 * | 10/2011 | Ishida | G03G 15/6567 | 271/228 |
| 8,079,589 | B2 * | 12/2011 | Kinoshita | B65H 9/006 | 271/242 |
| 10,031,464 | B2 * | 7/2018 | Mori | G03G 15/6529 | |
| 10,221,030 | B2 * | 3/2019 | Koizumi | B65H 9/006 | |
| 2007/0007719 | A1 | 1/2007 | Nishida et al. | | |
| 2009/0295079 | A1 * | 12/2009 | Kinoshita | B65H 9/006 | 271/242 |

FOREIGN PATENT DOCUMENTS

| | | | |
|---|---|---|---|
| JP | S6441154 | A | 2/1989 |
| JP | H06115767 | A | 4/1994 |
| JP | H0733285 | A | 2/1995 |
| JP | H07187521 | A | 7/1995 |
| JP | 2001341897 | A | 12/2001 |
| JP | 2005-255406 | A | 9/2005 |
| JP | 2009280327 | A | 12/2009 |
| JP | 2011-143995 | * | 7/2011 |
| JP | 2011-255976 | A | 12/2011 |
| RU | 2175633 | C1 | 11/2001 |
| WO | 9928225 | A1 | 6/1999 |
| WO | WO2011/151984 | A1 | 12/2011 |

OTHER PUBLICATIONS

WIPO, Japanese International Search Authority, International Search Report (with English translation) and Written Opinion dated Jul. 10, 2018 in International Patent Application No. PCT/JP2018/017664, 10 pages.

Russian Office Action(with English translation) and Search Report dated Nov. 18, 2020, issued in Russian Application No. 2019142840, 12 pages.

Chinese Office Action(with English translation) dated Nov. 4, 2020, issued in Chinese Application No. 201880051396.9, 13 pages.

* cited by examiner (a)

(b)

FRICTION TRANSPORT DEVICE AND PAPER SHEET TRANSPORT DEVICE

RELATED APPLICATIONS

This application is the U.S. National Phase of and claims priority to International Patent Application No. PCT/JP2018/017664, International Filing Date May 7, 2018, entitled Friction Transport Device And Paper Sheet Transport Device; which claims benefit of Japanese Application No. 2017-153161 filed Aug. 8, 2017; both of which are incorporated herein by reference in their entireties.

FIELD

The present invention relates to a skew correction technique in a paper sheet transport device that transports paper sheets such as banknotes.

BACKGROUND

In various types of automatic vending machines, change machines, money dispensers, and other types of various types of money handling devices that receive a loaded banknote to provide items and services to users, there is provided a centering device and a skew correction device that corrects the loaded banknote to a normal position and a correct posture when the banknote is displaced or skewed from a central axis of a transport path.

If a banknote inserted from an insertion slot of a money handling device is transported while coming into contact with a side wall of a transport path due to skew or the like, the banknote receives a reaction force in a direction moving away from the side wall to move in a direction that matches the central axis of the transport path. However, if a nipping force of the banknote caused by transport rollers is stronger than the reaction force, a tip corner or the like of the banknote is folded to cause deformation such as crushing, thereby causing a transport defect or poor recognition.

In a paper sheet transport device disclosed in Patent Literature 1, a spherical body that comes into contact with a paper sheet rotates dependent on the movement of the paper sheet, and thus a frictional force between the paper sheet and the spherical body decreases, and the reaction force generated in the paper sheet becomes larger than the frictional force with the spherical body. Accordingly, the paper sheet can move in a direction canceling out the reaction force, and thus the paper sheet is automatically aligned and matched with a central axis of a transport path.

However, since the pressing force of the spherical body is weak and the frictional force with the paper sheet is always small, jamming occurs easily when the paper sheet comes into contact with undulations in the transport path. Further, also in a return transport, since a sufficient transport grip cannot be ensured, a return transport defect easily occurs, which is disadvantageous.

Patent Literature 2 discloses a configuration in which a banknote is gradually matched with a reference wall by aligning the banknote with the reference wall in a process of transporting the banknote obliquely toward the reference wall by a skew roller that rotates about an axis that is inclined by a predetermined angle with respect to a normal banknote transport direction.

However, while this configuration is effective in a case where a hard medium such as a credit card or a film is matched with a reference wall, in the transport of a heavily creased medium or a banknote in a poor condition or a banknote without "firmness" such as a worn-out, crumpled, or wet banknote, deformation of the medium or deterioration of the condition is caused at the time of contact with the reference wall, and there is a risk of jamming being caused.

In a paper sheet transport device disclosed in Patent Literature 3, by intermittently bringing a plurality of rotors arranged in parallel to a side wall of a transport path into contact with a medium, the medium is transported and driven at the time of contact between the medium and rotors, and at the time of non-contact between the medium and the rotors, the medium can be automatically matched with the transport path and transported along the transport path, while releasing a distortion of accumulated mediums due to contact with the side wall.

However, since the rotors are intermittently brought into contact with the mediums, there is a disadvantage in that the wear volume of the rotor increases. Further, since the transport driving is not continuous, the medium has a flopping behavior at the time of transport, and thus the medium cannot be transported stably.

Patent Literature 4 discloses a configuration in which, when skew of an inserted paper sheet is detected, an adjustment unit is activated based on a detection signal to increase or decrease a roller diameter by changing the axial position of one roller of a pair of paper-sheet feed rollers, thereby correcting the skew. However, there are problems that a detection unit that detects the skew is required, and the control and configuration for finely adjusting the increase and decrease of the roller diameter according to the degree of the skew becomes complicated.

Patent Literature 5 discloses a configuration of including a transport roller pair formed by a drive-side tapered roller with an outer peripheral surface being in a tapered shape and a normal driven roller, in which an axial direction position of the driven roller is changed so as to change the contact position with the tapered roller, thereby accelerating or decelerating the feed rate of paper sheets to correct the skew. However, since the axial movement of the driven roller is performed by a motor, there is a problem that detection of the degree of skew and control of the motor based on a detection result become complicated.

CITATION LIST

Patent Literatures

Patent Literature 1: Japanese Patent Application Laid-open No. 2011-255976

Patent Literature 2: Japanese Patent Application Laid-open No. H7-33285

Patent Literature 3: U.S. Pat. No. 6,712,356

Patent Literature 4: Japanese Patent Application Laid-open No. S59-12031

Patent Literature 5: Japanese Patent Application Laid-open No. 2005-255406

SUMMARY

Technical Problem

The present invention has been achieved in view of the above problems, and an object of the invention is to provide a friction transport device that can correct a posture of a paper sheet inserted from various positions and angles to a proper transport state without causing any deformation due to contact with a side wall, while transporting the paper sheets continuously and non-intermittently, and a paper sheet transport device.

Another object of the invention is to provide a friction transport device provided with a mechanism that changes a frictional force (hereinafter, "transport grip") between a drive roller and a paper sheet according to the status of the paper sheet, in which at the time of receiving the paper sheet, the transport grip is weakened to perform skew correction advantageously, and at the time of returning the paper sheet or at the time of standby, a strong transport grip is maintained to perform return transport and prevention of continuous insertions of paper sheets advantageously, and a paper sheet transport device.

Solution to Problem

In order to achieve the above object, a friction transport device according to the present invention comprises: a drive-side unit that transmits a transport driving force to one surface of a paper sheet to be transported on a transport path; a driving source that supplies a driving force to the drive-side unit; and a driven-side unit that is arranged to face the drive-side unit and comes into contact with the other surface of the paper sheet, wherein the drive-side unit includes at least one drive roller that is supported rotatably about a shaft orthogonal to a normal paper-sheet transport direction and axially movably, an elastic biasing member that elastically biases the drive roller in an axial direction, and a cam mechanism that transmits a driving force from the driving source to the drive roller, and operates when an external force exceeding a predetermined value in a direction other than a normal transport direction is applied to the paper sheet transported by the drive roller, so as to change an axial position of the drive roller against the elastic biasing force, and the driven-side unit includes a driven roller that changes a transport grip between the drive roller and the paper sheet according to a change of an axial position of the drive roller.

Advantageous Effects of Invention

According to the present invention, it is possible to correct a posture of a paper sheet to be inserted from various positions and angles to a normal transport state without causing any deformation due to contact with a side wall, while transporting the paper sheets continuously and non-intermittently.

BRIEF DESCRIPTION OF DRAWINGS

FIGS. 32(*a*), (*b*), and (*c*) are front elevational views illustrating configurations of a friction transport device according to a fifth embodiment of the present invention and illustrating respective operation modes.

DESCRIPTION OF EMBODIMENTS

Figure 1:
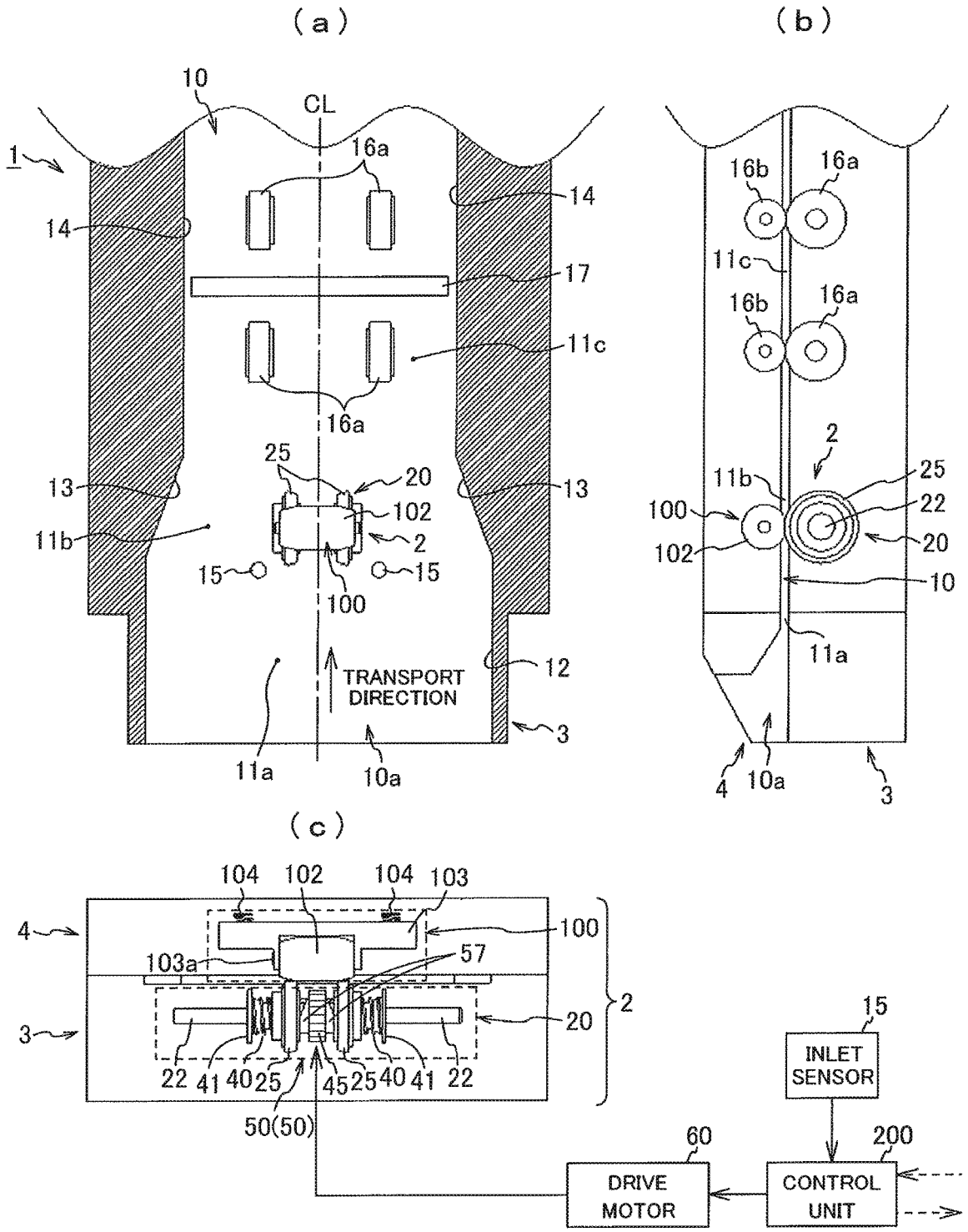
FIGS. 1(*a*), (*b*), and (*c*) are respectively a plan view and a side longitudinal sectional view of a paper-sheet transport path illustrating a basic configuration of a banknote transport device including a friction transport device according to an embodiment of the present invention, and a front elevational view of the friction transport device.

The present invention will be described below in detail with embodiments illustrated in the drawings.

First Embodiment

[Basic Structure]

A basic configuration, an operating principle, and a skew correction principle of a banknote transport device including a friction transport device according to the present invention are described below.

Figure 2:
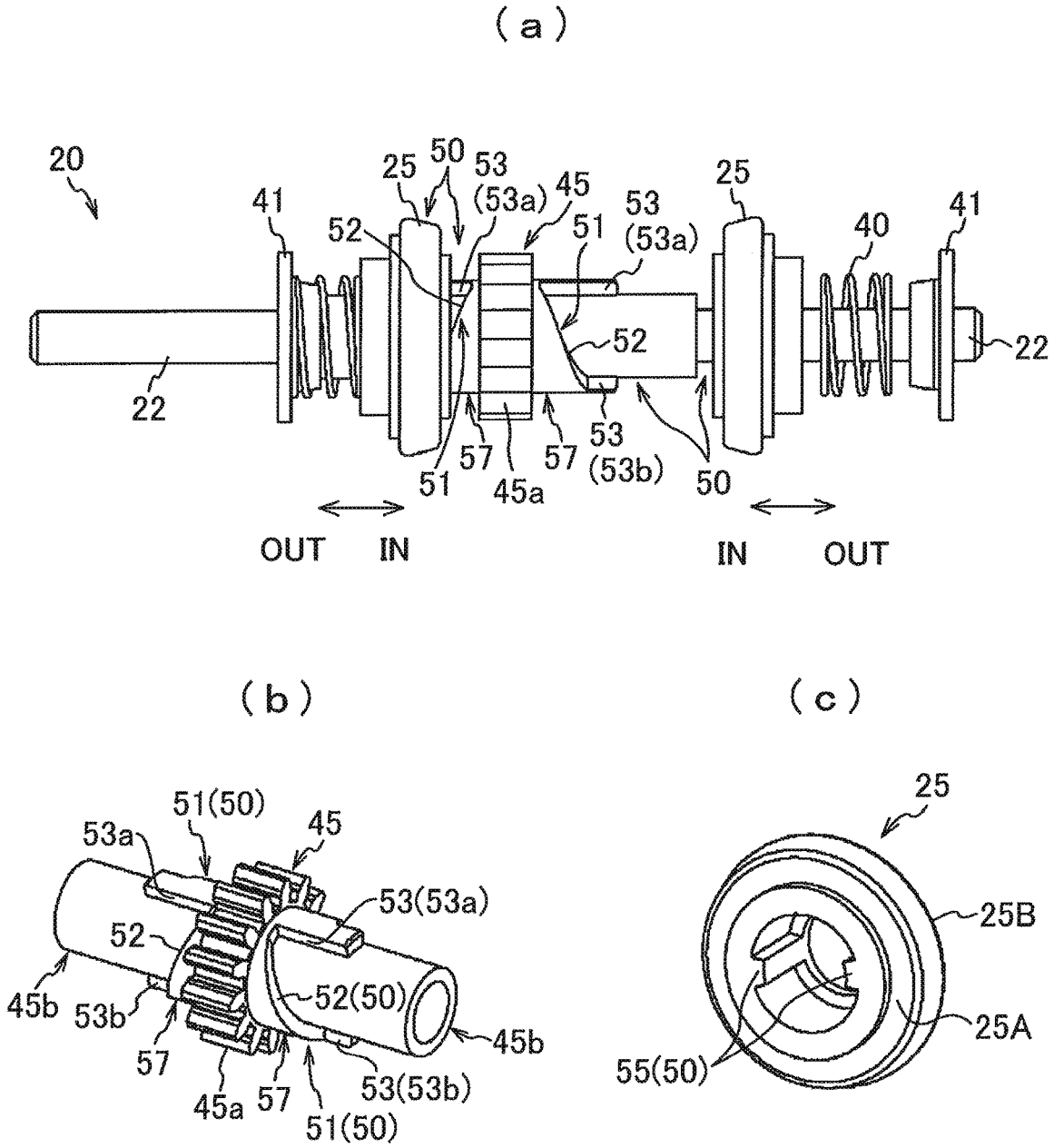
FIGS. 2(*a*), (*b*), and (*c*) are respectively an overall front elevational view of a drive-side unit constituting the friction transport device, an external perspective view of a transport drive gear with a sloped portion, and an external perspective view of a drive roller.
Figure 3:
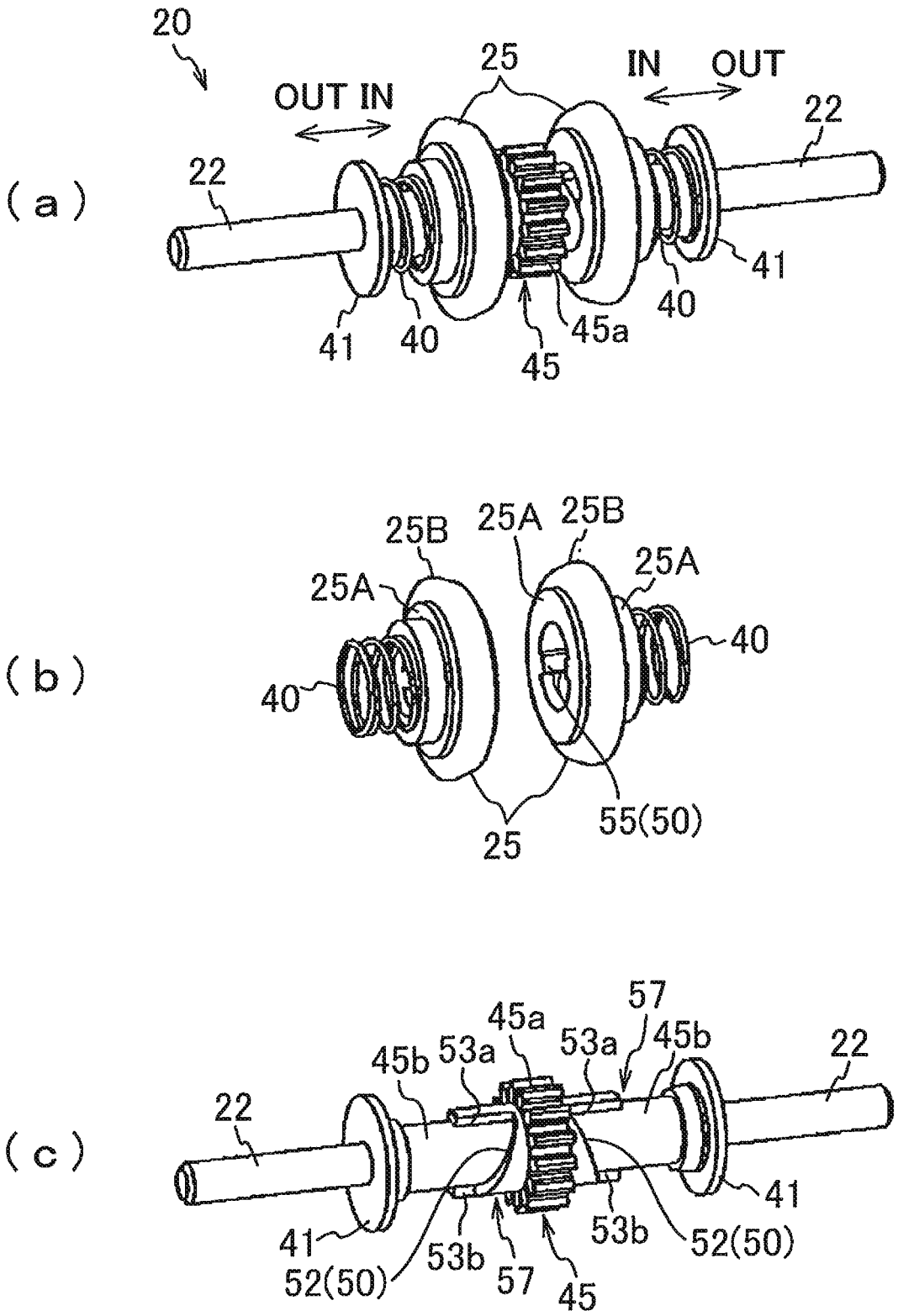
FIGS. 3(*a*), (*b*), and (*c*) are respectively an external perspective view of a drive-side unit, a perspective view of a drive roller pair, and a perspective view illustrating a state where the transport drive gear with the sloped portion is assembled to a shaft.
Figure 4:
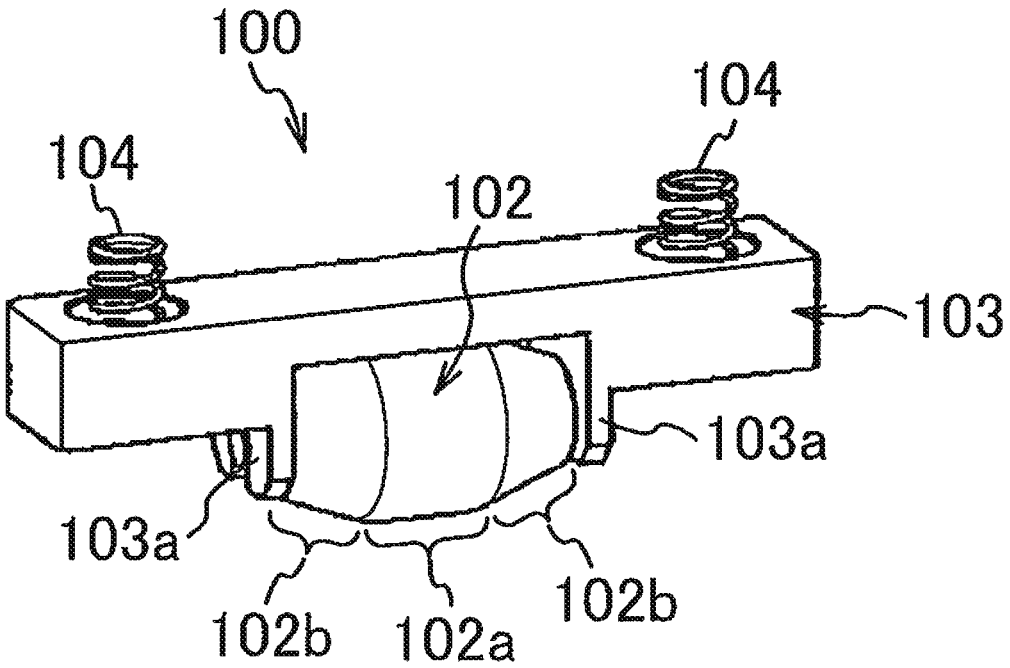
FIG. 4 is an external perspective view of a driven-side unit.

FIGS. 1(*a*), (*b*), and (*c*) are respectively a plan view and a side longitudinal sectional view of a paper-sheet transport path illustrating a basic configuration of the banknote transport device (a paper sheet transport device) including a friction transport device according to an embodiment of the present invention, and a front elevational view of the friction transport device. FIGS. 2(*a*), (*b*), and (*c*) are respectively an overall front elevational view of a drive-side unit constituting the friction transport device, an external perspective view of a transport drive gear with a sloped portion, and an external perspective view of a drive roller. FIGS. 3(*a*), (*b*), and (*c*) are respectively an external perspective view of a drive-side unit, a perspective view of a drive roller pair, and a perspective view illustrating a state where the transport drive gear with the sloped portion is assembled to a shaft. FIG. 4 is an external perspective view of a driven-side unit.

In this example, a banknote is illustrated as an example of the paper sheet. However, the present device can be also applied to skew correction in transport of paper sheets other than banknotes, such as marketable securities or tickets.

A banknote transport device 1 is mounted on a main unit of a banknote handling device body (not illustrated) to be used, and a banknote received in the banknote transport device 1 is subjected to recognition of authenticity and denomination of the banknote by a recognition sensor, and is sequentially stored one by one in a banknote accumulation unit such as a cash box in the main unit of the banknote handling device body. If there is any deviation or skew in a transport position of the banknote transported in the banknote transport device 1, poor recognition or jamming may occur, and alignment of banknotes stored in a stacked state in the cash box deteriorates. Therefore, the banknotes introduced into the banknote transport device 1 and transported need to be at constant transport positions and transport postures or to be within an allowable range.

The banknote transport device 1 includes a lower unit 3 and an upper unit 4 that are supported openably and closably with respect to the lower unit 3, and when the respective units are in a closed state, a banknote transport path 10 is formed between the respective units.

The banknote transport device 1 includes a friction transport device 2 for automatically correcting a skew when a banknote P to be transported in the banknote transport path 10 (on a banknote transport surface 11) is skewed.

The friction transport device 2 includes a drive-side unit 20 that transmits a transport driving force to one surface (a lower surface) of the banknote P to be transported on the banknote transport path 10, a driving source such as a drive motor 60 that supplies a driving force to the drive-side unit 20, a driven-side unit 100 that is arranged to face the drive-side unit 20 sandwiching the banknote transport path therebetween and comes into contact with the other surface (an upper surface) of the banknote, and a control unit 200 that controls various control targets.

In this example, the drive-side unit 20 is arranged in the lower unit 3, and the driven-side unit 100 is arranged in the upper unit 4. However, the arrangement position may be reversed.

In the banknote transport path 10, there are arranged the banknote transport surface 11 that guides the lower surface of the banknote P by an upper surface thereof, side walls 12, 13, and 14 that are continuously arranged in a standing state on both sides in a width direction of the banknote transport surface 11, inlet sensors (banknote detection sensors) 15 respectively formed by an optical sensor that detects an entry of the inserted banknote, lower transport rollers 16*a* that are arranged with a periphery thereof being exposed from an opening provided in a banknote transport surface 11 on a downstream side (an inner transport surface 11*c*) of the friction transport device 2, upper transport rollers 16*b* that are arranged in the upper unit 4 to face the transport rollers 16*a*, and a recognition sensor 17 formed by an optical sensor or the like.

The drive-side transport rollers 16*a* has a configuration to be driven by the drive motor 60 that drives the drive-side unit, and switching of the driving force to the respective objects to be driven is performed by a clutch.

The banknote transport surface 11 has an entry-side transport surface 11*a* that is close to a slot 10*a* as a banknote insertion port, an intermediate transport surface 11*b* with the width thereof gradually decreasing in a tapered shape as moving inward, and an inner transport surface 11*c* that is located at an innermost position and having a minimum width.

The side walls standing on the both sides of the respective transport surfaces respectively have entry-side side walls 12 that are arranged on both sides of the entry-side transport surface 11*a*, intermediate side walls 13 that are arranged on both sides of the intermediate transport surface 11*b* with a width interval gradually decreasing in a tapered shape, and inner-side side walls 14 that are arranged on both sides of the inner transport surface 11*c*.

In this example, it is configured that the entry-side transport surface 11*a* that receives a banknote has a wide width (86 millimeters), the inner transport surface 11*c* has the narrowest width (68 millimeters), and the intermediate transport surface 11*b* has a width gradually decreasing in a tapered shape. This configuration takes easy insertion of a banknote along a smooth inclined surface into consideration, and enables to transport the banknote while a tip corner of the banknote is brought into contact with the inclined wall surface of the intermediate side wall to guide the banknote toward the center of the transport path.

Since the entry width of the transport path is wider than the banknote width, banknotes are inserted from various positions and various angles. According to the friction transport device 2, banknotes inserted from various positions with various inclination angles and transported, with the tip corner and other portions thereof coming into contact with the side walls, can be guided toward the center of the transport path or toward one side wall while the transport posture thereof is corrected in parallel to a normal transport direction.

The illustrated configurations of the banknote transport surface 11 and the side walls are only examples, and the whole length of the transport path may have the same wide width, or the whole length of the transport path may have the same narrow width. Alternatively, the friction transport device 2 can be applied to a type including a variable guide that can vary the entry width of the transport path.

The friction transport device 2 is arranged within the range of the intermediate transport surface 11*b* in this example. This configuration is for preventing and resolving that the banknote P introduced from the slot 10*a* comes into contact with the tapered intermediate side wall 13 to receive a reaction force, and causes deformation or skew because a tip corner thereof is strongly pressed by the intermediate side wall. Therefore, even if the friction transport device 2 is arranged in any other transport surface 11*a* or 11*c* of the banknote transport surface 11, the friction transport device 2 can fulfill a function of preventing and resolving deformation or skew of the banknote resulting from a reaction force generated by the contact between the respective side walls 12 and 14 and the banknote or by other reasons.

The friction transport device 2 is a unit that corrects an introduction posture and a transport posture of the banknote P so as to match a central axis CL of the transport path or the side walls, in a process of introducing and transporting the banknote P, which receives a reaction force in a direction different from a normal transport direction due to contact with side walls or the like of s transport path by being inserted by a user from various positions, angles, and directions in various irregular postures, toward the inner portion of the transport path continuously and non-intermittently.

The drive-side unit 20 is characterized by a configuration including at least one drive roller 25 (slide roller) with a shaft center being supported rotatably by a shaft 22 extending in a direction orthogonal to (intersecting with) a normal banknote transport direction, and supported so as to be able to move forward and backward in an axial direction along the shaft 22, an elastic biasing member 40 that elastically biases the drive roller 25 in the axial direction, a transport drive gear 45 as a transport driving member that transmits a driving force from the drive motor 60 to the drive roller 25, and a cam mechanism 50 that transmits a driving force from the drive motor to the drive roller, and operates when an external force (a reaction force from a side wall or the like) exceeding a predetermined value is applied to a banknote transported by the drive roller in a direction other than the normal transport direction so as to change the axial position of the drive roller against the elastic biasing force due to the elastic biasing member 40.

Further, in the friction transport device 2 according to a first embodiment, the drive-side unit 20 includes at least two drive rollers 25 and 25, elastic biasing members 40 and 40 that elastically bias the respective drive rollers in an axial direction the drive rollers approaching each other, and cam members 57 and 57 that are arranged so as to be capable of relative rotation with respect to each other, with axial positions thereof being fixed to a shaft located between the respective drive rollers and then rotated and driven by the driving source 60. The friction transport device 2 is configured so that one cam mechanism element 55 or the other cam mechanism element 52 is arranged in each drive roller, the other cam mechanism element or the one cam mechanism element is arranged in the cam member, and the driven roller decreases a transport grip when the respective drive rollers are at operating positions where an interval therebetween is increased more than a transport grip between a banknote and the respective drive rollers at initial positions where the respective drive rollers are close to each other.

The cam mechanism 50 is a unit that changes the frictional force between drive rollers and the banknote P (hereinafter, "transport grip") according to the status of the banknote P. The friction transport device 2 has a function of introducing a banknote with an appropriate transport grip without operating the cam mechanism 50 at the time of receiving the banknote inserted in a proper posture with a proper angle, operating the cam mechanism to decrease the transport grip (for example, 25 gf) and performing skew correction automatically and efficiently at the time of introducing a banknote that receives a reaction force from a side wall due to improper insertion angle or improper insertion posture, and efficiently realizing return transport and prevention of continuous insertions while maintaining a strong transport grip state (for example, 70 gf) at the time of returning a banknote or at the time of standby for preventing continuous insertions.

The elastic biasing force of the elastic biasing member 40 is set such that the axial position of the drive roller can be finely adjusted corresponding to minute changes, for example, in a transport load applied from a banknote to a drive roller.

Specifically, the transport grip when the drive rollers are at the initial positions because the cam mechanism 50 is not operating is maintained at a value with which a banknote nipped between drive rollers and a driven roller can be reliably transported forward. Meanwhile, when the cam mechanism operates and the drive rollers move in a direction toward the operating positions, the transport grip is set to be weak further so that the banknote can change the direction by the reaction force received from a side wall. That is, the transport grip when the drive rollers are at the initial positions is set beforehand to a predetermined value by the elastic biasing member so that the transport grip can be decreased to a degree weak enough so that skew correction can be performed immediately when the drive rollers having received a load from the banknote start to move (be displaced) in the axial direction.

As will be explained in other embodiments described later, even if the number of the drive rollers 25 incorporated in the drive-side unit 20 is one or two or more, a mechanism that automatically corrects the skew of the banknote can be established. In the first embodiment, an example in which two drive rollers are arranged is described.

An external force exceeding a predetermined value applied to the banknote P being transported in a direction other than a normal transport direction includes a reaction force applied to a banknote from a side wall, a transport load resulting from a deformed portion formed in the banknote itself, a transport load from resistance of components and a convex portion provided in the transport path, and the like.

The drive rollers 25 and 25 are assembled to the shaft 22 so as to be able to move axially corresponding to the rotation direction thereof and the transport load to be received on the transported banknote P. In this example, the two drive rollers 25 and 25 arranged coaxially so as to be capable of relative rotation are biased in a direction the drive rollers approaching each other by the elastic biasing members 40 and 40, respectively. External ends of the respective elastic biasing members 40 and 40 formed by a coil spring are respectively retained and locked by respective bushes 41 and 41 in a state of being inserted into the shaft 22. A transport drive gear (transport driving member) 45 is arranged between the two drive rollers 25 and 25. A shaft center of the transport drive gear 45 is supported rotatably by the shaft 22 that does not rotate. In this example, each bush integrally rotates with a transport drive gear and an elastic biasing member so as to avoid generation of friction between the bush and these components.

The respective drive rollers 25 and 25 are constituted by core members 25A and 25A that are located on an inner diameter side as illustrated in FIG. 2(*c*), FIG. 3 and the like, and outer peripheral members 25B and 25B that are fixed to an outer periphery of each of the core members. The respective core members are made of hard resin or the like, and the respective outer peripheral members are made of rubber, resin, or the like having predetermined elasticity and friction resistance.

Regulation of an axial moving range of the drive roller is executed by, for example, causing the drive roller to abut on the bush 41.

In the following descriptions, in principle, with regard to the denoting of reference signs of components and members forming a pair such as the drive rollers 25 and 25 and the elastic biasing members 40 and 40, these reference signs are expressed simply as respective shafts 22, respective drive rollers 25, or the like.

The cam mechanism 50 includes a pair of cam members 57 that is integrally formed with the transport drive gear 45 arranged coaxially so as to be capable of relative rotation with respect to the respective drive rollers 25 about the shaft 22 that does not rotate, cam followers (cam mechanism elements) 55 that are respectively arranged in the respective drive rollers 25 or the respective cam members 57, cam portions (cam mechanism elements) 51 that are arranged in the respective cam members 57 or the drive rollers to come into contact with the cam followers by an elastic biasing force in a sliding manner, and changes the axial positions of the drive rollers between the initial positions and the operating positions (move the drive rollers forward and backward in the axial direction) as the cam followers change peripheral positions thereof, and stoppers 53 that are provided at both ends in a circumferential direction of the respective cam portions to regulate relative movement of the cam followers.

The cam mechanism 50 is constituted by the cam portion (cam mechanism element) 51 having a sloped portion 52 as one element constituting the cam mechanism, that is, as the cam mechanism element, and a cam follower 55 as the other cam mechanism element. In this example, each of the cam members 57 (each of the cam portions 51) is respectively arranged in a state of projecting from the both side faces in the axial direction of the transport drive gear (cam member) 45, and each of the cam followers 55 is arranged respectively on an inner periphery of each of the drive rollers 25. However, this arrangement is only an example, and the arrangement positions can be reversed. That is, the cam portion 51 can be provided on the side of the drive roller 25, and the cam follower 55 can be provided on the side of the transport drive gear 45.

Further, as in this example, when the cam follower is formed in a shape of a small protrusion, the contact between the cam follower and the sloped portion becomes point contact, line contact, or narrow surface contact. However, by forming an end face of the cam follower that comes into contact with the sloped portion in a wide sloped shape that comes into surface contact with the sloped portion, a contact portion between slopes is provided. That is, the cam follower does not need to be a small protrusion, and can be in any shape, so long as the cam follower can slide while being in pressure contact with the sloped portion.

When the cam mechanism 50 is not operating, each of the drive rollers is at the initial position where the respective drive rollers are close to each other and the transport grip with the banknote is maintained at an appropriate strength. However, when the cam mechanism 50 operates to displace the respective drive rollers to the operating positions apart from each other, the transport grip is further decreased to enable the banknote to slide horizontally on the drive rollers. As described above, since each of the drive rollers is displaced finely between the closest position to each other and the farthest position from each other, the elastic biasing force of the elastic biasing member 40 is set such that the transport grip finely changes according to the fine changes of the drive rollers in the axial direction. Further, when a load is applied to the drive rollers from a banknote in a state where the drive rollers are at the positions closest to each other, the elastic biasing force of the elastic biasing member is set such that the drive rollers immediately move axially with good responsiveness.

The transport drive gear 45 according to this example is constituted by a gear portion 45*a* and two cam members 57 (the cam portion 51=the sloped portion 52 and the stopper 53).

The respective cam portions 51, that is, respective sloped portions 52 provided in the cam members 57 of the transport drive gear 45 have a shape set to have a bilaterally symmetric shape and arranged to be bilaterally symmetrical, and the shape of each of the drive rollers including the cam follower 55 is also a bilaterally symmetric shape, and thus the elastic biasing force of the respective elastic biasing members is equivalent. It is also possible to adjust the moving direction and the range of a banknote by skew correction, by setting the shape of each of the sloped portions as a bilaterally asymmetric shape or by differentiating the elastic biasing forces of the elastic biasing members.

Further, in this example, there is provided a configuration that one cam member 57 includes two cam portions 51 and 51 divided into two in the circumferential direction, that is, individual sloped portions 52 and 52 including the stopper 53 have a circumferential length of 180 degrees, respectively. In other words, the two sloped portions 52 and 52 are arranged in a rotationally symmetric positional relation of 180 degrees. However, this configuration is only an example, and it is also possible to have a configuration that one cam member 57 has one cam portion 51 formed by a single sloped portion 52 including one stopper 53 and having a circumferential length of 360 degrees.

As illustrated in FIGS. 2(*a*) and (*b*) and FIG. 3(*c*), the transport drive gear (transport driving member) 45 includes the gear portion 45*a* engaging with another gear (not illustrated) to receive a driving force from the drive motor 60, the cam portions 51 that are integrally arranged on both sides of the gear portion 45*a* in a line-symmetric positional relation, and an integrated pair of hollow cylindrical sleeves 45*b* passing through a central portion of the gear portion 45*a*. The shaft 22 is inserted into the respective sleeves 45*b* so as to be able to rotate relatively to each other. Drive rollers and elastic biasing members are arranged around the outer peripheries of the respective sleeves so that the sleeves pass therethrough, and the bush 41 is fixedly arranged respectively at the ends of the respective sleeves. The shaft 22 and the transport drive gear 45 can be integrated to rotate and drive the shaft. However, in order to reduce a loss of driving energy, the configurations illustrated in the drawings are more preferable.

More specifically, the cam members 57 (the cam portions 51) constituting the cam mechanism 50 are respectively provided in an axially protruding manner on both faces in the axial direction of the transport drive gear 45, and each of the cam portions 51 includes a pair of sloped portions (cam surfaces) 52 with the axial position thereof changing in a form of a sloped portion toward the circumferential direction, and the stopper 53 that is arranged between the respective sloped portions. In this example, the respective sloped portions 52 are arranged in a pair at a circumferential interval of 180 degrees.

As illustrated in FIGS. 2(*a*), (*b*) and FIG. 3(*c*), the stopper 53 is constituted by a stopper 53*a* that is provided at an axially inner position of the sloped portion 52 and a stopper 53*b* that is provided at an axially outer position of the sloped portion. When the cam follower 55 is in contact with the stopper 53*a* provided at the axially inner position, a transport drive gear and drive rollers are at positions closest to each other, and when the cam follower 55 is in contact with the stopper 53*b* provided at the axially outer position, the transport drive gear and the drive rollers are at positions farthest from each other.

In this example, although a gear mechanism formed by the transport drive gear as the transport driving member is illustrated, a combination of a timing pulley and a timing belt, a combination of a roller and a belt, a combination of a pulley and a wire, or other drive transmitting members can be used instead of using a gear.

In each of the drive rollers 25, protruding cam followers (cam mechanism element) 55 that come into sliding contact with the respective sloped portions (cam mechanism element) 52 to rotate relatively to each other and move axially are provided at a circumferential interval of 180 degrees. The cam followers 55 are brought into pressure contact with the respective sloped portions 52 by the elastic biasing member 40, and come into contact with any position of the respective sloped portions constantly. The cross-sectional shape of the outer periphery of the respective drive rollers can be formed in a curved shape such as a circular arc, or can be formed in a tapered shape diagonally inclined as in the configuration example illustrated in FIG. 2. By forming the cross-sectional shape in a tapered shape, wear resistance can be improved.

More specifically, as illustrated in FIG. 2(*c*), each of the drive rollers 25 is in a ring-shaped body with a hole therein being put through, and the sleeve 45*b* of the transport drive gear 45 passes through a hollow portion thereof so that the respective drive rollers can rotate relatively to the transport drive gear (sloped portion) 45 within a predetermined angular range. The protruding cam follower 55 is provided in a protruding state on a hollow inner face of each drive roller, and has a configuration in which when the sleeve of the transport drive gear is inserted into the hollow inner portion of the drive roller, an end face of the cam follower can come into contact with the opposing sloped portion 52. Further, when the respective cam followers move circumferentially along the respective sloped portions and come into contact with the respective stoppers 53*a* and 53*b* located at a terminal end thereof, the cam followers stop the relative movement with respect to the sloped portions. That is, when the cam followers come into contact with the stopper 53*b* at the time of normal rotation of the drive roller, the cam followers rotate in the normal direction integrally with the transport drive gear 45 thereafter, and when the cam followers come into contact with the stopper 53*a* at the time of reverse rotation of the drive roller, the cam followers rotate in a reverse direction integrally with the transport drive gear 45 thereafter.

Since each of the sloped portions has a bilaterally symmetric shape, if one banknote receives a reaction force from a side wall in a state where the banknote is in contact with two drive rollers simultaneously, the both drive rollers axially move equally on both sides. Therefore, the respective sloped portions operate so as to move the banknote in a direction moving away from the side wall.

If such a configuration is employed that a banknote is leaned to one side wall at the time of skew correction, it suffices that the sloped portion is configured so that it is not made bilaterally symmetrical, so that one of the drive rollers axially moves quicker than the other drive roller.

The transport drive gear 45 receives a driving force from the drive motor 60 to rotate and drive in the normal direction, and when a banknote is introduced in a proper posture so as not to come into contact with a side wall, the respective drive rollers 25 are continuously biased inward equally by the right and left elastic biasing members 40. Therefore, each of the drive rollers maintains its equal axial position (initial position) with respect to the transport drive gear 45 (the cam member 57). Accordingly, as described later, in a relation with a driven roller 102, the banknote transport grip due to the drive roller can be maintained at an appropriate value suitable for transport. The transport grip at this time has a value such that a banknote can be stably transported in a forward direction when the drive rollers rotate in the normal direction.

Meanwhile, when the respective drive rollers are rotating in the normal direction, if a skewed banknote comes into contact with a side wall and a reaction force in a direction opposite to the transport direction is applied thereto even slightly, the both drive rollers 25 are immediately displaced axially outward against a biasing force due to the elastic biasing members 40. Therefore, as described later, in the relation with the driven roller 102, the transport grip of the drive rollers with respect to the banknote decreases, and thus posture correction becomes possible in a direction of separating the banknote from the side wall (in a direction of decreasing damage received on the banknote from the side wall).

As illustrated in the perspective view of FIG. 4, the driven-side unit 100 includes the driven roller 102 that changes the transport grip, that is, contact pressure and friction resistance between the outer periphery of drive rollers and a banknote according to a change in the axial position of the drive rollers 25, a bracket 103 including a shaft support 103*a* that rotatably supports the driven roller, and elastic members 104 that bias the driven roller toward the drive-side unit 20 via the bracket.

The driven roller 102 according to this example has a horizontally long crown shape. That is, the driven roller 102 has a shape (a tapered crown shape) such that a central portion 102*a* has a cylindrical shape with the same diameter, and outer diameters of respective end portions 102*b* extending axially outward from the both ends of the central portion gradually decrease in a tapered shape as moving outward. In this example, each end portion 102*b* has an external shape (an outer diameter) gradually decreasing in a straight form as viewed from the front. However, the external shape can be a barrel crown shape in which the external shape gradually decreases in a curved shape, or a boundary between the central portion 102*a* and the respective end portions 102*b* can be in a curved shape.

The cam mechanism 50 is switched between a non-operating state and an operating state according to changes in the transport load received on the banknote P from a side wall or the like by a combination of the drive rollers 25 and the driven roller 102, and the transport grip in a nip portion between the both rollers fluctuates. While the transport grip in a state where an interval between the two drive rollers is the narrowest is suitable for normal transport of banknotes, the transport grip has a strength to an extent that a change of a moving direction of the banknote is not easy. Meanwhile, the transport grip in a state where the interval between the two drive rollers is the widest is such that movement of banknotes in a direction moving away from a side wall becomes easy due to the reaction force from the side wall.

[Skew Correcting Operation at the Time of Normal Rotation]

Figure 5:
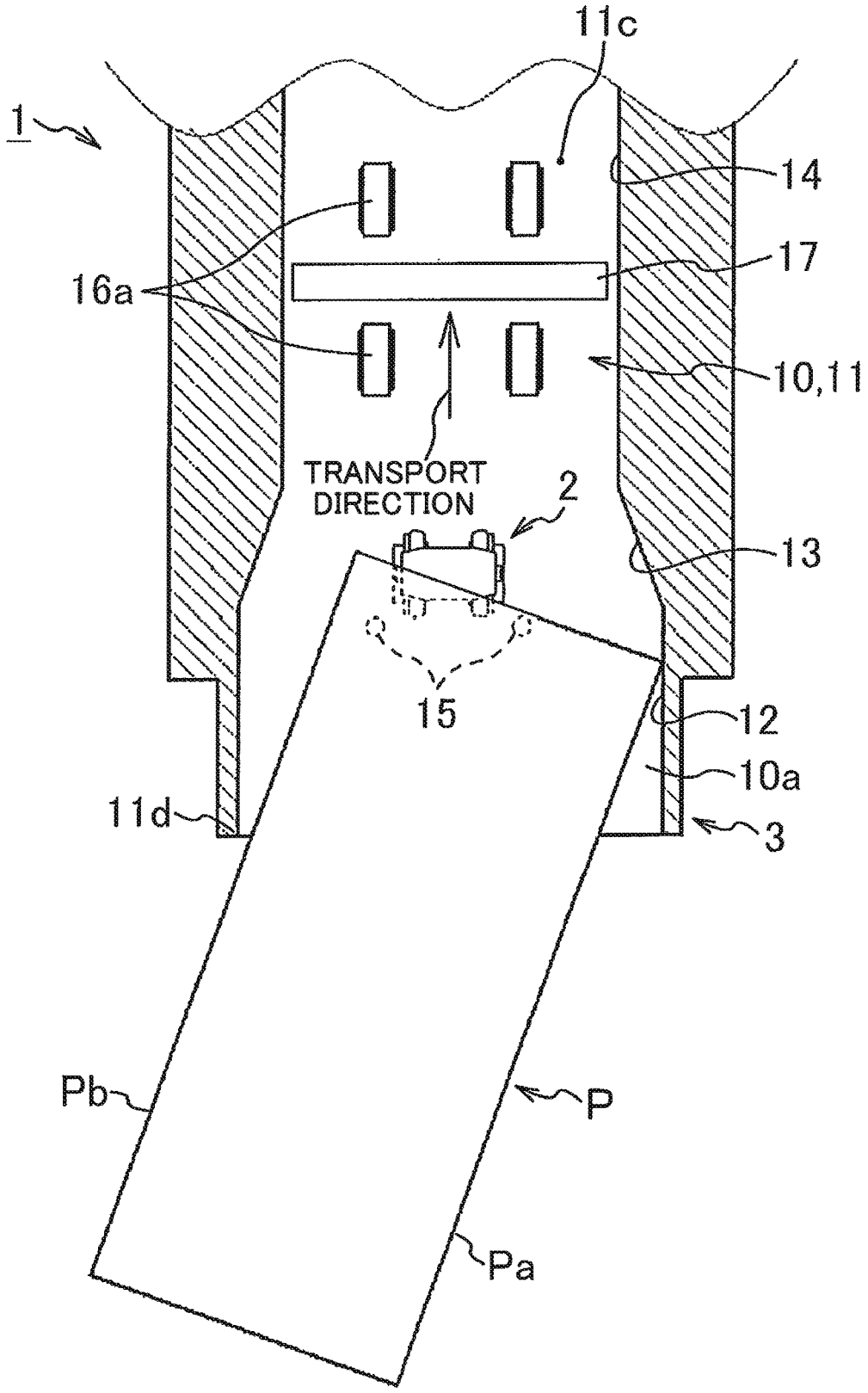
FIG. 5 is a plan view illustrating a skew correction principle, and is a perspective view of the drive-side unit.
Figure 6:
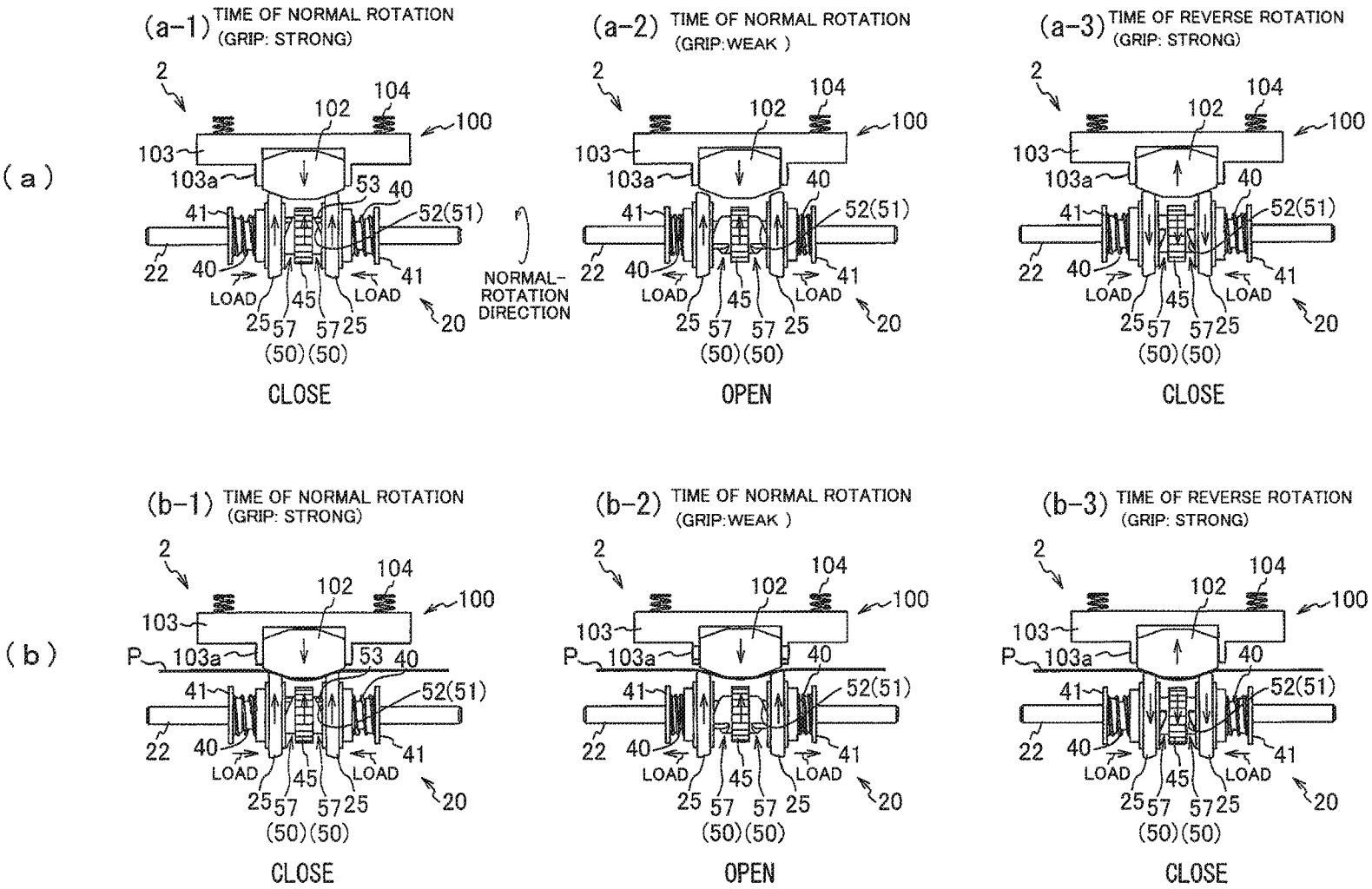
FIGS. 6(*a*) and (*b*) are front elevational views of a drive-side unit and a driven-side unit, where (a-1), (a-2), and (a-3) respectively illustrate an approaching state of drive rollers at the time of normal rotation in a state where there is no banknote in a nip portion, a separating state of the drive rollers, and a state at the time of reverse rotation, and (b-1), (b-2), and (b-3) respectively illustrate an approaching state of the drive rollers at the time of normal rotation in a state where there is a banknote in the nip portion, a separating state of the drive rollers, and a state at the time of reverse rotation.

Next, FIG. 5 are plan views illustrating a principle of a skew correction by the friction transport device, and a perspective view of a drive-side unit, and FIGS. 6(*a*) and (*b*) are front elevational views of a drive-side unit and a driven-side unit. FIGS. 6(*a*-1), (*a*-2), and (*a*-3) respectively illustrate drive rollers at the time of normal rotation in a state where there is no banknote in a nip portion (transport grip: strong), a separating state of the drive rollers (transport grip: weak), and a state at the time of reverse rotation (transport grip: strong), and FIGS. 6(*b*-1), (*b*-2), and (*b*-3) respectively illustrate an approaching state of the drive rollers at the time of normal rotation in a state where there is a banknote in the nip portion (transport grip: strong), a separating state of the drive rollers (transport grip: weak), and a state at the time of reverse rotation (transport grip: strong).

Figure 7:
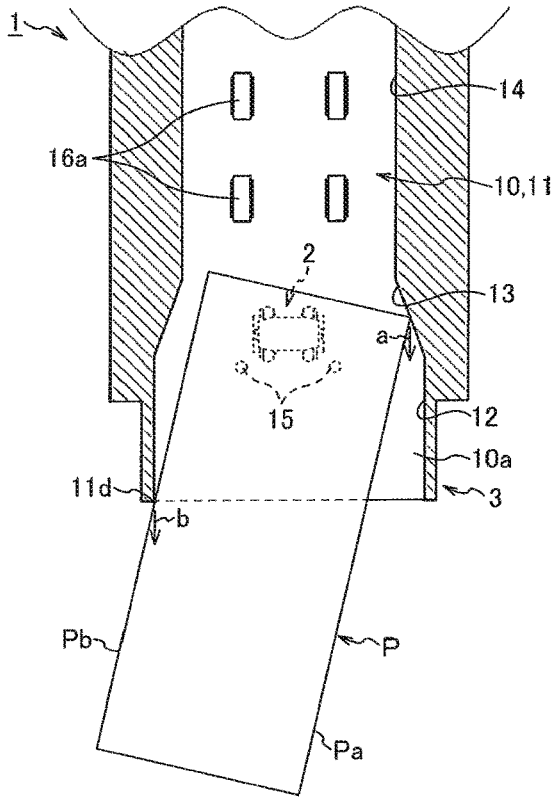
FIGS. 7(*a*) and (*b*) are respectively a plan view and a relevant-part enlarged view of a banknote transport path.
Figure 7:
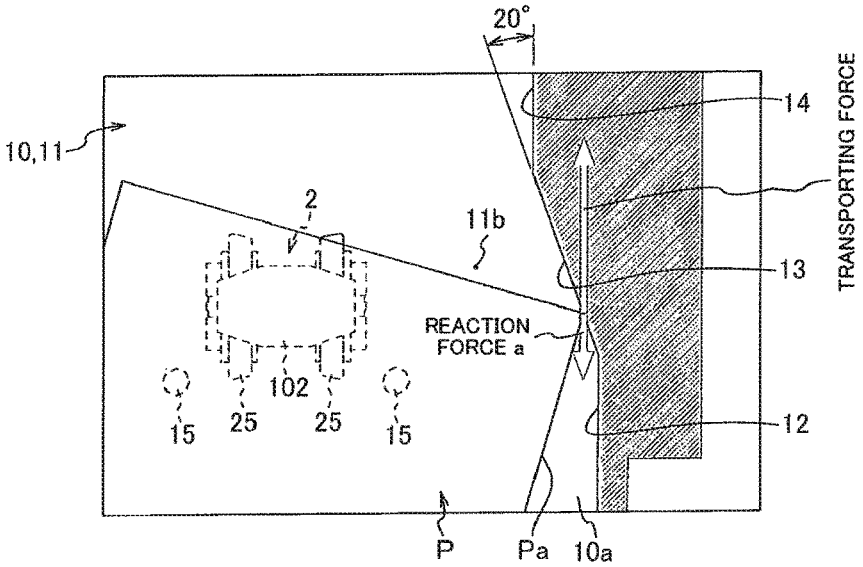
Figure 8:
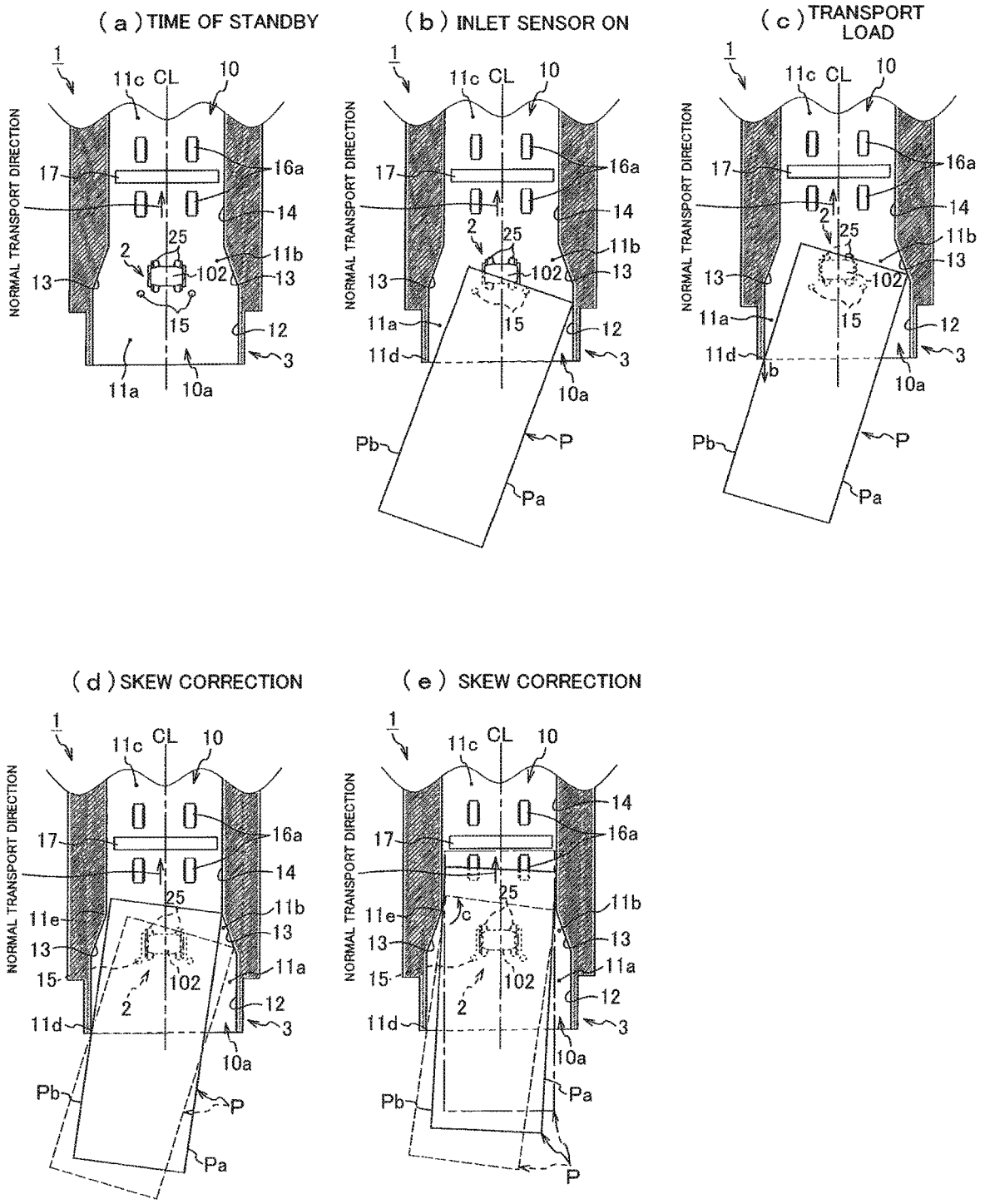
FIGS. 8(*a*) to (*e*) are plan views of a banknote transport path for explaining a procedure in which a banknote having entered the banknote transport path in a skewed state is subjected to skew correction in a process of moving forward.
Figure 9:
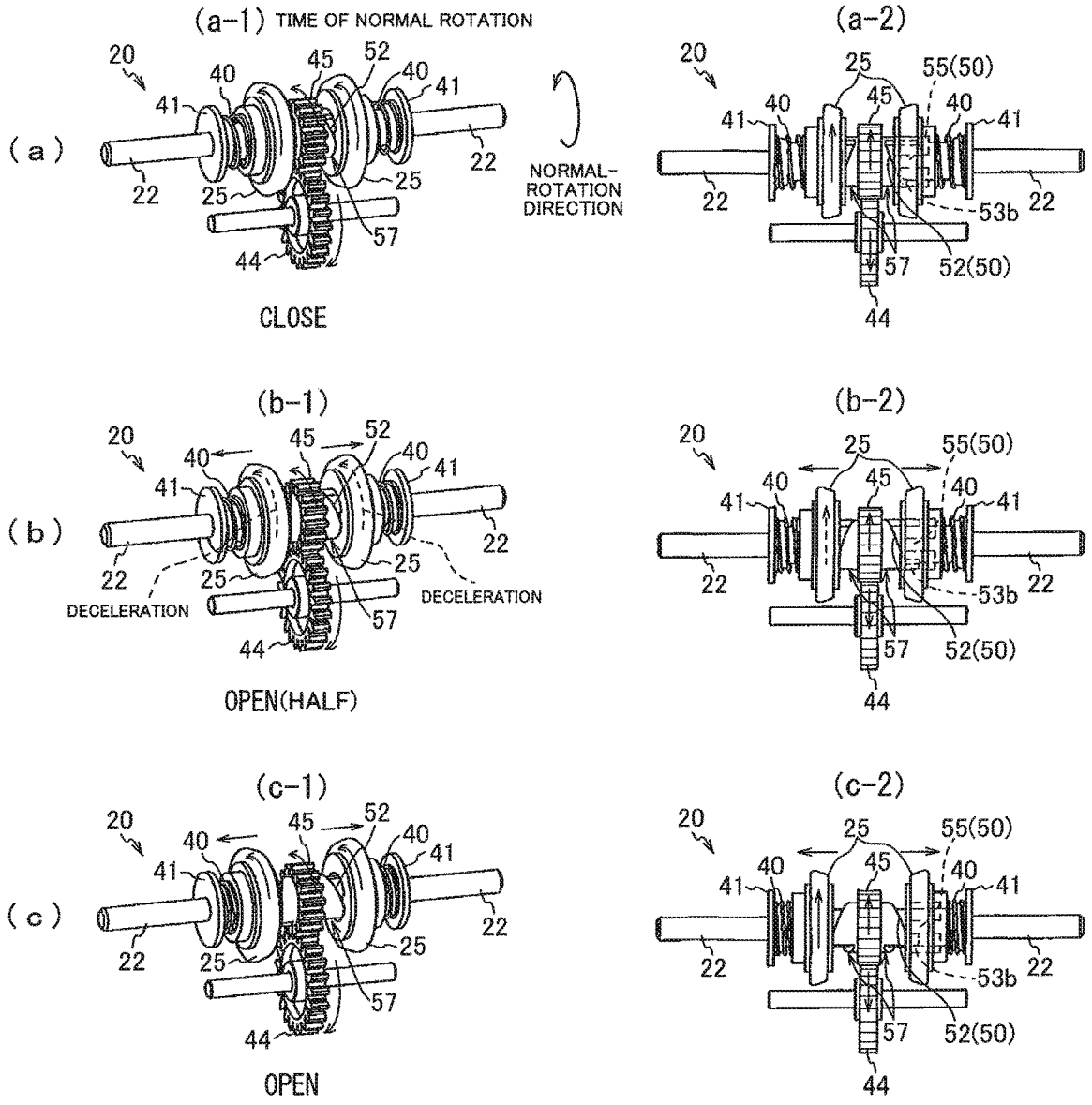
FIG. 9 are explanatory diagrams illustrating a skew-correcting operation procedure of a drive-side unit, where (a) illustrates a state where drive rollers performing normal rotation are closest to each other, (b) illustrates a state where the drive rollers performing normal rotation have started to separate from each other, and (c) illustrates a state where an interval between the drive rollers performing normal rotation becomes maximum and the transport grip is weak, (a-1), (b-1), and (c-1) are perspective views of the drive-side unit, and (a-2), (b-2), and (c-2) are front elevational views of the drive-side unit in which a cam mechanism is illustrated in a perspective state.

FIGS. 7(*a*) and (*b*) are respectively a plan view and a relevant-part enlarged view of a banknote transport path in a state where skew has occurred. FIGS. 8(*a*) to (*e*) are plan views of a banknote transport path for explaining a procedure in which a banknote having entered the banknote transport path in a skewed state is subjected to skew correction in a process of moving forward. FIG. 9 are explanatory diagrams illustrating a skew-correcting operation procedure of a drive-side unit, where (a) illustrates a state where drive rollers performing normal rotation are closest to each other, (b) illustrates a state where the drive rollers performing normal rotation have started to separate from each other, and (c) illustrates a state where the interval between the drive rollers performing normal rotation becomes maximum and the transport grip is weak. FIGS. 9 (*a*-1), (*b*-1), and (*c*-1) are perspective views of the drive-side unit, and FIGS. 9 (*a*-2), (*b*-2), and (*c*-2) are front elevational views of the drive-side unit in which the cam mechanism 50 is illustrated in a perspective state.

The skew correcting operation is described in detail with reference to FIG. 5 to FIG. 9.

At the time of standby before receiving a banknote, the drive rollers 25 and 25 receive a load from the elastic biasing members 40 and 40 formed by a compression spring and are at the innermost positions (positions closest to each other, initial positions), and in a state where the outer peripheries thereof are brought into contact (into pressure contact) with an outer periphery of the driven roller 102 with a strong force (FIG. 6(*a*-1), FIG. 8(*a*)).

When a banknote is inserted in a posture inclined rightward from the slot 10*a* as illustrated in FIG. 5 and FIG. 8(*b*) at the time of the friction transport device 2 being in a standby state, the inlet sensor 15 detects the banknote P, and the drive motor transmits a driving force in a normal-rotation direction indicated by an arrow to the gear portion 45*a* of the transport drive gear 45 via a transmission gear 44 as illustrated in FIGS. 6(*a*-1) and (*b*-1), thereby rotating each of the drive rollers 25 in the forward direction indicated by an arrow. The banknote P is transported inside of the banknote transport path 10 by a strong transport grip between peripheral surfaces of the respective drive rollers rotated in the forward direction and the banknote surface. Note that the transport grip at this time point is at a degree that can prevent occurrence of slippage between the banknote and a nip portion, when a load is applied from the banknote in a direction different from the normal transport direction.

Since the respective drive rollers 25 are biased to an axially inward direction (a direction of increasing the transport grip) by the elastic biasing members 40, the cam followers 55 on the inner peripheries of the respective drive rollers 25 rotate together with a transport drive gear, while maintaining the contact with the respective sloped portions 52 thereof. If a speed difference occurs between the drive rollers and the transport drive gear even slightly, cam followers move relatively with respect to the sloped portions.

As illustrated in FIG. 6(*b*-1), the outer peripheries of the respective drive rollers 25 and the driven roller 102 overlap on each other with respective apexes being into contact with each other, so as to transport the banknote P by sandwiching the banknote P therebetween, while bending a widthwise central part of the banknote P in a U-shape (gap transport). In a normal rotation state illustrated in FIGS. 6(*a*-1) and (*b*-1), since the respective drive rollers 25 are at axially inside positions where the drive rollers 25 are close to each other and the cam mechanism 50 is in a non-operating state, the transport grip at the nip portion with the driven roller 102 becomes stronger to an extent that can transport the banknote stably in the normal transport direction. In the normal rotation state illustrated in FIGS. 6(*a*-2) and (*b*-2), since the cam mechanism 50 starts to operate and the respective drive rollers start to be displaced axially outward, the transport grip becomes weaker than that in the state illustrated in FIGS. 6(*a*-1) and (*b*-1).

As illustrated in FIG. 7(*a*) and FIG. 8(*c*), the banknote P inserted by a user from the slot 10*a* of the banknote transport path 10 in an inclined state with an angle larger than a predetermined allowable angle with respect to the normal transport direction indicated by an arrow becomes a state where, in a process of being transported inward by the friction transport device 2, a tip corner of a right side edge Pa of the banknote P comes into contact with the intermediate side wall 13 and a left side edge Pb of the banknote comes into contact with an entry-side end 11*d* of the entry-side side wall 12. When the tip corner of the banknote being transported comes into contact with the side wall surface and the left side edge Pb thereof comes into contact with the entry-side end 11*d*, the banknote decelerates by receiving reaction forces a and b (transport loads) from respective contact portions.

As illustrated in FIGS. 7(*a*) and (*b*) and FIG. 8(*c*), since the tip corner of the one side edge Pa of the banknote P comes into contact with the intermediate side wall 13 being a tapered surface, the banknote P receives a reaction force (an arrow a) in a direction different from the normal transport direction. At the moment when the corner of the banknote comes into contact with the intermediate side wall 13, as illustrated in FIGS. 6(*a*-1) and (*b*-1), the both drive rollers 25 are into contact with an inside portion of the tapered end portions 102*b*, that is, a large diameter portion of the driven roller 102. Therefore, a reaction force a applied to the banknote P from the intermediate side wall 13 is smaller than the transport grip between the both drive rollers 25 and the banknote, and thus the moving direction of the banknote P does not change. Meanwhile, immediately after the contact, the respective drive rollers start to be displaced axially outward (in a direction of decreasing the transport grip) against the elastic biasing force due to an increase of the load from the reaction force a applied to the banknote P, thereby decreasing the transport grip at once. That is, since the cam mechanism 50 operates, as illustrated in FIGS. 6(*a*-2) and (*b*-2) and FIGS. 9(*b*) and (*c*), the respective drive rollers move axially outward to form a gap between the drive rollers and the driven roller, thereby decreasing the transport grip to cancel out the reaction force a from the side wall acting on the banknote P. When the transport grip acting on the banknote P becomes smaller than the reaction force a applied from the intermediate side wall 13, the banknote P can shift in a direction of canceling out the reaction force a from the wall surface, that is, in a direction and posture aligned with the central axis CL of the banknote transport path 10.

A relation between a reaction force b generated due to the contact between the left side edge Pb of the banknote and the entry-side end 11*d* and the transport grip is similar to the relation between the reaction force a and the transport grip.

It is possible to handle a banknote skewed largely by about 20%, as illustrated in FIG. 7(*b*).

That is, in a state where the transport grip between the drive rollers 25 and the banknote P is larger than the reaction forces a and b (FIG. 6(*b*-1), FIG. 9(*a*)), when the reaction forces a and b from the side wall surfaces are applied continuously to the drive rollers 25 via the banknote P, the reaction forces a and b act as a rotation load to the drive rollers, and the transport speed of the banknote P and the rotation of the respective drive rollers both decrease (FIG. 6(*b*-2), FIG. 9(*b*)).

That is, since there is strong friction resistance between the respective drive rollers 25 and the banknote P, the rotational speed of the respective drive rollers decreases together with the decelerated banknote. At this time, the respective drive rollers (the respective cam followers 55) are pushed out by the respective sloped portions 52 and start to slide axially outward, due to the difference in the rotational speed between the drive rollers and the transport drive gear 45.

Since the transport drive gear 45 receives a rotational driving force from the drive motor 60, a load is generated at a contact point between the respective drive rollers 25 and the transport drive gear 45, that is, at a contact point between the respective sloped portions 52 and the respective cam followers 55, due to the reaction forces a and b applied to the banknote. Accordingly, since the drive rollers 25 (the cam followers 55) receive a reaction force from the sloped portions 52 of the transport drive gear 45, the drive rollers 25 start to move in a direction of canceling out the reaction force, that is, axially outward (in a direction of decreasing the transport grip) against the elastic biasing force (FIG. 6(*b*-2), FIG. 9(*b*)).

In a process in which the drive rollers 25 move axially outward, a gap is formed between a peripheral surface (the end portion 102*b*) of the driven roller 102 and the drive rollers 25, thereby decreasing the transport grip. When the transport grip acting on the banknote P becomes smaller than the reaction forces a and b that are applied from side walls, axial movement of the drive rollers 25 stops (FIG. 9(*c*)). In this manner, the sliding amount of the drive rollers changes according to the changes in the transport load.

In a state where the transport grip has started to decrease as illustrated in FIG. 9(*b*), the banknote P starts to slide toward a central part of the transport path on the surfaces of the drive rollers to release the transport load as illustrated in FIGS. 8(*c*), (*d*), and (*e*).

When the banknote starts to slide, axially outward sliding of the drive rollers stops (FIG. 9(*c*)). In FIG. 8(*c*), the banknote is in a state where a tip right corner comes into contact with the right intermediate side wall 13 and the left side edge Pb comes into contact with the entry-side end 11*d*. However, in a state of further moving forward as illustrated in FIGS. 8(*d*) and (*e*), a tip portion of the banknote enters the inner transport surface 11*c* and finally becomes a posture parallel to the inner side wall 14 (completion of skew correction). Specifically, in the state of FIG. 8(*e*), the banknote moves forward while rotating in a counterclockwise direction by receiving a force in a rotation direction indicated by an arrow c due to a reaction force generated in a contact point between a corner portion 11*e* at a terminal end of the left intermediate side wall 13 and the left side edge Pb of the banknote, thereby enabling to correct the transport posture.

In a state where the drive rollers stop the axial movement in FIG. 9(*c*), as illustrated in a perspective view of the cam mechanism in FIG. 9(*c*-2), the cam followers 55 of the drive rollers abut on the stoppers 53*b* of the transport drive gear, and the drive rollers and the transport drive gear start to rotate integrally in the normal rotation direction.

In this manner, the drive rollers 25 axially move automatically and non-intermittently until the transport grip decreases to an appropriate value sufficient to cancel out the transport load acting on the banknote P. Since the movement is non-intermittent axial movement, the behavior of the banknote becomes a continuous and stable state.

The banknote P keeps a contact point with the drive rollers 25 and the driven roller 102 constantly due to "firmness" (coarseness, stiffness) of the banknote itself. Therefore, even if the transport grip is weak and the drive rollers 25 axially move, the banknote P can receive a transport driving force continuously.

As described above, according to the friction transport device 2 of the present invention, when the transport grip acting on the banknote P from the nip portion between the drive rollers 25 and the driven roller 102 becomes smaller than the reaction force applied to the banknote from the intermediate side wall 13, the banknote P starts to slide horizontally on the drive rollers 25, is transported toward the center of the banknote transport path along the side wall surfaces, while changing its posture in the direction of canceling out the reaction force from a wall surface, and is aligned with the central axis CL of the banknote transport path.

When the reaction force from the side wall surface acting on the banknote P is canceled out, the respective drive rollers 25 move axially inward and return to the original positions due to the pressing force of the respective elastic biasing members 40.

Since the friction transport device has a structure in which at the time of returning the banknote P or at the time of standby, the cam mechanism 50 is in a non-operating state and the drive rollers 25 do not move axially, the banknote P can be returned or continuous insertions of the banknotes can be prevented by a strong transport grip.

With regard to the elastic member 104 that biases a driven roller, if the elastic biasing force thereof is set to be weak, the transport grip between drive rollers rotating in the normal direction and a banknote decreases. Therefore, when the banknote is inserted in a skewed state into a nip portion between the both rollers, not only the drive rollers are likely to be axially separated from each other, but also the driven roller moves up. Accordingly, the grip strength is further weakened and the skew correction function is improved. Note that, if the elastic biasing force of the elastic member 104 is too weak, the driven roller is lifted at the time of returning the banknote by reversely rotating the drive rollers to reduce (decrease) the transport grip, and thus return of the banknote becomes difficult. In order to return the banknote, it is effective to increase the transport grip by strengthening the spring of the elastic members 104.

In FIG. 8, a case where the tip right corner of the banknote comes into contact with the intermediate side wall 13 as a result of inserting the banknote diagonally from the slot 10*a* has been exemplified. However, even if the insertion posture of the banknote is not in a skewed state, that is, the posture is parallel to the normal transport direction, when the banknote is inserted while leaning to the right (or to the left) of the transport path to an extent that the tip right corner comes into contact with the intermediate side wall 13, the reaction force applied to the banknote from the side wall is generated. Therefore, the cam mechanism 50 operates and exhibits a behavior of moving the banknote in a width direction toward the widthwise central part of the transport path.

That is, the friction transport device 2 according to the present invention can correct the transport position in the width direction by operating the cam mechanism 50, not only for a case where the banknote is inserted in a skewed state but also for all the cases where the banknote is inserted in a state where the tip corner thereof comes into contact with the tapered side wall 13.

[Reverse Operation at the Time of Returning Banknote]

Next, a reverse operation of drive rollers at the time of returning the banknote P is described.

In order to correct the transport position and the transport posture of a banknote to the normal state by operating the cam mechanism 50, the transport grip between the drive rollers and the banknote needs to be weakened. On the other hand, there is a problem on measures for jamming such that when a jam or the like occurs with a banknote once introduced and the drive rollers are rotated reversely to return the banknote, if the transport grip is weak, the return transport strength becomes weak. That is, there are conflicting demands such that a sufficiently strong transport grip is desired for returning the banknote, while it is desired to weaken the transport grip to correct the transport position and the posture of the banknote once introduced. Any technique that satisfies such demands with a simple and low-cost configuration has not been developed hitherto.

According to the present invention, such conflicting demands can be satisfied with a simple and low-cost configuration. Particularly, the present invention is characterized such that continuous and non-intermittent transport can be performed for both cases at the time of normal rotation of drive rollers and at the time of reverse rotation thereof.

Figure 10:
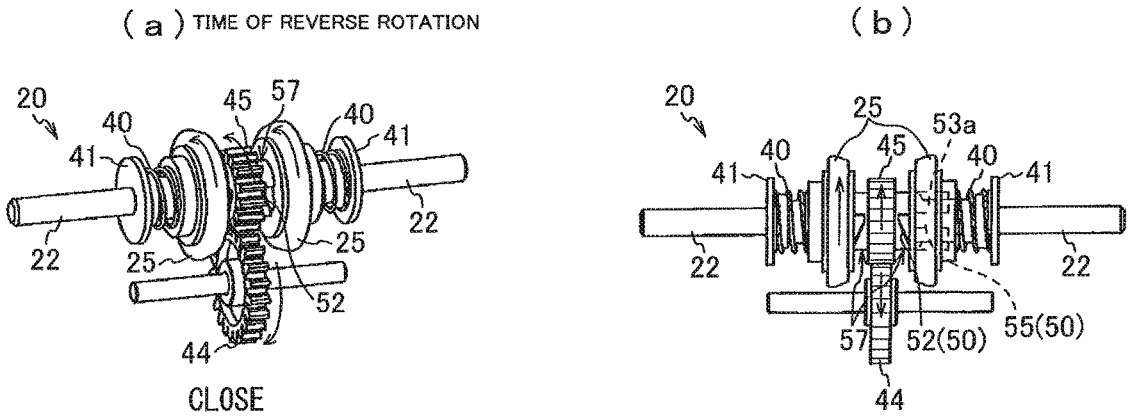
FIGS. 10(*a*) and (*b*) are respectively a perspective view illustrating a state where a drive-side unit is rotated reversely, and a front elevational view illustrating a cam mechanism in a partially perspective state.

FIGS. 10(*a*) and (*b*) are respectively a perspective view illustrating a state where the drive-side unit is rotated reversely, and a front elevational view illustrating the cam mechanism in a partially perspective state. FIGS. 6(*a*-3) and (*b*-3) illustrating the reversely rotated state are also referred to.

At the time of error occurrence, such as when the control unit 200 judges that the banknote P having been inserted from the slot 10*a* cannot be accepted based on a result of recognition by the recognition sensor 17 (the banknote P being forged, soiled, deformed, jammed, and the like), the control unit 200 performs an operation to return the rejected banknote to the slot 10*a* by reversely rotating the transport drive gear 45 by the drive motor 60. As illustrated in FIG. 10(*b*) and FIG. 6(*b*-3), when the transport drive gear 45 is reversely rotated, the protruding cam followers 55 on the inner peripheries of the respective drive rollers 25 receive a rotational driving force from the sloped portions 52 of the transport drive gear 45 to rotate relatively to each other, while rotating in the reverse direction together with the sloped portions 52. As a result of continuous relative rotation of the cam followers and the sloped portions, the cam followers abut on the stoppers 53*a* located axially inside to stop the relative rotation, and thus the transport grip becomes maximum.

Since the cam followers 55 of the respective drive rollers 25 receive a reverse-rotational driving force from the sloped portions 52 (the stoppers 53*a*), even if a rotation load is applied from outside, the cam followers 55 do not move axially to maintain their initial state of being displaced innermost. When the banknote P is reversely transported toward the slot 10*a*, the driven roller 102 supported vertically movably by the elastic members 104 is raised by the thickness of the banknote P and can perform return transport by sandwiching the banknote P between the drive rollers and the driven roller.

At this time, since the drive rollers 25 do not move axially, return of the banknote can be advantageously performed while maintaining a strong transport grip. That is, when the drive rollers are reversely rotated for the return, the transport grip does not decrease regardless of the presence of a banknote and the transport state thereof.

The reason why the drive rollers do not move axially and can maintain a strong transport grip at the time of reverse rotation of the drive rollers is that at the time of reverse rotation, the elastic biasing members 40 elastically bias the drive rollers 25 axially to press the drive rollers 25 to axial positions where the transport grip becomes strong.

In this manner, at the time of reverse rotation of the drive rollers, the respective drive rollers are closest to each other and maintain the state of being in contact with the driven roller 102, regardless of the volume of the transport load. Therefore, the transport grip and returning force become strong to facilitate and ensure the return transport. Further, the returning force at the time of banknote jamming becomes strong.

At the time of transport of the banknote, the driven roller 102 is raised vertically by the thickness of the banknote to facilitate the passage of the banknote.

[Insertion Prevention at the Time of Standby]

Next, insertion prevention (prevention of two continuous insertions) of banknotes or the like at the time of standby is described.

Figure 11:
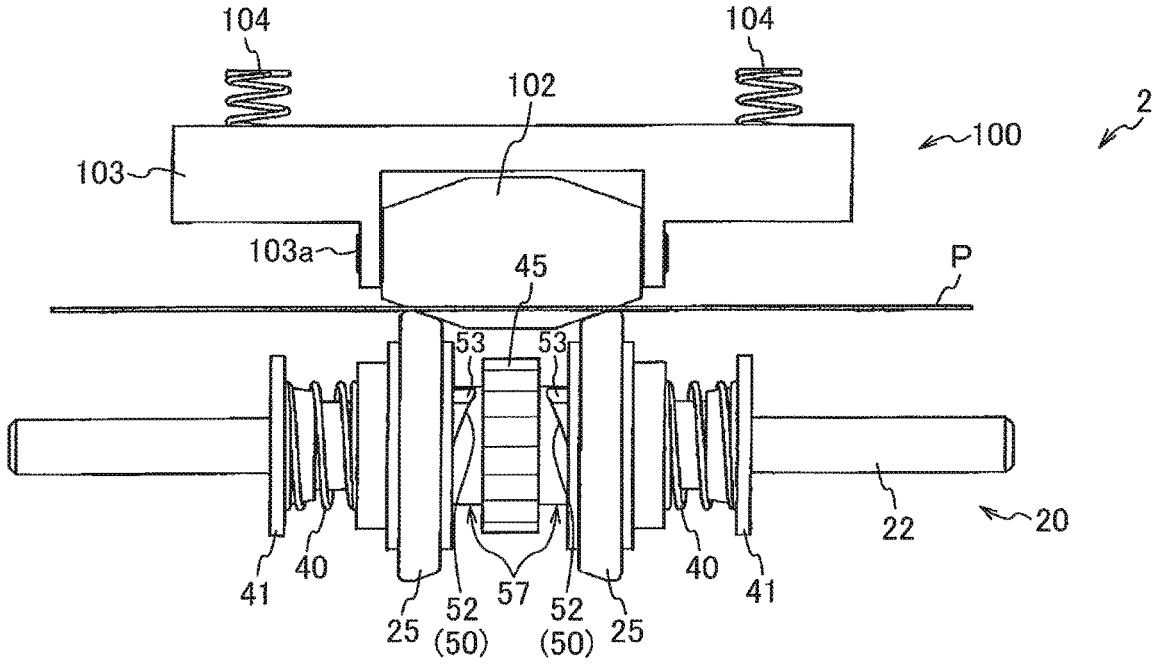
FIG. 11 is a front elevational view illustrating a state of the friction transport device in a standby state where a second banknote is not accepted.

FIG. 11 is a front elevational view illustrating a state of the friction transport device in a standby state where the second banknote is not accepted since the first banknote inserted beforehand is being processed.

The banknote transport device 1 is incorporated in a banknote handling device such as an automatic vending machine and a change machine, and a deposited banknote is deposited in a cash box after being recognized by the recognition sensor 17. In the banknote handling device, there is a demand to simplify the configuration and to achieve cost reduction by driving the drive rollers 25 and the transport rollers 16*a* arranged near the slot 10*a* by a single drive motor. However, in a type using a single drive motor, there is a disadvantage in that if an insertion of a subsequent banknote is detected by a banknote detection sensor (not illustrated) inside the transport path before the deposit processing with respect to the first banknote is complete, the drive rollers and the transport rollers need to be reversely rotated to return the both banknotes collectively. In order to deal with such a disadvantage, it is required to block the insertion of the subsequent banknote without exception, before completion of the deposit processing of the preceding banknote.

However, the transport grip needs to be decreased in order to exhibit the skew correction function by the drive rollers whereas the transport grip needs to be set strong in order to block the insertion of the subsequent banknote, and it has been difficult heretofore to satisfy these two demands simultaneously.

In this connection, according to the banknote transport device 1 (banknote handling device) including the friction transport device 2 of the present invention, transmission of a driving force from a drive motor to the drive rollers 25 is stopped by using a clutch, at a timing when the preceding banknote is detected by a banknote detection sensor (not illustrated) in the inner part of the transport path at a position where the preceding banknote passes through the drive rollers 25. Even if it is attempted to insert the second banknote continuously after the drive rollers have been stopped, loading of the banknote can be prevented because the grip (a nipping force) at a contact point between the drive rollers 25 in the stopped state and the driven roller 102 becomes strong to an extent that can block the insertion. In this manner, according to the present invention, the insertion of the subsequent banknote can be blocked by stopping driving of the drive rollers by the automatic grip adjustment function of the friction transport device 2.

The reason why a state where the transport grip is strong can be maintained without axially moving the respective drive rollers biased to the closest position to each other by elastic biasing members at the time of stopping driving of the drive rollers is that the elastic biasing members 40 elastically bias the drive rollers 25 axially to press the drive rollers 25 to the axial positions where the transport grip becomes strong.

As described above, in the banknote transport device 1 according to the present invention, in a period during which the first banknote has been transported into the banknote transport path 10 from the slot 10*a* through the friction transport device 2 and the recognition processing by the recognition sensor 17 or deposit processing to a cash box is being performed, a standby state in which the second banknote is not accepted by the friction transport device 2 is maintained. That is, after a rear end of the first banknote has passed the inlet sensor 15, the control unit 200 temporarily interrupts transmission of a driving force to the transport drive gear 45 for a certain period to stop driving of the respective drive rollers 25, thereby setting the friction transport device 2 to the standby state.

At the time of standby when the drive rollers stop driving, the grip at a contact point between the drive rollers and the driven roller is maintained in a strong state, regardless of the presence of a banknote and the transport state thereof.

In this standby state, the respective drive rollers 25 and the driven roller 102 are in a stopped state, and apexes of the respective outer peripheries thereof overlap on each other. Further, the respective drive rollers at the time of being stopped are at the axially innermost positions and do not move axially to maintain the strong grip with the driven roller, and thus, unless the respective drive rollers rotate, the insertion of the second banknote P can be prevented effectively.

Particularly, as illustrated in FIG. 11, when driving is stopped, a banknote insertion gap formed between the two drive rollers and the driven roller has a U-shape, and thus it is difficult to insert a flat banknote into this gap.

[Return Operation of Cards]

Next, a return operation when a plate-like medium such as a card that is harder, shorter, and thicker than a banknote is erroneously inserted is described.

Figure 12:
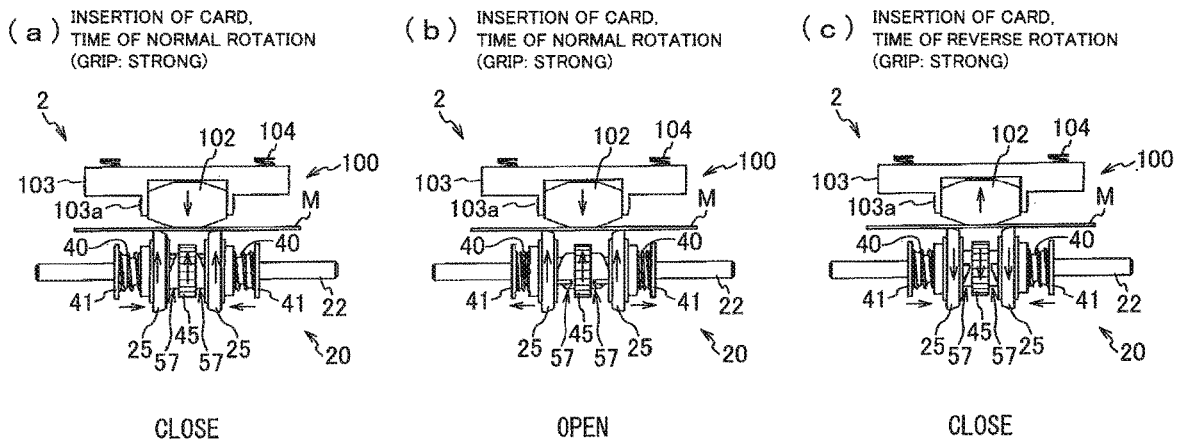
FIG. 12 are front elevational views of the friction transport device in a state where a card or the like is erroneously inserted, where (a) illustrates a state where drive rollers are closest to each other at the time of normal rotation, (b) illustrates a state where an interval between the drive rollers is increased at the time of normal rotation, and (c) illustrates a state where the drive rollers are closest to each other at the time of reverse rotation.

FIG. 12 are front elevational views of the friction transport device in a state where a card or the like is erroneously inserted, where (a) illustrates a state where drive rollers are closest to each other at the time of normal rotation, (b) illustrates a state where an interval between the drive rollers is increased at the time of normal rotation, and (c) illustrates a state where the drive rollers are closest to each other at the time of reverse rotation.

The drive rollers 25 perform an opening and closing operation in the axial direction according to changes in the transport load by the cam mechanism 50. In a case where a hard card medium M is pressed in, the drive rollers 25 nip the card medium with the driven roller 102. Therefore, the transport grip does not change, and a strong grip state is maintained in any of FIGS. 12(*a*), (*b*), and (*c*).

When the hard medium M such as a card is erroneously inserted into the banknote transport path 10 and transported, the control unit 200 shifts to a return operation to reversely rotate the drive motor 60, thereby reversely rotating the transport drive gear 45, by performing insertion detection by the inlet sensor 15 and length detection by a width aligning start sensor (not illustrated) (FIG. 12(*c*)).

The respective drive rollers 25 rotate together with the transport drive gear 45 at the time of reverse rotation, and thus continuously maintain axial positions closest to each other, and do not slide axially outward, thereby maintaining a strong transport grip. Conversely, the respective drive rollers 25 at the innermost positions rotate together with the transport drive gear 45 and do not move axially.

The reason why the drive rollers do not move axially and can maintain a strong transport grip at the time of reverse rotation of the drive rollers is that, at the time of reverse rotation, the elastic biasing members 40 elastically bias the drive rollers 25 axially to press the drive rollers to the axial positions where the transport grip becomes strong.

At the time of return transport, the driven roller 102 is raised by "overlapped height with drive rollers"+"thickness height of medium M" against the biasing force of the elastic members 104, and can effectively perform return of the medium by a strong transport grip.

In the present embodiment, since a card has less deflection as compared with a banknote, the driven roller 102 is lifted at the time of nipping the card. At this time, since the transport grip is made strong by biasing the driven roller with respect to the drive rollers by the elastic members 104, the card can be reliably returned by reversely rotating the drive rollers.

In this manner, in the present embodiment, when a card is pressed into a nip portion between drive rollers and a driven roller, it is detected that the medium is a card (not a banknote) by detecting the length or the like thereof by the inlet sensor 15. The driven roller 102 is lifted so that the transport grip reliably works to strengthen the returning force at the time of taking in the card and at the time of returning the card. The axial positions of the drive rollers are not relevant to the return processing of the card. That is, since a card does not bend, the pressing force (transport grip) at the nip portion is the same even if the axial positions of the respective drive rollers are opened or closed. It is because the transport grip is determined also with a spring pressing force from the elastic members 104.

Application Example of First Embodiment

First Application Example

Figure 13:
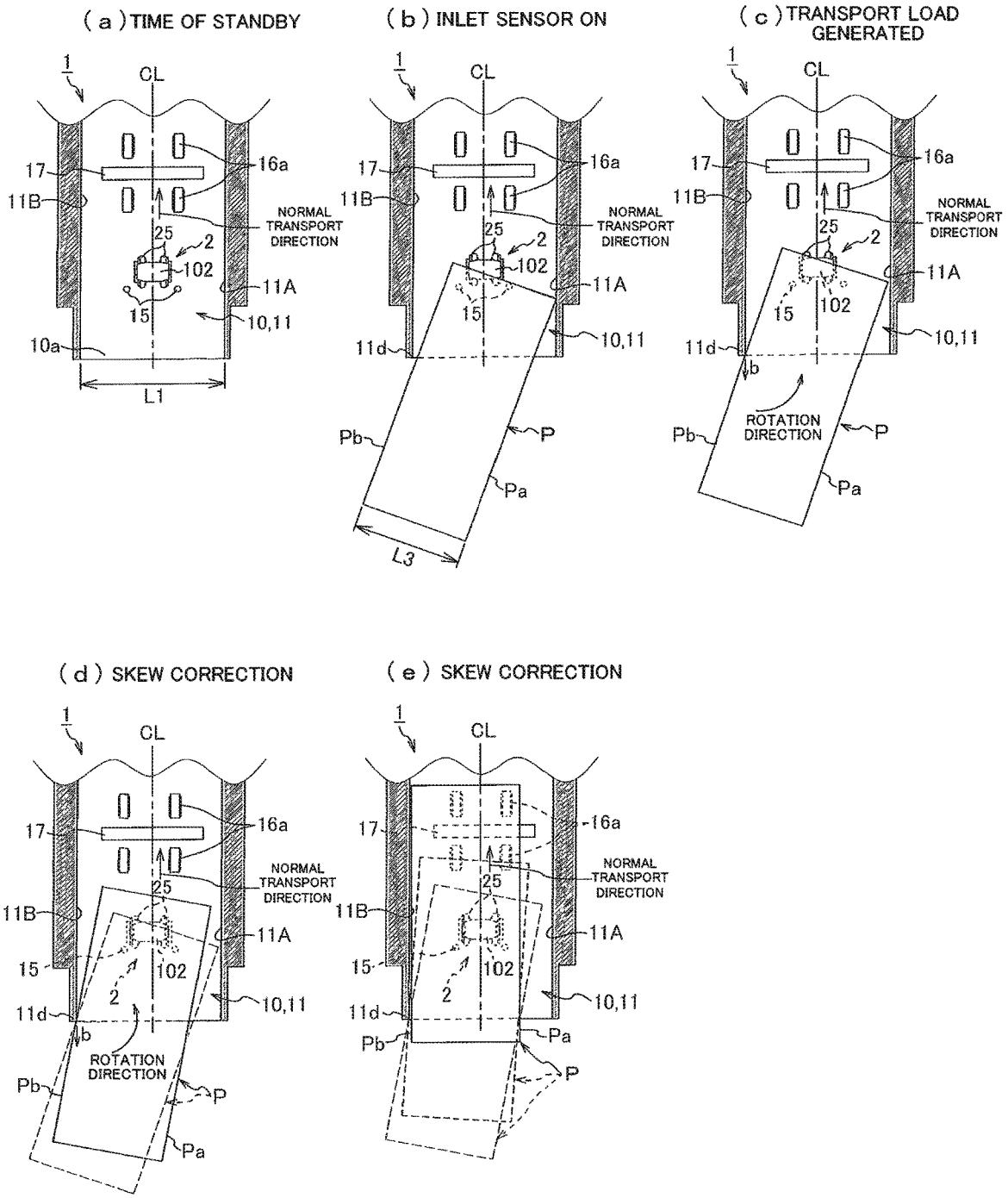
FIGS. 13(*a*) to (*e*) are plan views of relevant parts illustrating a skew correction procedure when the friction transport device according to the present invention is applied to a banknote transport path having a wide constant width.

FIGS. 13(*a*) to (*e*) are plan views of relevant parts illustrating a skew correction procedure when the friction transport device according to the present invention is applied to a banknote transport path having a wide constant width.

The friction transport device 2 according to the present invention can be applied to a banknote transport path having a constant width dimension other than the banknote transport path 10 (the banknote transport surface 11) having a non-constant width dimension as illustrated in FIG. 1(*a*), so as to be able to correct the position, angle, and posture of a banknote inserted in a skewed state to a normal state.

In the example illustrated in FIG. 13, a width dimension L1 of the banknote transport path 10 is 86 millimeters, and a width dimension L3 of a banknote to be transported is 66 millimeters.

Also when the friction transport device 2 is applied to the wide banknote transport path 10, the position, angle, and posture of a banknote are corrected according to the same operation principle and procedure as in the case where the friction transport device is applied to a banknote transport path in which the width dimension is not constant as illustrated in FIG. 1 to FIG. 9, and a transport state where the banknote is aligned to one side wall can be acquired.

When the banknote P is inserted from the slot 10*a* to the friction transport device 2 in the standby state illustrated in FIG. 13(*a*), the inlet sensor 15 detects the insertion and the friction transport device 2 is turned ON to start driving of the transport drive gear 45 and the drive rollers 25 sequentially in the normal rotation direction by the drive motor 60, as illustrated in FIG. 13(*b*). If the inserted banknote is skewed by a predetermined angle in a clockwise direction as illustrated in FIGS. 13(*b*) and (*c*), a left side edge Pb of the banknote P comes into contact with the entry-side end 11*d* to receive the reaction force b. In FIG. 1 to FIGS. 9, a case where the tip corner of the banknote comes into contact with the tapered intermediate side wall 13 has been described. Also in this example, the operation procedure of the cam mechanism 50 with respect to the reaction force b is the same. That is, since the left side edge Pb of the banknote receives the reaction force b from the entry-side end 11*d*, the cam mechanism 50 operates to weaken a transport grip between the drive rollers and the banknote, and thus the skew correcting operation in which the banknote is transported while sliding horizontally and rotating in a counterclockwise direction about a contact portion between the left side edge of the banknote and the entry-side end can be efficiently performed. In this example, the banknote P after correction is transported to the innermost portion in a forward advancing posture with the left side edge Pb being parallel to and along the left side wall 11B, as indicated by a solid line in FIG. 13(*e*).

Further, at the time of return of the banknote P and at the time of standby, return transport and insertion prevention can be effectively realized by maintaining a strong transport grip.

Second Application Example

Figure 14:
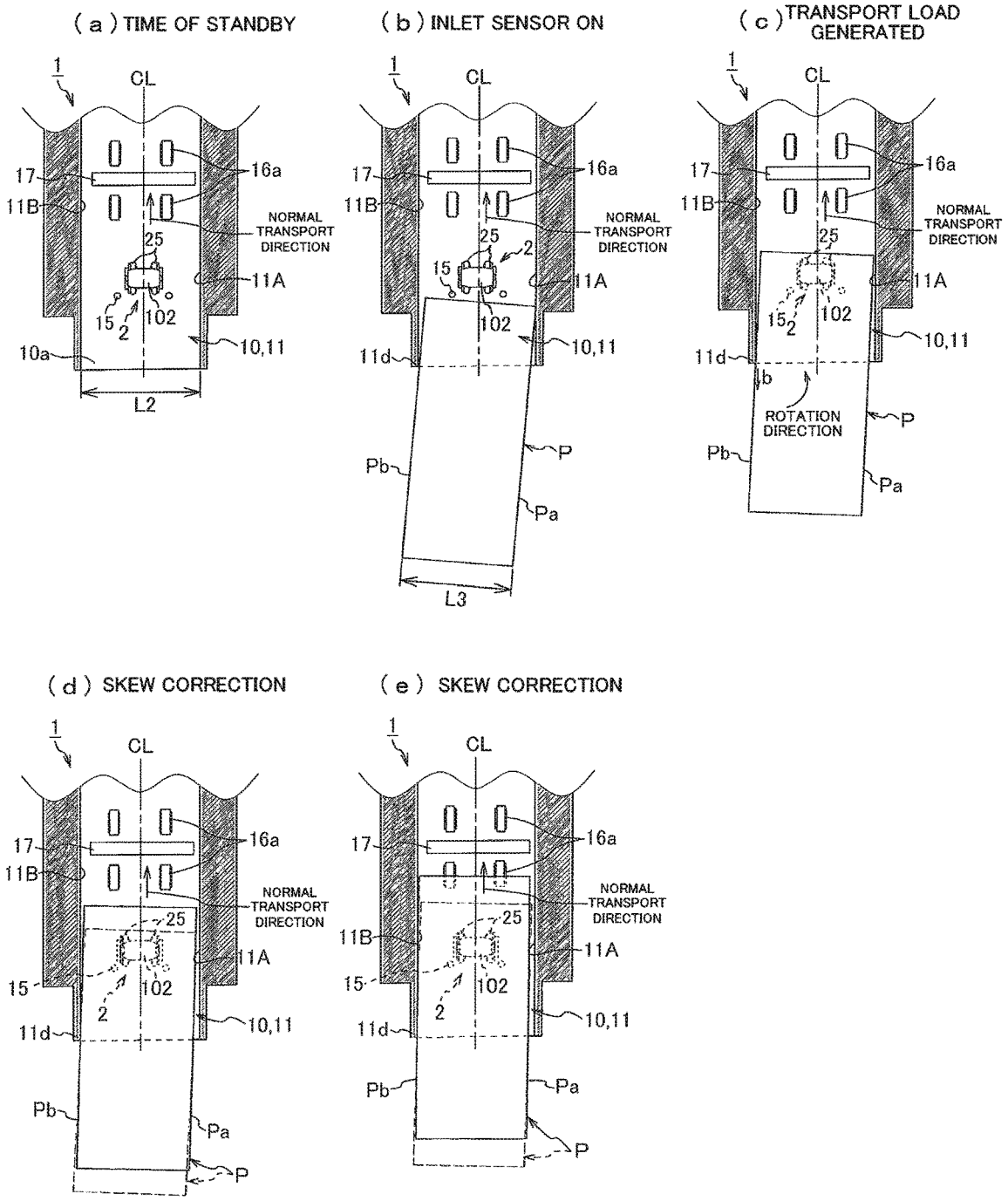
FIGS. 14(*a*) to (*e*) are plan views of relevant parts illustrating a skew correction procedure when the friction transport device according to the present invention is applied to a banknote transport path having a narrow constant width.

Next, FIGS. 14(*a*) to (*e*) are plan views of relevant parts illustrating a skew correction procedure when the friction transport device according to the present invention is applied to a banknote transport path having a narrow constant width.

In the example illustrated in FIG. 14, a width dimension L2 of the banknote transport path 10 is 68 millimeters and a width dimension L3 of a banknote to be transported is 66 millimeters.

Also when the friction transport device 2 is applied to the narrow banknote transport path 10, the position, angle, and posture of a banknote are corrected according to the same operation principle and procedure as in the case where the friction transport device 2 is applied to the banknote transport path in which the width is different as illustrated in FIG. 1 to FIG. 9, and the transport state where the banknote is aligned to the central part of the transport path or the left side wall can be acquired.

When the banknote P is inserted from the slot 10*a* to the friction transport device 2 in the standby state as illustrated in FIG. 14(*a*), the inlet sensor 15 detects the insertion and the friction transport device 2 is turned ON to start driving of the transport drive gear 45 and the drive rollers 25 sequentially in the normal rotation direction by the drive motor 60, as illustrated in FIG. 14(*b*). If the banknote to be inserted is skewed by a predetermined angle in a clockwise direction as illustrated in FIG. 14(*b*), the left side edge Pb of the banknote P comes into contact with the entry-side end 11*d* to receive the reaction force b. In FIG. 1 to FIGS. 9, a case where the tip corner of the banknote comes into contact with the tapered intermediate side wall 13 has been described. Also in this example, the operation procedure of the cam mechanism 50 with respect to the reaction force b is the same. That is, since the left side edge Pb of the banknote receives the reaction force b from the entry-side end 11*d*, the cam mechanism 50 operates to weaken the transport grip between the drive rollers and the banknote, and thus the skew correcting operation in which the banknote is transported while sliding horizontally and rotating in a counter-clockwise direction about a contact portion between the left side edge of the banknote and the entry-side end can be efficiently performed.

In this example, the banknote P after correction is transported to the innermost portion in a forward advancing posture with the widthwise central part of the banknote being aligned with the widthwise central part of the transport path 10, as indicated by a solid line in FIG. 14(*e*).

Further, at the time of return of the banknote P and at the time of standby, return transport and insertion prevention can be effectively realized by maintaining a strong transport grip.

Actions and Effects of First Embodiment

According to the banknote transport device 1 of the first embodiment, due to the actions of the friction transport device 2, the banknote P to be inserted from various positions and angles and in various postures from the slot 10*a* of the banknote transport path 10 (the banknote transport surface 11) can be aligned to the position and posture along the central axis or any of the right and left side walls of the banknote transport path 10 by correcting the position, angle, and posture thereof, while continuously transporting the banknote P. At this time, it is possible to prevent that the corners and other portions of the banknote are strongly pressed against the side wall and crushed.

Further, when the banknote P having been inserted from the slot 10*a* is receiving a reaction force from a side wall, the cam mechanism 50 provided in the friction transport device 2 can perform skew correction efficiently by automatically weakening a transport grip between the drive rollers and the banknote, and can perform return transport and insertion prevention advantageously by strengthening the transport grip at the time of return of the banknote P and at the time of standby.

Adjustment of the transport grip is realized by axially moving the drive rollers forward and backward by the cam mechanism 50 (the sloped portions and the cam followers) that is provided as it spans across the drive rollers 25 and the cam member 57 provided in the transport drive gear 45 (transport driving member). That is, when the banknote P is inserted from the slot 10*a* of the banknote transport path, the inlet sensor 15 detects the banknote to normally rotate the drive motor 60, and the transport drive gear 45 normally rotates upon reception of an input. When a reaction force is applied to the banknote in a direction different from the normal transport direction due to abutment of the banknote on a side wall or any other causes, the reaction force is applied to the drive rollers via the banknote to decelerate the banknote and the drive rollers. That is, while the banknote decelerates due to the reaction force from the side wall, the drive rollers decelerate together with the banknote due to a strong frictional force between the drive rollers and the banknote, that is, the transport grip. The rotation of the drive rollers is then delayed with respect to the rotation of the transport drive gear 45, and a difference in the rotational speed is generated between the transport drive gear and the drive rollers, thereby causing an axially outward displacement of the cam followers 55 of the drive rollers along the sloped portions 52. As a result, the transport grip decreases when the drive rollers move axially outward due to cooperation of the sloped portions 52 provided in the rotating transport drive gear 45 and the cam followers 55 provided in the drive rollers, thereby enabling to correct the posture of the banknote in a direction moving away from the side wall (in a direction of decreasing damage of the banknote received from the side wall).

If it is assumed that the axial positions of the drive rollers are not displaced, since the banknote moves forward while the corner thereof is being pressed against the side wall, there is a disadvantage in that the corner is crushed due to the reaction force from the side wall, and the banknote starts to move forward after the corner thereof is continuously crushed and cannot be crushed any more. In other words, the banknote receives the reaction force from the side wall to move toward the center of the transport path. However, if the transport grip is stronger than the reaction force, the banknote cannot change its orientation, and moves forward without canceling out the reaction force received from the side wall, thereby deforming the corner.

After a rear end of the banknote has passed the nip portion between the drive rollers and the driven roller, the drive rollers return to the original positions.

When the drive roller moves axially outward, the drive roller does not move up to a limit position constantly, and stops its movement right before the limit position according to the transport load value. That is, the drive roller stops axial movement at a position where a load by biasing of a spring axially inward by the elastic biasing member 40 and the transport load are balanced. While the moving amounts of the right and left drive rollers are not always constant, the balanced moving amounts and the balanced stop positions are acquired constantly with respect to the transport load from the side wall, thereby enabling skew correction. That is, according to the difference of the transport load received by the individual drive roller from one banknote, each of the drive rollers stops at an axial position where the transport load is balanced.

When a banknote receives a reaction force from any of the side walls 12, 13, and 14 at the time of normal rotation of drive rollers, the friction transport device 2 can decrease and cancel out the reaction force acting on the banknote P by decreasing the transport grip. Therefore, the friction transport device 2 can perform skew correction without causing any deformation of the side edge Pa (the tip corner) and other portions of the banknote P due to a strong contact with the respective side walls to an extent that the deformed parts cannot be restored, and without causing any deterioration of other states of the banknote P.

Further, identification accuracy by the recognition sensor 17 can be increased by correcting the position, angle, and posture (a change in direction) of the banknote P so as to be aligned with the central axis CL of the banknote transport path 10 or either one of the side wall surfaces.

Further, since the side wall of the transport path 10 is a flat surface and any guide roller is not provided thereto, the side wall has a plain and simple structure with a smaller number of components, and can be manufactured at a low cost, and the mechanical strength thereof can be increased. The flat side wall does not have an uneven part causing jamming. Further, since the transport is performed by non-intermittent and continuous driving, banknotes to be transported do not flop and stable transport can be performed.

The friction transport device 2 can be applied not only to a type in which the width of the banknote transport surface, that is, the width between the side walls is fixed, but also to a variable width type in which the width between the side walls can be changed, so as to exhibit the skew correction function and the like.

The procedures for banknote transport and skew correction according to the present invention are summarized as follows.

In the example illustrated in FIG. 8, for example, a fixed-width transport path is provided, and a banknote having a width of 66 millimeters inserted from the entry-side transport surface 11*a* of the transport path having a wide width of 86 millimeters is leaned to the center of the transport path or toward any of the side walls, in a process of introducing the banknote into the inner transport surface 11*c* having the minimum width of 68 millimeters via the intermediate transport surface 11*b*.

Since the entry width is large with respect to the banknote width, the banknote is inserted from various positions and angles and in various postures. However, the banknote transport device 1 can lean the banknote to the center of the transport path or toward one of the side walls by correcting the posture of the banknote at any insertion position and insertion angle to a posture parallel to the normal banknote transport direction.

A corresponding intermediate transport surface 11*b* between the intermediate side walls 13 has a gradually decreasing width in a range from 86 millimeters to 68 millimeters, so that the banknote inserted from a position deviated from the center of the transport path can be leaned to the center of the transport path and transported, while bringing a tip corner of the banknote in contact with the intermediate side wall 13.

When a load is applied to a banknote being transported by the respective drive rollers 25 at the time of normal rotation for introducing the banknote and the drive rollers 25 decelerate or stop, the respective drive rollers 25 axially move to weaken the nipping force with the driven roller (widen a gap therebetween). With this process, the transport grip between the drive rollers and the banknote becomes weak, and the banknote can be leaned to the center without crushing the tip corner and other portions of the banknote.

Generation of a reaction force applied to a banknote, which triggers the axial movement of the drive rollers, is not caused only by a contact of the banknote with a side wall; however, the contact thereof with the side wall becomes a large factor.

The banknote inserted in a skewed state receives a reaction force due to contact with a side wall, thereby moving the both drive rollers in a direction of increasing the interval therebetween, not only in a relation with the intermediate wall 13 inclined in a tapered manner and the entry-side end 11*d*, but also in a relation with the side walls 12 and 14 that are parallel to the transport direction. As a result, skew correction is performed (refer to the descriptions of FIG. 13 and FIG. 14).

When a banknote is inserted in a state of not coming into contact with a side wall, there is no change in the load applied to the banknote. Therefore, the both drive rollers do not axially move, and cause the banknote to move forward at the inserted position and in the posture. That is, a banknote inserted to the central part in the width direction of the transport path moves directly forward in the central part unless the banknote comes into contact with the side wall, and a banknote inserted from a position deviated to one side from the central part in the width direction moves forward in the transport path at the position in the width direction unless the banknote comes into contact with the side wall. In this manner, when a banknote is inserted without touching the side wall, there is no change in the load and the drive rollers do not axially move.

At the time of reverse rotation for returning a rejected banknote and at the time of stop for blocking continuous insertions of the second banknote (at the time of standby), the drive rollers maintain their initial positions regardless of the presence of a banknote and the transport state, thereby not to decrease the transport grip. That is, at the time of reverse rotation and at the time of stop, since the drive rollers 25 are elastically biased axially by the elastic biasing members 40 to maintain the strong transport grip, reliable return of a rejected banknote and of an erroneously inserted card can be performed and two continuous insertions can be reliably prevented.

When the cam followers of the two drive rollers simultaneously come into contact with the respective sloped portions, the respective drive rollers integrally rotate. However, when a banknote comes into contact with only one of the drive rollers, the two drive rollers rotate at different speeds. That is, the two drive rollers do not always rotate integrally.

When a reaction force is applied to a banknote from a side wall in a state where the banknote simultaneously comes into contact with the two drive rollers, if the load applied from the banknote to the respective drive rollers is not constant, the amount of axial displacement of the drive rollers is not constant.

Second Embodiment

As a friction transport device according to a second embodiment of the present invention, a configuration example in which there is a variation in a positional relation or an assembly relation between respective drive rollers and a driven roller is described below.

With regard to the drive motor 60 and the control unit 200, FIG. 1 are referred to, and although not illustrated in the drawings described below, the drive motor 60 and the control unit 200 are incorporated in friction transport devices or banknote transport devices according to all the embodiments described below.

(1) First Configuration Example

Figure 15:
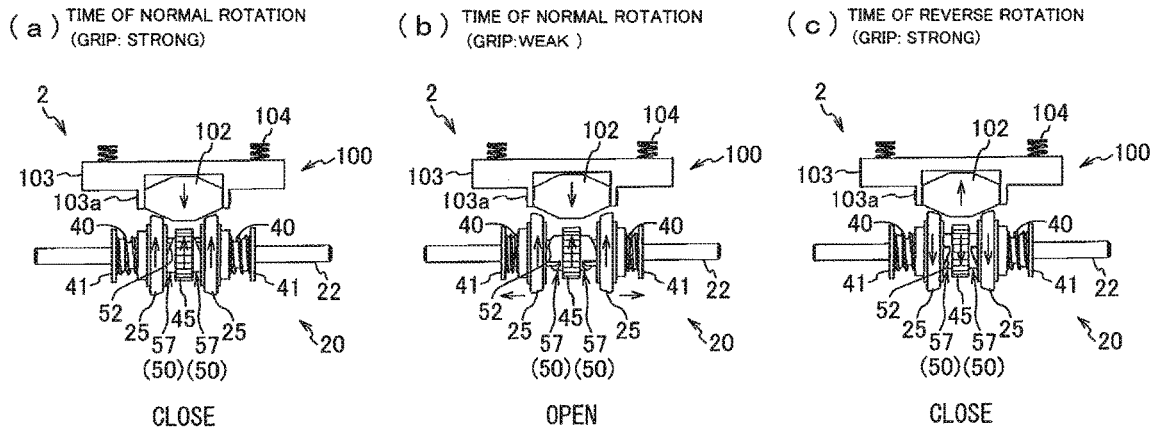
FIGS. 15(*a*), (*b*), and (*c*) are front elevational views illustrating configurations of the friction transport device in which a gap is provided constantly between respective drive rollers and a driven roller and illustrating respective operation modes.

First, FIG. 15 illustrate a friction transport device according to a first configuration example of the second embodiment, and illustrate a non-contact type configuration in which a gap is provided constantly between respective drive rollers and a driven roller, where FIG. 15(*a*) is a front elevational view of the friction transport device illustrating a state of a strong transport grip in which the respective drive rollers are closest to each other at the time of normal rotation, (b) is a front elevational view thereof illustrating a state of a weak transport grip in which an interval between the drive rollers is increased at the time of normal rotation, and (c) is a front elevational view thereof illustrating a state of a strong transport grip in which the drive rollers are closest to each other at the time of reverse rotation.

In the state of FIG. 15(*a*) in which respective drive rollers 25 and the driven roller 102 are closest to each other, if the respective drive rollers and the driven roller are in a non-contact state, the transport grip is slightly weakened as compared with that when the respective drive rollers and the driven roller are in a contact state. However, the transport grip is sufficient for normally transporting a banknote by rotating the drive rollers in the normal direction.

That is, in the normal rotation state of the drive rollers illustrated in (a), the drive rollers are at the positions closest to each other, and the banknote is transported forward so long as the banknote is inserted with a tip corner and other portions thereof not coming into contact with one of the side walls.

If a reaction force or an external force in a direction different from the normal transport direction is applied even slightly to a banknote inserted from a slot 10*a* due to contact with a side wall or any other causes, the cam mechanism 50 operates with good responsiveness to move the drive rollers in a direction moving away from each other, so as to have the maximum moving amount illustrated in (b). In this state, the transport grip between the drive rollers and the banknote is further weakened and thus, as in the first embodiment, the banknote can slide horizontally on the drive rollers, thereby enabling automatic correction of the skew. In this manner, since the interval between the drive rollers changes between a wide state and a narrow state, the transport grip is increased or decreased. Therefore, the skew correction function can be exhibited without damaging the banknote.

At the time of reverse rotation illustrated in FIG. 15(*c*), since there is a gap between the drive rollers and the driven roller, as the gap increases, the maximum value of the transport grip decreases. However, the decrease of the transport grip can be suppressed to a slight value by setting the gap value appropriately. Even if the transport grip decreases due to the presence of the gap as compared with a type having no gap, a sufficient transport grip can be exhibited by cooperation with a biasing force from the elastic members 104 of the driven roller, thereby enabling to return the banknote.

(2) Second Configuration Example

Figure 16:
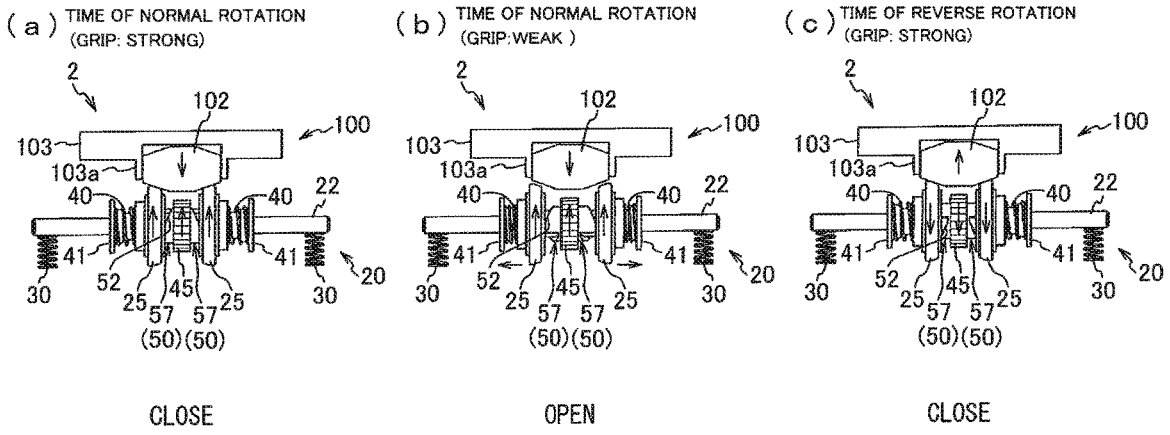
FIGS. 16(*a*), (*b*), (C) are front elevational views illustrating configurations of a friction transport device according to a second configuration example in which a relation between respective drive rollers and a driven roller is changed and illustrating respective operation modes.

Next, FIG. 16 illustrate a second configuration example in which a relation between respective drive rollers and a driven roller is changed in the second embodiment, where (a) is a front elevational view of the friction transport device illustrating a state of a strong transport grip in which the respective drive rollers are closest to each other at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the drive rollers are closest to each other at the time of reverse rotation.

In this example, the configuration is characterized such that while the driven-side unit 100 is vertically unmovable, the drive-side unit 20 is vertically movable and is elastically biased upward by elastic members 30.

The elastic member 30 is a unit that changes the position of each drive roller 25 with respect to the driven roller 102 according to a change of a vertical load from a paper sheet such as a banknote, a card, and the like passing a nip portion, as in the elastic member 104 on the driven roller side in the first embodiment.

When a banknote inserted from a slot 10*a* is in a normal posture in which the banknote does not come into contact with any side wall at the time of normal rotation of the drive rollers, the respective drive rollers 25 are at their initial positions closest to each other in FIG. 16(*a*), and transport the banknote forward stably by a transport grip having a strength sufficient for transporting the banknote forward.

Meanwhile, if a tip corner or other portions of a banknote comes into contact with a side wall due to skew, a reaction force applied to the banknote acts as a transport load on the drive rollers as illustrated in FIG. 16(*b*). Therefore, a speed difference is generated between the drive rollers and a transport drive gear 45 even if the transport load is slight and the respective drive rollers move axially outward to decrease the transport grip immediately. Accordingly, the banknote easily moves in a direction moving away from the side wall, and the skew is corrected without crushing a corner or the like of the banknote.

At the time of reverse rotation of the drive rollers illustrated in FIG. 16(*c*), the drive rollers 25 supported vertically movably by the elastic members 30 come down by the thickness of the banknote P or a card M to transport the banknote P or the like in the reverse direction by sandwiching the banknote P or the like between the drive rollers and the driven roller. At the time of reverse rotation and transport, since the elastic members 30 bias the drive rollers with respect to the driven roller to strengthen the transport grip, a banknote, a card, or the like can be reliably returned by rotating the drive rollers in the reverse direction.

Although not illustrated, it is possible to have a configuration that both the driven-side unit 100 and the drive-side unit 20 are elastically biased simultaneously in a direction the drive rollers approaching each other.

(3) Third Configuration Example

Figure 17:
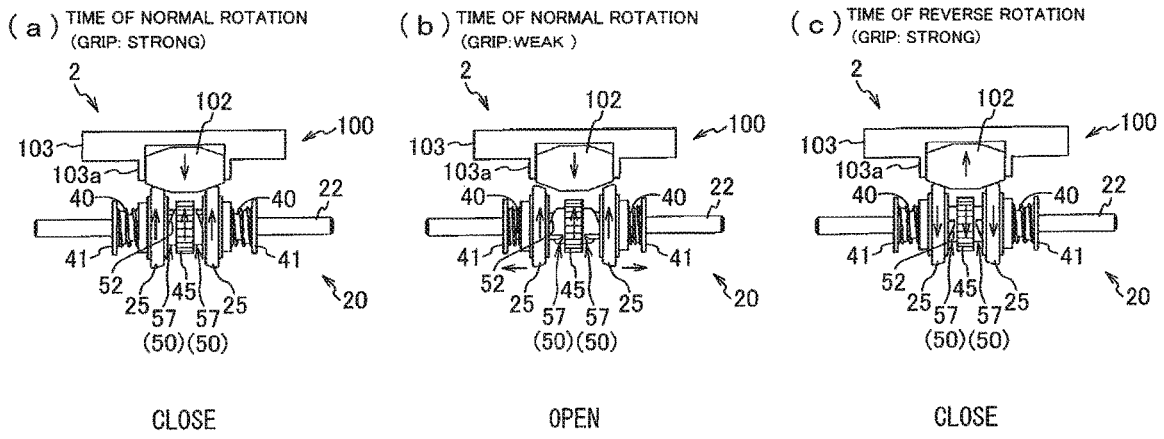
FIGS. 17(*a*), (*b*), and (*c*) are front elevational views illustrating configurations of a friction transport device according to a third configuration example with regard to a relation between respective drive rollers and a driven roller and illustrating respective operation modes.

Next, FIG. 17 illustrate a third configuration example with regard to a relation between the respective drive rollers and the driven roller in the second embodiment, where FIG. 17(*a*) is a front elevational view of the friction transport device illustrating a state of a strong transport grip in which the respective drive rollers are closest to each other at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the drive rollers are closest to each other at the time of reverse rotation.

This configuration example illustrates a configuration in which a vertical positional relation between the drive-side unit 20 and the driven-side unit 100 is fixed, and both the drive-side unit 20 and the driven-side unit 100 are assembled in a state immovable vertically both in directions approaching and separating from each other. Therefore, there is no room for biasing by an elastic member.

When a banknote is inserted without coming into contact with a side wall because the banknote is in a normal insertion posture, respective drive rollers 25 that have started normal rotation are at the positions closest to each other in FIG. 17(*a*), and transport the banknote forward stably by a strong transport grip.

Meanwhile, when an inserted banknote is in a skewed state and thus a tip corner or the like comes into contact with a side wall, as illustrated in FIG. 17(*b*), a reaction force applied to the banknote from the side wall acts on the respective drive rollers, and thus the cam mechanism 50 operates immediately with good responsiveness to move the respective drive rollers axially outward, thereby decreasing the transport grip. Therefore, the banknote easily moves in a direction moving away from the side wall and is transported while being leaned to the central direction of the transport surface, without crushing a corner or the like of the banknote coming into contact with the side wall.

Even in this configuration example in which there is no elastic member that presses the drive rollers and the driven roller in any of the drive-side unit and the driven-side unit, if a transport load is applied from the banknote even slightly, the drive rollers move (are displaced) axially to decrease the transport grip. Therefore, loading and skew correction of the banknote becomes possible.

At the time of reverse rotation of the drive rollers illustrated in FIG. 17(*c*), since any of the drive-side unit and the driven-side unit do not move vertically and there is no gap between the drive rollers and the driven roller, return of a banknote is not always easy even if the drive rollers rotate reversely. However, return is possible by deformation of an elastic layer on the respective roller surfaces.

(4) Fourth Configuration Example

Figure 18:
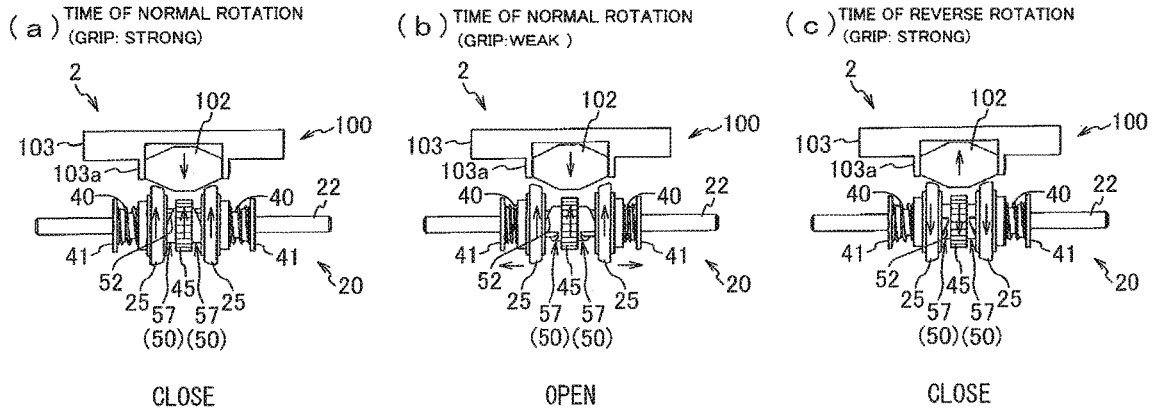
FIGS. 18(*a*), (*b*), and (*c*) are front elevational views illustrating configurations of a friction transport device according to a fourth configuration example with regard to a relation between respective drive rollers and a driven roller and illustrating respective operation modes.

Next, FIG. 18 illustrate a fourth configuration example with regard to a relation between the respective drive rollers and the driven roller in the second embodiment, where FIG. 18(*a*) is a front elevational view of the friction transport device illustrating a state of a strong transport grip in which the respective drive rollers are closest to each other at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the drive rollers are closest to each other at the time of reverse rotation.

The present embodiment is a modification in which characteristics of the respective configuration examples in FIG. 15 and FIG. 17 are combined. While the vertical positional relation between the drive-side unit 20 and the driven-side unit 100 is fixed, a gap corresponding to the thickness of one or more banknotes is formed between the drive rollers and the driven roller in any state of FIGS. 18(*a*), (*b*), and (*c*).

When a banknote is inserted without coming into contact with a side wall, the respective drive rollers 25 that start normal rotation transport the banknote forward stably by a strong transport grip in the state where the drive rollers 25 are closest to each other in FIG. 18(*a*).

Meanwhile, when a slight transport load is applied to the drive rollers from the banknote due to contact of the tip corner or the like of the inserted banknote with the side wall, the respective drive rollers move axially outward as illustrated in FIG. 18(*b*) to decrease the transport grip. Therefore, the banknote becomes easier to move in a direction moving away from the side wall, and is transported while being leaned to the central direction of the transport surface without crushing a corner of the banknote that is in contact with the side wall.

In this manner, even in this configuration example in which there is no elastic member that presses the drive rollers and the driven roller in any of the drive-side unit and the driven-side unit, since the drive rollers move axially, loading and skew correction of the banknote becomes possible.

At the time of reverse rotation of the drive rollers illustrated in FIG. 18(*c*), any of the drive-side unit and the driven-side unit do not move vertically. However, since there is a gap of a thickness of one or more banknotes between the drive rollers and the driven roller, return of a banknote or a card becomes possible by reversely rotating the drive rollers.

In this manner, skew correction is possible even if one of the driven-side unit 100 or the drive-side unit is not elastically biased toward the other, and return of a banknote or a card and prevention of continuous insertions of the second banknote become possible.

Third Embodiment

As a friction transport device according to a third embodiment of the present invention, a configuration example in which the configuration of the driven roller side is changed is described.

In the first embodiment, the number of the driven roller 102 is one and has a crown shape. However, the shape and the number of the driven roller are not limited to those of a crown shape, so long as it is a configuration in which the transport grip can be changed by axially moving drive rollers. In other words, variability characteristics of the transport grip in the friction transport device 2 according to the present invention can be changed according to the surface friction coefficient, the number, and the shape of the driven roller 102.

(1) First Configuration Example

Figure 19:
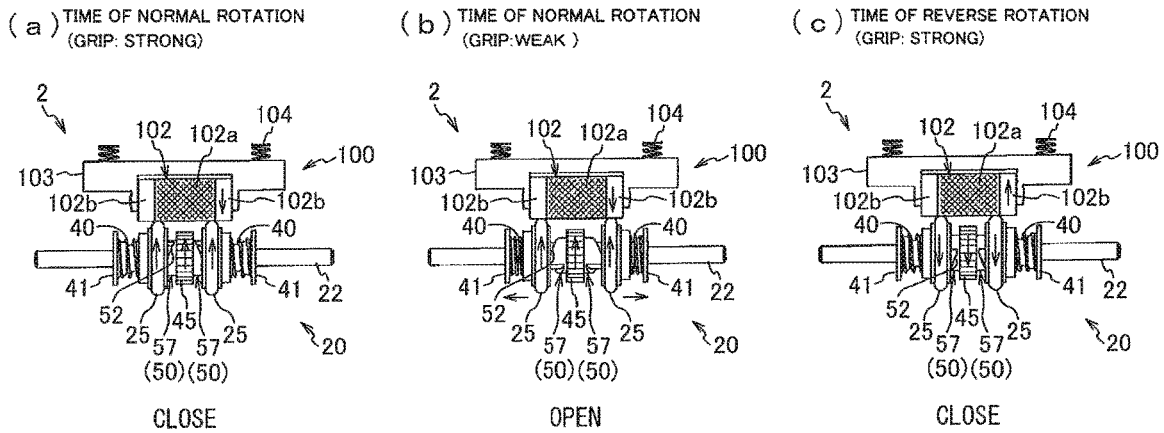
FIGS. 19(*a*), (*b*), and (*c*) are front elevational views illustrating configurations of a friction transport device according to a first configuration example of a third embodiment and illustrating respective operation modes.

FIG. 19(*a*) is a front elevational view of the friction transport device according to the third embodiment illustrating a state of a strong transport grip in which drive rollers are closest to each other at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation.

FIG. 19 illustrate configuration examples in which the friction coefficient of a central part 102*a* of the driven roller 102 having a straight shape is set to be large and the friction coefficient of the both end portions 102*b* and 102*b* is set to be small.

In a state where a transport load is not applied to the drive rollers illustrated in FIG. 19(*a*), since the both drive rollers 25 come into contact with the central part 102*a* of the driven roller having a large friction coefficient, the transport grip is large. Therefore, a banknote can be transported forward stably by the transport grip with an appropriate strength necessary and sufficient for transporting the banknote forward.

In a state where a transport load is applied to the drive rollers illustrated in (b), since the respective drive rollers 25 having moved to positions where an interval therebetween is increased come into contact with the both end portions 102*b* and 102*b* of the driven roller having a small friction coefficient, the transport grip is smaller. Therefore, skew correction becomes possible.

At the time of reverse rotation in (c), since each of the drive rollers comes into contact with the central part 102*a* of the driven roller having a large friction coefficient, and a transport grip having a sufficient strength is exhibited by cooperation with a biasing force from the elastic members 104, thereby enabling to return the banknote.

(2) Second Configuration Example

Figure 20:
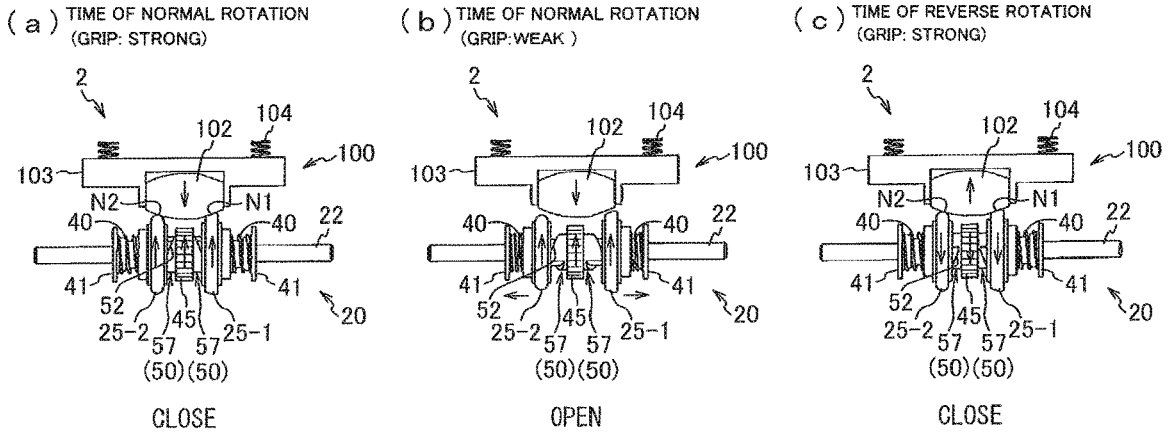
FIGS. 20(*a*), (*b*), and (*c*) are front elevational views illustrating configurations of a friction transport device in which shapes of outer peripheries of two drive rollers are made different from each other and illustrating respective operation modes.

FIG. 20 are configuration examples of the third embodiment in which shapes of outer peripheries of two drive rollers 25-1 and 25-2 are made different from each other, where (a) is a front elevational view of the friction transport device illustrating a state of a strong transport grip in which drive rollers are closest to each other at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation.

The outer periphery of one drive roller 25-1 is a surface inclined in a tapered shape, while the outer periphery of the other drive roller 25-2 has a circular shape.

By forming the outer peripheries of the drive rollers in different shapes in this manner, the variation of the transport grip when a transported banknote receives a reaction force from a side wall becomes different between the right and left drive rollers. That is, the transport grip generated in a nip portion N1 between the drive roller 25-1 and the driven roller 102 and the transport grip generated in a nip portion N2 between the drive roller 25-2 and the driven roller have different values from each other. Therefore, when a banknote changes its posture in the direction moving away from the side wall in the normal rotation state illustrated in FIG. 20(*b*), the banknote can change its posture and transport direction, while rotating about the nip portion having a stronger transport grip.

(3) Third Configuration Example

Figure 21:
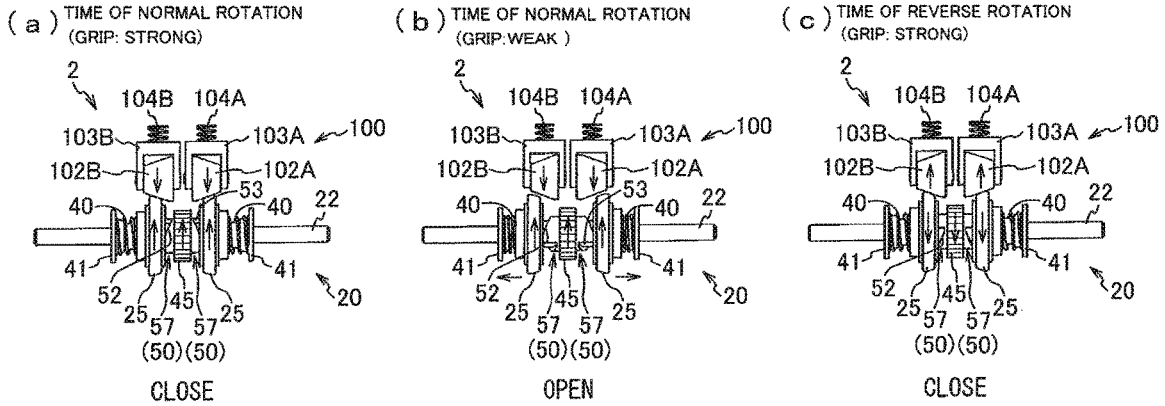
FIGS. 21(*a*), (*b*), and (*c*) are front elevational views illustrating configurations of a friction transport device in which a driven roller is provided in the same number as that of drive rollers in one-to-one correspondence and illustrating respective operation modes.

FIG. 21 illustrate configuration examples of the third embodiment in which the driven roller is provided in the same number as that of the drive rollers in one-to-one correspondence, where (a) is a front elevational view of the friction transport device illustrating a state of a strong transport grip in which drive rollers are closest to each other at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation.

Configurations other than a configuration in which the driven roller 102 is divided into two so as to face the respective drive rollers 25 in one-to-one correspondence are the same as that of the first embodiment.

Respective divided driven rollers 102A and 102B are supported rotatably about an axis by respective brackets 103A and 103B, and the respective brackets are elastically biased individually by respective elastic members 104A and 104B. Therefore, the respective divided driven rollers can rotate independently and skew correction with respect to a banknote that is receiving a reaction force from a side wall can be performed more flexibly by cooperation with the respective divided driven rollers and the drive rollers.

A configuration example in which a gap is provided between the drive rollers and the driven roller illustrated in FIG. 15, a configuration example in which the drive-side unit 20 is elastically biased illustrated in FIG. 16, a configuration example in which the drive-side unit and the driven-side unit are not elastically biased illustrated in FIG. 17 and FIG. 18, a configuration example in which friction resistance of the driven roller is changed illustrated in FIG. 19, and a configuration example in which the shapes of the outer peripheries of the two drive rollers are made different from each other illustrated in FIG. 20 can be combined with and applied to this configuration example respectively.

(4) Others

Although not particularly illustrated, by setting tapered angles or curvatures of curved portions at the right and left ends of the crown-shaped driven roller 102 to be different from each other, it is possible to configure that movement of a banknote in the width direction is deviated to one direction when the drive rollers are separated from each other due to a transport load from the banknote to decrease the transport grip. Specifically, by setting an inclination angle of a tapered shape at one end to be larger than that at the other end, the banknote is transported to the inner side while rotating about a contact point with one end having a steeper inclination and moving in the width direction.

Fourth Embodiment

As a friction transport device according to a fourth embodiment of the present invention, there is presented a configuration example in which a transport drive gear is arranged at a position avoiding a position between the drive rollers, that is, axially outward of one drive roller.

In this example, as a result of not arranging the transport drive gear between the drive rollers 25, a sloped portion constituting the cam mechanism 50 cannot be provided in the transport drive gear. Therefore, the cam member 57 including the sloped portion 52 is provided on the shaft 22 located between the drive rollers.

(1) First Configuration Example

Figure 22:
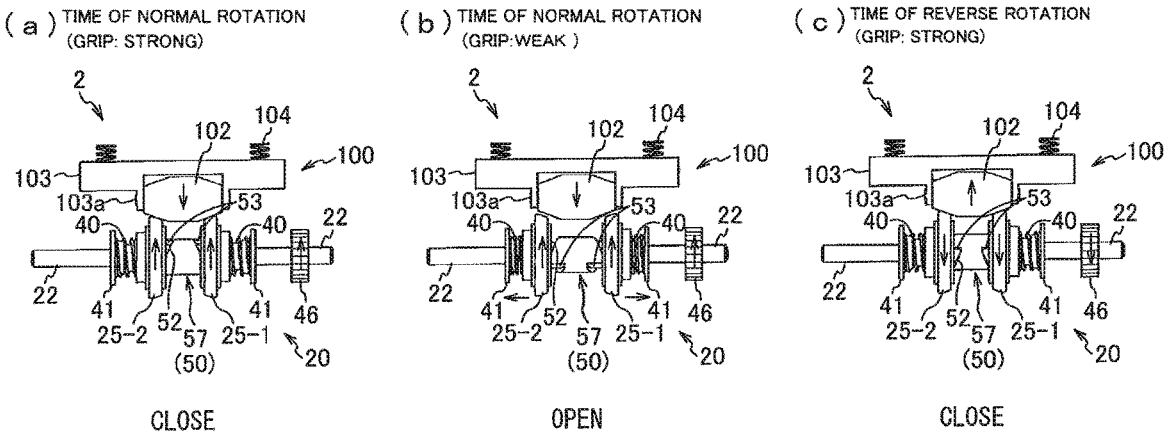
FIGS. 22(*a*), (*b*), and (*c*) are front elevational views illustrating configurations of a friction transport device according to a first configuration example of a fourth embodiment and illustrating respective operation modes.

FIG. 22 are explanatory diagrams of a configuration and an operation of a friction transport device according to a first configuration example of the fourth embodiment, where (a) is a front elevational view of the friction transport device illustrating a state of a strong transport grip in which drive rollers are closest to each other (at initial positions) at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation. Parts same as those of the above embodiments are explained as like reference signs are denoted thereto.

The drive-side unit 20 constituting the friction transport device 2 according to the present embodiment has a configuration including at least two drive rollers 25, the cam member 57 fixedly arranged on a shaft between the respective drive rollers, an elastic biasing member 40 that elastically biases each of the drive rollers in an axial direction the drive rollers approaching each other, one cam mechanism element 55 or the other cam mechanism element 52 arranged in the drive roller, the other cam mechanism element 52 or the one cam mechanism element 55 arranged in the cam member, and a transport driving member 46 that is fixed to the shaft axially outward of any one of drive rollers and rotated and driven by a driving source, where the driven roller 102 decreases the transport grip when the respective drive rollers move axially outward.

The friction transport device 2 is characterized by having a configuration in which both drive rollers 25-1 and 25-2 are pivotally supported so as to be able to move forward and backward axially with respect to the shaft 22 and capable of relative rotation and are biased to a direction the drive rollers approaching each other by the respective elastic biasing members 40, the transport drive gear 46 is fixed to the shaft 22 axially outward of one drive roller 25-1, and one cam member 57 including the sloped portion 52 (the cam portion 51) provided line symmetrically on both axially surfaces is fixed to the shaft 22 between the respective drive rollers.

This is a configuration example in which the transport drive gear 46 and the cam member 57 (the sloped portion 52) are separated from each other, and synchronization is made between the integrally formed transport drive gear 46, shaft 22, and sloped portion 52.

The transport drive gear (transport driving member) 46 receives a driving force from the drive motor 60 via another gear (not illustrated) to change forward and reverse rotation to integrally rotate the shaft 22. The cam follower 55 provided in an inner periphery of each of the drive rollers 25-1 and 25-2 is brought into pressure contact with each sloped portion 52 provided in the cam member 57 integrally formed with the shaft 22 by each of the elastic biasing members 40 and 40.

This configuration example has skew correction when a reaction force that is generated as a banknote transported through a nip portion between the driven roller 102 and the drive rollers 25-1 and 25-2 comes into contact with any of the side walls 12, 13, and 14 at the time of normal rotation of the drive rollers 25-1 and 25-2 decelerates the drive rollers via the banknote, and the cam followers and the sloped portions operate to move the respective drive rollers axially outward and decrease the transport grip, and actions and effects of this skew correction are identical to those of other embodiments described above.

Therefore, descriptions of the behavior of the friction transport device 2 with respect to the banknote in the respective states illustrated in FIGS. 22(*a*), (*b*), and (*c*) are omitted to avoid redundant explanations thereof.

A configuration example in which a gap is provided between the drive rollers and the driven roller illustrated in FIG. 15, a configuration example in which the drive-side unit 20 is elastically biased illustrated in FIG. 16, a configuration example in which the drive-side unit and the driven-side unit are not elastically biased illustrated in FIG. 17 and FIG. 18, a configuration example in which friction resistance of the driven roller is changed illustrated in FIG. 19, and a configuration example in which the shapes of the outer peripheries of the two drive rollers are made different from each other illustrated in FIG. 20 can be combined with and applied to this configuration example respectively. The possibilities of combinations and applications of this configuration example with and to other configuration examples described above similarly apply to all the following configuration examples.

Since the cam portion 51 (cam follower) and the sloped portion constituting the cam mechanism 50 is separated from the transport drive gear 46, flexibility of layout can be improved.

(2) Second Configuration Example

Figure 23:
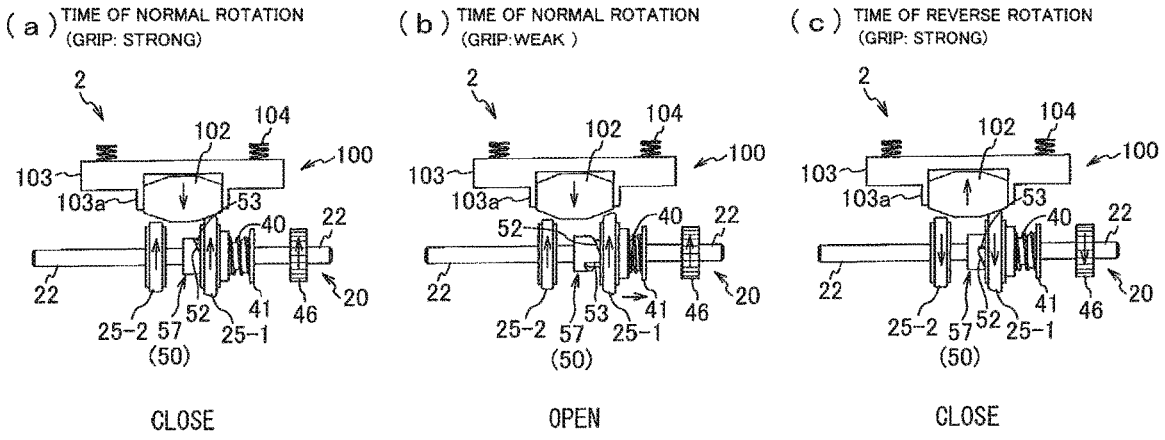
FIGS. 23(*a*), (*b*), and (*c*) are front elevational views illustrating configurations of a friction transport device according to a second configuration example of the fourth embodiment and illustrating respective operation modes.

FIG. 23 are explanatory diagrams of a configuration and an operation of a friction transport device according to a second configuration example of the fourth embodiment, where (a) is a front elevational view of the friction transport device illustrating a state of a strong transport grip in which drive rollers are closest to each other (at initial positions) at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation.

Parts same as those of the above embodiments are explained as like reference signs are denoted thereto.

In the friction transport device 2, the transport drive gear 46 is fixed to the shaft 22 axially outward of one drive roller 25-1, and a shaft core of the other drive roller (a fixed-side drive roller) 25-2 is fixed to the shaft 22 in an axially immovable state. The one drive roller (a movable-side drive roller) 25-1 is supported so as to be capable of relative rotation and axially movable with respect to the shaft 22, and is biased axially inward by the elastic biasing member 40.

The cam member 57 constituting the cam mechanism 50 is fixed to the shaft 22 between the two drive rollers and the sloped portion 52 (the cam portion 51) comes into contact with the cam follower 55 provided on the side of the movable-side drive roller 25-1. The drive roller 25-1 receives transmission of a driving force from the shaft 22 via the cam mechanism 50 (the cam member 57, the cam follower 55). The other drive roller 25-2 fixed to the shaft is not provided with a cam follower.

That is, in this example, the cam mechanism 50 is arranged to span across the shaft 22 and the drive roller 25-1.

When a reaction force that is generated as a banknote transported through a nip portion between the driven roller 102 and the drive rollers 25-1 and 25-2 comes into contact with any of the side walls 12, 13, and 14 at the time of normal rotation of the drive rollers 25-1 and 25-2 decelerates the drive roller 25-1 via the banknote, and the cam followers and the sloped portions operate to move the one drive roller 25-1 axially outward and decrease the transport grip, thereby exhibiting the actions and effects of skew correction.

Further, while an outer periphery of the one drive roller 25-1 has a tapered inclined surface, an outer periphery of the other drive roller 25-2 has a circular arc shape. The driven roller 102 has a crown shape.

In a state where a transport load is not applied to the drive rollers 25 illustrated in FIG. 23(*a*), the drive roller 25-2 and the driven roller at the time of normal rotation are in a non-contact state. Therefore, the transport grip is set to be slightly weak, while the transport grip in the nip portion between the drive roller 25-1 and the driven roller is set to be strong. When the drive rollers normally rotate to transport the banknote inserted normally in this state, the banknote can be transported forward. That is, the transport grip between the respective drive rollers and the banknote is set to have an appropriate strength necessary and sufficient for transporting the banknote forward.

When the drive roller 25-1 is displaced axially outward due to a transport load from the banknote illustrated in (b), since the drive roller 25-2 and the driven roller are constantly in a non-contact state, the transport grip is weak, while the transport grip in the nip portion between the drive roller 25-1 and the driven roller becomes weak. Therefore, if a banknote is transported while coming into contact with one side wall, the banknote moves laterally, while sliding on the outer peripheries of the both drive rollers and the transport position and the transport posture thereof are corrected to the normal state.

At the time of reverse rotation in (c), since the both drive rollers maintain the state approaching each other, the banknote can be reliably returned by using the strong transport grip between the drive roller 25-1 and the driven roller. Further, at the time of stop of the drive rollers, insertion of a banknote can be prevented by the strong transport grip.

As described above, in this example, since only the transport grip on the side of the drive roller 25-1 changes when the transported banknote receives a reaction force from a side wall. However, since the transport grip between the other drive roller 25-2 and the driven roller is set to be weak beforehand, effective skew correction can be performed in the state of (b).

(3) Third Configuration Example

Figure 24:
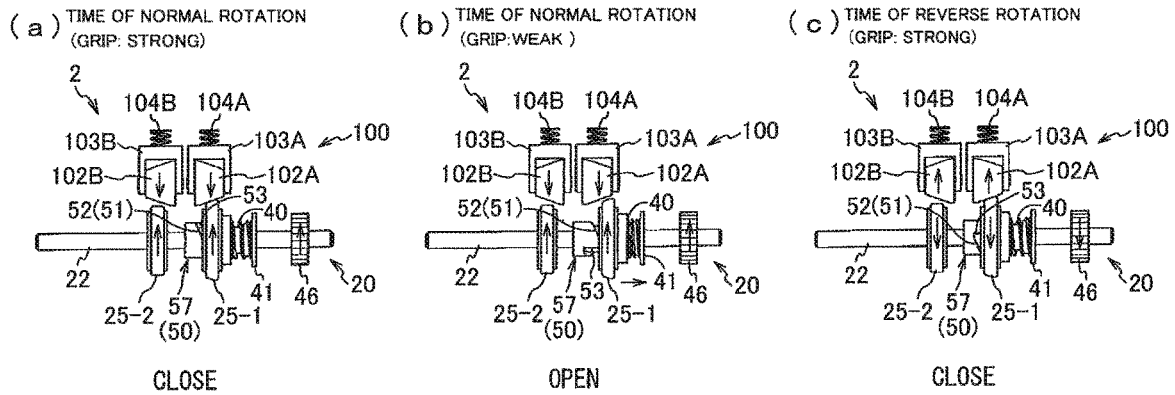
FIGS. 24(*a*), (*b*), and (*c*) are front elevational views illustrating configurations of a friction transport device according to a third configuration example of the fourth embodiment and illustrating respective operation modes.

FIG. 24 are explanatory diagrams of a configuration and an operation of a friction transport device according to a third configuration example of the fourth embodiment, where (a) is a front elevational view of the friction transport device illustrating a state of a strong transport grip in which drive rollers are closest to each other (at initial positions) at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation.

Parts same as those of the above embodiments are explained as like reference signs are denoted thereto.

The friction transport device 2 according to this configuration example has a characteristic configuration in which the driven roller according to the second configuration example in FIG. 23 is divided into two in the axial direction. Further, a configuration in which there is a gap formed between a fixed-side drive roller and the driven roller is the same as that of FIG. 23.

That is, in this friction transport device 2, the driven roller is provided in the same number as that of the drive rollers in one-to-one correspondence.

Configurations other than a configuration in which the driven roller 102 is divided into two so as to face the drive roller (the movable-side drive roller) 25-1 and the drive roller (the fixed-side drive roller) 25-2 in one-to-one correspondence are the same as that of the second configuration example.

Respective divided driven rollers 102A and 102B are supported rotatably about an axis by respective divided brackets 103A and 103B, and the respective divided brackets are elastically biased individually by respective elastic members 104A and 104B. Therefore, the respective divided driven rollers can rotate independently and skew correction with respect to a banknote that is receiving a reaction force from a side wall can be performed more flexibly by cooperation with the respective divided driven rollers and the drive rollers.

Operations, actions, and effects of skew correction due to this friction transport device 2 are identical to those of the second configuration example.

(4) Fourth Configuration Example

Figure 25:
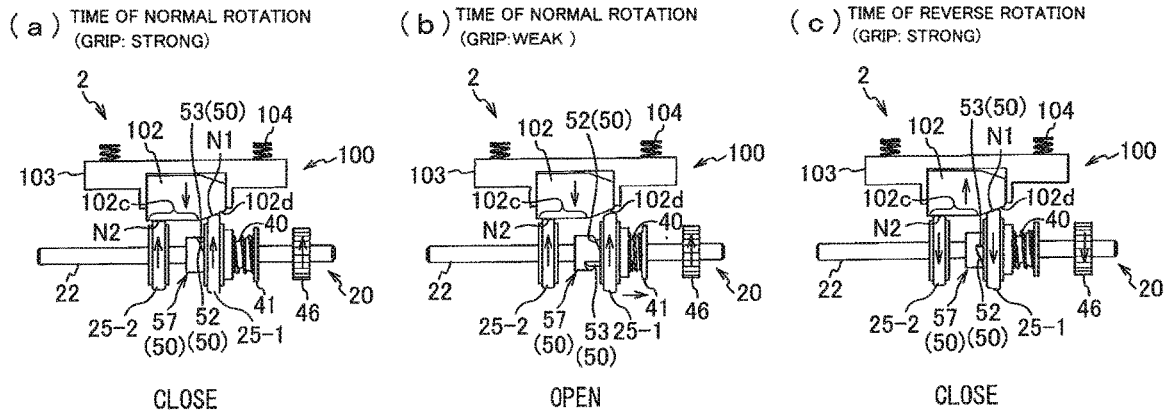
FIGS. 25(*a*), (*b*), and (*c*) are front elevational views illustrating configurations of a friction transport device according to a fourth configuration example of the fourth embodiment and illustrating respective operation modes.

FIG. 25 are explanatory diagrams of a configuration and an operation of a friction transport device according to a fourth configuration example of the fourth embodiment, where (a) is a front elevational view of the friction transport device illustrating a state of a strong transport grip in which drive rollers are closest to each other (at initial positions) at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation.

Parts same as those of the above embodiments are explained as like reference signs are denoted thereto.

In the friction transport device 2, the transport drive gear 46 is fixed to the shaft 22 axially outward of one drive roller (a movable-side drive roller) 25-1, and a shaft core of the other drive roller (a fixed-side drive roller) 25-2 is fixed to the shaft 22 in an axially immovable state. The one drive roller 25-1 is supported so as to be capable of relative rotation and axially movable with respect to the shaft 22, and is biased axially inward by an elastic biasing member 40.

The cam member 57 constituting the cam mechanism 50 is fixed to the shaft 22 between the two drive rollers and the sloped portion 52 (the cam portion 51) comes into contact with the cam follower 55 provided on the side of the movable-side drive roller 25-1. The movable-side drive roller 25-1 receives transmission of a driving force from the shaft 22 via the cam mechanism 50 (the cam member 57, the cam follower 55). The other drive roller 25-2 is not provided with the cam follower.

As described above, in this example, the cam mechanism 50 is arranged to span across the shaft 22 and the drive roller 25-1.

When a reaction force that is generated as a banknote transported through a nip portion between the driven roller 102 and the drive rollers 25-1 and 25-2 comes into contact with any of the side walls 12, 13, and 14 at the time of normal rotation of the drive rollers 25-1 and 25-2 decelerates the drive roller 25-1 via the banknote, the cam followers and the sloped portions operate to move the one drive roller 25-1 axially outward and decrease the transport grip, thereby exhibiting the actions and effects of skew correction.

Further, while an outer periphery of the one drive roller 25-1 has a tapered inclined surface, an outer periphery of the other drive roller 25-2 has a circular arc shape. Further, while one end of the driven roller 102 has a tapered shape, the other end has a straight shape. This configuration is formed as the difference in the shapes of driven roller portions with which the respective drive rollers come into contact is taken into consideration.

The shape of the driven roller 102 is not bilaterally symmetrical, and a central portion and a left end portion have a straight large diameter (a same diameter portion 102*c*), while a right end portion (a tapered portion 102*d*) has a diameter gradually decreasing in a tapered shape.

At the time of normal rotation of the drive rollers in a state where a transport load is not applied to the drive rollers 25 illustrated in (a), the transport grip in a nip portion N1 between the drive roller 25-1 and the tapered portion 102*d* of the driven roller and the transport grip in a nip portion N2 between the drive roller 25-2 and the same diameter portion 102*c* of the driven roller are both strong, and a banknote can be transported linearly and stably.

Since the drive roller 25-1 is easily displaced axially due to a slight transport load from the banknote, the transport grip in the nip portion N1 is liable to change ((b)).

In this manner, since the outer peripheral shape of the drive rollers and the end shape of the driven roller nipped therewith are made different from each other, only the transport grip on the side of the drive roller 25-1 when the transported banknote receives a reaction force from a side wall fluctuates. That is, while the transport grip generated in the nip portion N1 between the drive roller 25-1 and the driven roller 102 fluctuates, the transport grip generated in the nip portion N2 between the drive roller 25-2 and the driven roller remains in a strong state and maintains a constant value. Therefore, in the normal rotation state of FIG. 25(*b*), when the banknote changes its posture in a direction moving away from the side wall, the banknote can change its posture while rotating about the nip portion N2 having a stronger transport grip. For example, when a banknote is introduced in a state where a right tip corner thereof comes into contact with the right side wall, the banknote is transported while changing its posture, as the banknote rotates about the nip portion N2 in a counterclockwise direction (see FIG. 8).

At the time of reverse rotation illustrated in (c), since the both drive rollers continuously maintain the state of being close to each other, the strong transport grip in the both nip portions N1 and N2 can be maintained, and the banknote or the like can be returned reliably. Further, at the time of stop of the drive rollers, insertion of a banknote can be prevented by the strong grip.

(5) Fifth Configuration Example

Figure 26:
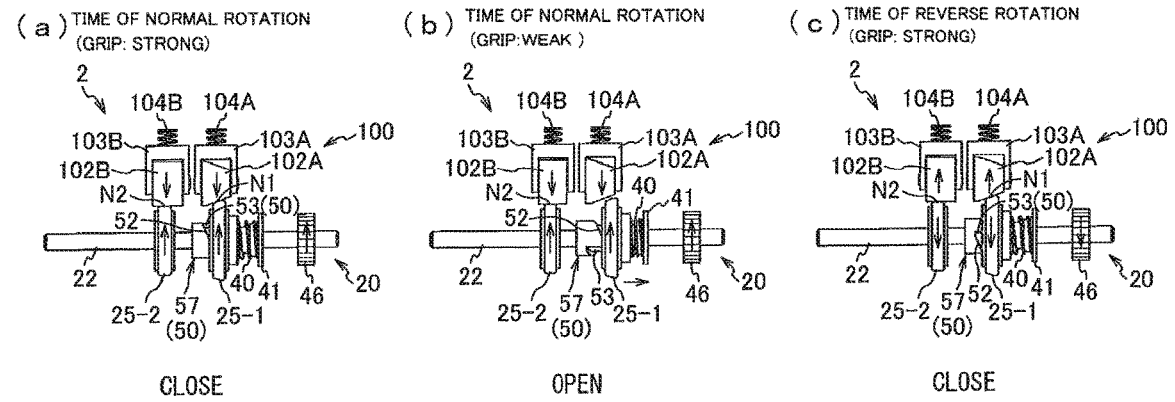
FIGS. 26(*a*), (*b*), and (*c*) are front elevational views illustrating configurations of a friction transport device according to a fifth configuration example of the fourth embodiment and illustrating respective operation modes.

FIG. 26 are explanatory diagrams of a configuration and an operation of a friction transport device according to a fifth configuration example of the fourth embodiment, where (a) is a front elevational view of the friction transport device illustrating a state of a strong transport grip in which drive rollers are closest to each other (at initial positions) at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation.

Parts same as those of the above embodiments are explained as like reference signs are denoted thereto.

The friction transport device 2 according to this configuration example has a characteristic configuration in which the driven roller according to the configuration example of FIG. 25 is divided into two in the axial direction.

That is, in this friction transport device 2, the driven roller is provided in the same number as that of the drive rollers (the movable-side drive roller 25-1, the fixed-side drive roller 25-2) in one-to-one correspondence.

Configurations other than a configuration in which the driven roller 102 is divided into two (102A and 102B) so as to face the drive rollers 25-1 and 25-2 in one-to-one correspondence are the same as that of the second configuration example.

An outer diameter of the left divided driven roller 1028 facing the fixed-side drive roller 25-2 is a straight large diameter, and corresponds to the same diameter portion 102*c* of the driven roller in FIGS. 25. The right divided driven roller 102A facing the movable-side drive roller 25-1 has a configuration in which the outer diameter gradually decreases in a tapered shape, and corresponds to the right-end tapered portion 102*d* of the driven roller in FIGS. 25.

The respective divided driven rollers 102A and 102B are supported rotatably about an axis by respective divided brackets 103A and 103B, and the respective divided brackets are elastically biased individually by respective elastic members 104A and 104B. Therefore, the respective divided driven rollers can rotate independently and skew correction with respect to a banknote that is receiving a reaction force from a side wall can be performed more flexibly by cooperation with the respective divided driven rollers and the drive rollers.

The behaviors of the respective drive rollers and the respective driven rollers are the same as those in the case in FIG. 25, and thus descriptions thereof are omitted.

Operations, actions, and effects of the skew correction due to this friction transport device 2 are identical to those of the second configuration example.

(6) Sixth Configuration Example

Figure 27:
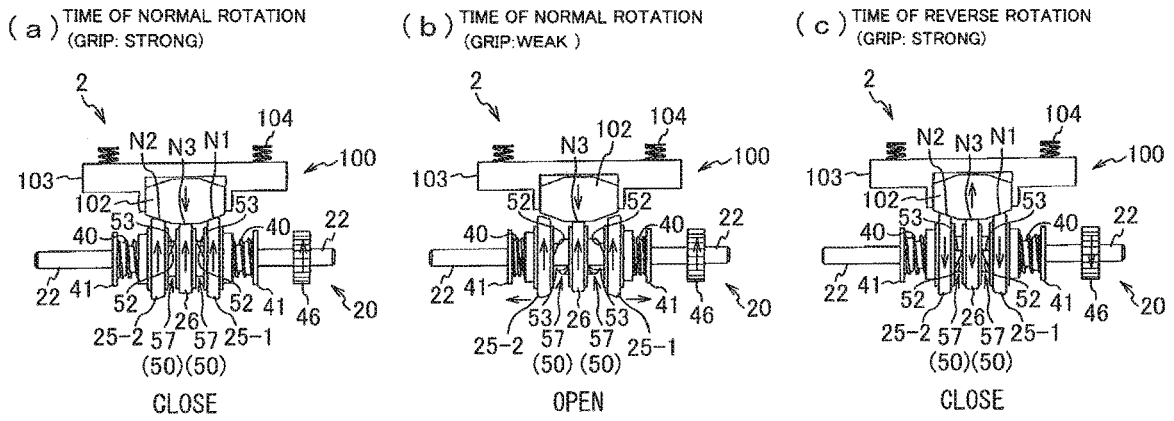
FIGS. 27(*a*), (*b*), and (*c*) are front elevational views illustrating configurations of a friction transport device according to a sixth configuration example of the fourth embodiment and illustrating respective operation modes.

FIG. 27 are explanatory diagrams of a configuration and an operation of a friction transport device according to a sixth configuration example of the fourth embodiment, where (a) is a front elevational view of the friction transport device illustrating a state of a strong transport grip in which drive rollers are closest to each other (at initial positions) at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation.

Parts same as those of the above embodiments are explained as like reference signs are denoted thereto.

In the friction transport device 2 according to this configuration example, the transport drive gear 46 is fixed to the shaft 22 axially outward of one drive roller 25-1, and two drive rollers (movable-side drive rollers) 25-1 and 25-2 are attached to the shaft 22, putting the cam member 57 therebetween, so as to be capable of relative rotation and axially movable with respect to the shaft 22, and the respective drive rollers are biased axially inward by respective elastic biasing members 40. Further, a shaft core of a drive roller (a fixed-side drive roller) 26 is fixed to the shaft at an intermediate position between the drive rollers 25-1 and 25-2.

The cam member 57 in this configuration example is incorporated in the drive roller (the fixed-side drive roller) 26, whose shaft core is fixed to the shaft 22, and an outer periphery of the drive roller 26 is nipped with an outer periphery of the driven roller 102 constantly. In this example, since the driven roller 102 has a crown shape, the diameter of the drive roller 26 is smaller than the diameters of the drive rollers 25-1 and 25-2 at the both ends. However, this configuration is only an example, and the shapes and the sizes of the respective drive rollers can be variously changed according to the difference in the shape of the driven roller.

The fixed-side drive roller 26 provided with the cam member 57 includes the cam portion 51 (the sloped portion 52) respectively at both end faces in the axial direction, and each cam follower 55 provided in the respective drive rollers 25-1 and 25-2 is brought into pressure contact with each of the sloped portions by each of the elastic biasing members 40.

The drive roller 26 is nipped with a central portion (a large diameter portion) of the driven roller 102 constantly, and a transport grip thereof is set to be constant in a strong state. Meanwhile, transport grips of the right and left drive rollers 25-1 and 25-2 respectively facing the right and left tapered portions of the driven roller fluctuate due to a change of the transport load received from a nipped banknote.

At the time of normal rotation of the respective drive rollers in a state where a transport load is not applied to the drive rollers 25-1 and 25-2 illustrated in FIG. 27(*a*), the transport grips in all the nip portions N1, N2, and N3 are set to be strong to an extent that can transport a banknote forward stably.

On the other hand, at the time of transport by normal rotation in FIG. 27(*b*), when a reaction force in a direction different from the transport direction is applied to a banknote being transported through the nip portions N1, N2, and N3 between the respective drive rollers 25-1, 25-2, and 26 and the driven roller 102 due to contact with a side wall, the rotational speed of the drive rollers 25-1 and 25-2 having received a transport load due to the reaction force decelerates. Therefore, the cam mechanism 50 operates, and the drive rollers 25-1 and 25-2 are displaced axially outward due to a speed difference generated between the drive rollers 25-1 and 25-2 and the drive roller 26, thereby decreasing the transport grip in the respective nip portions N1 and N2.

Meanwhile, while the transport grip in the nip portion N3 between the central drive roller 26 and the driven roller is strong and constant, the transport grip is slightly stronger than the transport grip in the respective nip portions N1 and N2, and thus the banknote rotates about the nip portion N3. When the banknote comes into contact with the right side wall, the banknote turns in a counterclockwise direction about the nip portion N3, and is transported to the inner side of the transport path while canceling out the reaction force from the side wall (see FIG. 8).

At the time of reverse rotation of the drive rollers illustrated in (c), the transport grip in all the nip portions N1, N2, and N3 becomes strong, and the banknote can be reliably returned. Further, at the time of stop of the drive rollers, insertion of a banknote can be prevented by the strong grip.

In this manner, there is no limitation in the number of drive rollers that can be provided in the present invention.

(7) Seventh Configuration Example

Figure 28:
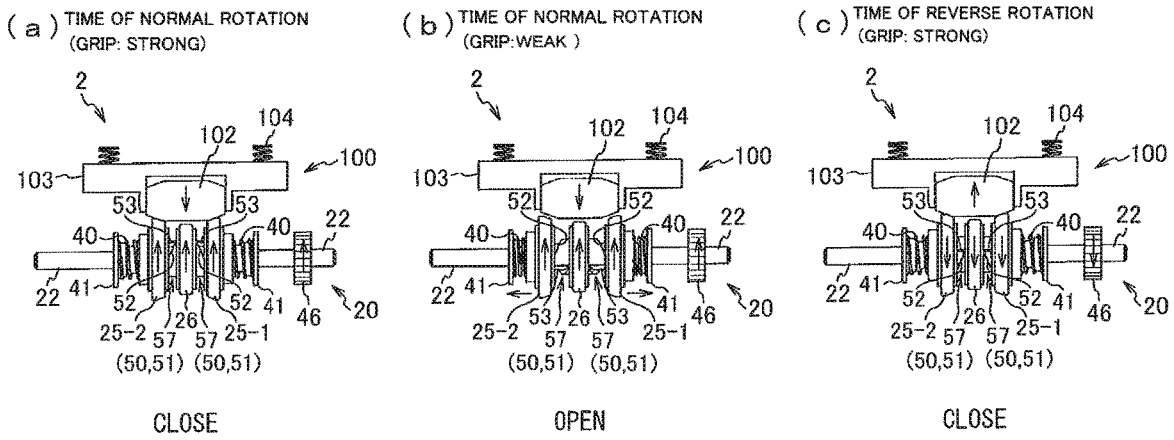
FIGS. 28(*a*), (*b*), and (*c*) are front elevational views illustrating configurations of a friction transport device according to a seventh configuration example of the fourth embodiment and illustrating respective operation modes.

FIG. 28 are explanatory diagrams of a configuration and an operation of a friction transport device according to a seventh configuration example of the fourth embodiment, where (a) is a front elevational view of the friction transport device illustrating a state of a strong transport grip in which drive rollers are closest to each other (at initial positions) at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation.

This friction transport device 2 is a modification of the sixth configuration example, and differs from the friction transport device 2 according to the sixth configuration example only in a feature that an outer periphery of the central drive roller (the fixed-side drive roller) 26 and the central portion of the driven roller 102 is constantly in a non-contact state. The configuration in which a gap is provided between the fixed-side drive roller and the driven roller is common to those illustrated in FIG. 23 and FIG. 24.

Since the fixed-side drive roller 26 is separated from the driven roller 102 constantly, in the normal rotation state of FIG. 28(*a*), the transport grip is slightly weak. Further, as in the friction transport device 2 of the sixth configuration example, in the normal rotation state of FIG. 28(*a*), the transport grip by the drive rollers 25-1 and 25-2 in the state of being closest to each other is strong. Therefore, due to the strong transport grip by the respective drive rollers 25-1, 25-2, and 26, a banknote can be transported forward. That is, the transport grip between the respective drive rollers and the banknote is set to have an appropriate strength necessary and sufficient for transporting the banknote forward.

At the time of generation of a transport load due to the skew of the banknote illustrated in (b), the transport grip by the drive rollers 25-1 and 25-2 displaced axially outward decreases to enable skew correction of the banknote.

At the time of reverse rotation of the drive rollers illustrated in (c), a banknote can be transported in a reverse direction by a strong transport grip of the drive rollers 25-1 and 25-2 in the state of being closest to each other. Further, at the time of stop of the drive rollers, insertion of a banknote can be prevented by the strong grip.

(8) Configuration Common to Second Configuration Example to Seventh Configuration Example The friction transport devices according to the second configuration example to the seventh configuration example are common in the following configuration.

The friction transport device 2 according to each of the respective configuration examples has a common configuration described below. That is, the drive-side unit 20 includes each one of drive rollers (fixed-side drive rollers) 25-2 and 26 fixed to the shaft 22, other drive rollers (movable-side drive rollers) 25-1 and 25-2 arranged so as to be capable of relative rotation and axially movable with respect to the shaft 22, and coaxially with the one drive roller, the elastic biasing member 40 that elastically biases the other roller toward the one drive roller, the cam mechanism 50 arranged to span across the shaft between the respective drive rollers (at an intermediate position) and the other drive roller, and the transport driving member 46 that is fixed to the shaft axially outward of any one of the drive rollers and rotated and driven by the driving source. The driven rollers 102, 102A, and 102B decrease the transport grip when the other drive roller moves axially against the elastic biasing member.

In this manner, even if at least one drive roller is a fixed-side drive roller fixed to the shaft, while the other movable-side drive roller is configured to be able to move axially, the transport load between the movable-side drive roller and the driven roller can be changed, since the movable-side drive roller moves axially due to a load received from a banknote, and the skew correction function as a friction transport device can be exhibited.

(9) Eighth Configuration Example

Figure 29:
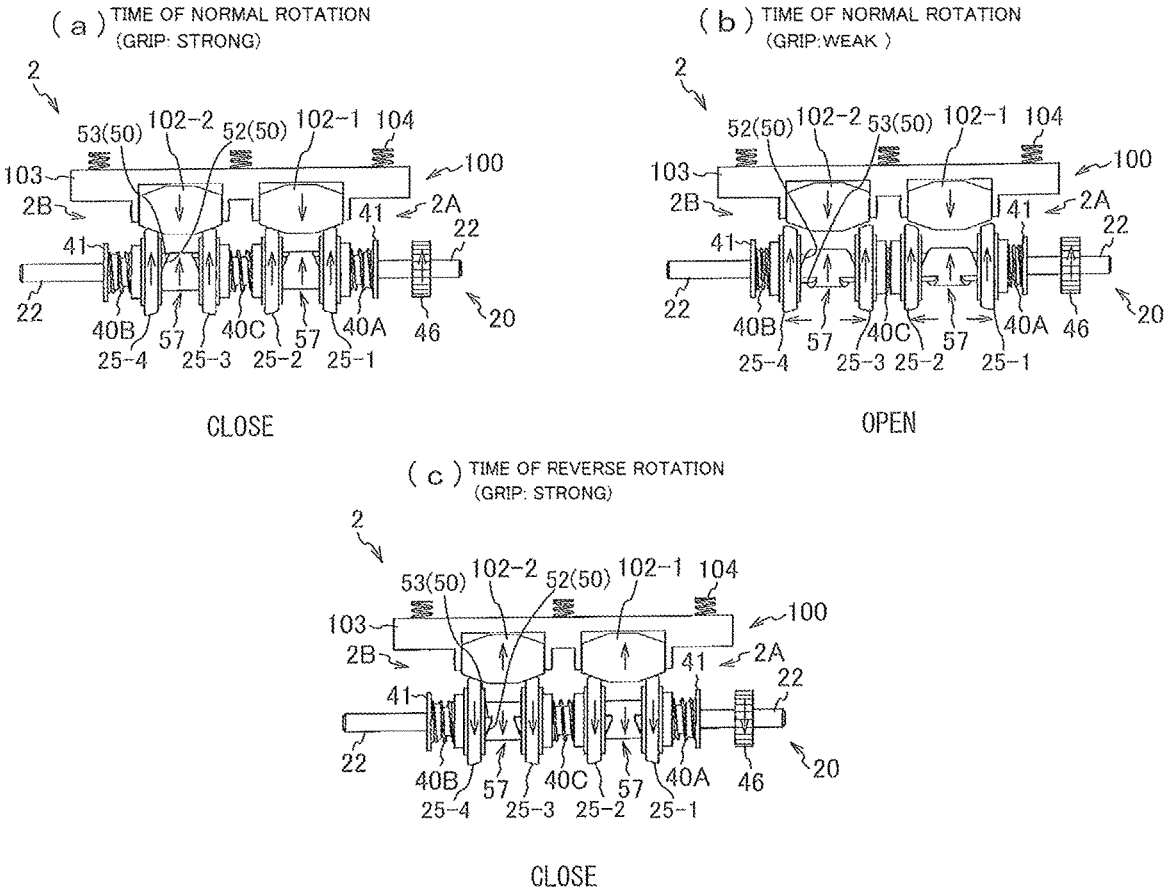
FIGS. 29(*a*), (*b*), and (*c*) are front elevational views illustrating configurations of a friction transport device according to an eighth configuration example of the fourth embodiment and illustrating respective operation modes.

FIG. 29 are explanatory diagrams of a configuration and an operation of a friction transport device according to an eighth configuration example of the fourth embodiment, where (a) is a front elevational view of the friction transport device illustrating a state of a strong transport grip in which drive rollers are closest to each other (at initial positions) at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip in which the respective drive rollers are closest to each other at the time of reverse rotation.

The friction transport device 2 is a modification of the first configuration example illustrated in FIG. 22, and it has a characteristic configuration in which a friction transport mechanism including a drive roller pair and the driven roller 102 is arranged in two sets (2A and 2B) in series. Therefore, components same as those in FIG. 22 are explained as these components are denoted by like reference signs.

In this configuration example, the first friction transport mechanism 2A is constituted by two drive rollers 25-1 and 25-2 and one driven roller 102-1, and the second friction transport mechanism 2B is constituted by two drive rollers 25-3 and 25-4 and one driven roller 102-2. An elastic member 40C formed by a coil spring is arranged coaxially with the shaft 22 between the two friction transport mechanisms 2A and 2B, thereby biasing the respective friction transport mechanisms 2A and 2B in a direction moving away from each other.

The behavior due to individual friction transport devices 2A and 2B is identical to that of the configuration example in FIG. 22.

That is, at the time of normal rotation when a transport load from a banknote is not applied to the drive rollers illustrated in FIG. 29(*a*), the two drive rollers 25-1 and 25-2 on one side are biased axially inward (in a direction the drive rollers approaching each other) by elastic biasing members 40A and 40C, and thus the transport grip becomes a predetermined strong state. The other two drive rollers 25-3 and 25-4 are biased axially inward (in a direction the drive rollers approaching each other) by elastic biasing members 40B and 40C, and thus the transport grip is in a predetermined strong state. Therefore, a banknote moving inside in a normal posture is transported forward.

When a transport load from the banknote is being applied to the drive rollers illustrated in (b), the two drive rollers 25-1 and 25-2, and the drive rollers 25-3 and 25-4 respectively move axially outward (in a direction moving away from each other) against the elastic biasing members 40A and 40C, and the elastic biasing members 40B and 40C. Therefore, the transport grip becomes weak in relation to the shape of the driven roller. Accordingly, the posture of the banknote in a skewed state can be corrected.

Further, at the time of reverse rotation illustrated in (c), since the transport grip between the respective drive rollers and the banknote becomes strong, the banknote can be reliably return-transported. At the time of stop of the drive rollers, insertion of a banknote can be prevented by the strong transport grip.

In this manner, the number of drive rollers and the number of driven rollers are not limited to any number, and two or more sets of these rollers can be provided.

(10) Ninth Configuration Example

Figure 30:
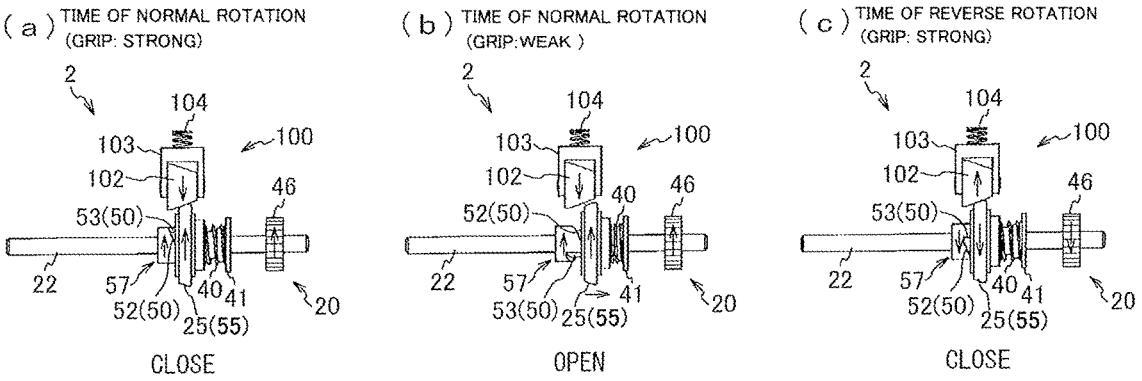
FIGS. 30(*a*), (*b*), and (*c*) are front elevational views illustrating configurations of a friction transport device according to a ninth configuration example of the fourth embodiment and illustrating respective operation modes.

FIG. 30 are explanatory diagrams of a configuration and an operation of a friction transport device according to a ninth configuration example of the fourth embodiment, where (a) is a front elevational view of the friction transport device illustrating a state of a strong transport grip in which drive rollers are closest to each other (at initial positions) at the time of normal rotation, (b) is a front elevational view thereof illustrating a state of a weak transport grip in which an interval between the drive rollers is increased at the time of normal rotation (a cam mechanism operating state), and (c) is a front elevational view thereof illustrating a state of a strong transport grip at the time of reverse rotation.

The drive-side unit 20 constituting the friction transport device 2 according to this configuration example includes one axially movable drive roller 25, one cam member 57 that is fixedly arranged on a shaft 22, one cam mechanism element 55 or the other cam mechanism element 52 that is arranged in the drive roller, the other cam mechanism element 52 or the one cam mechanism element 55 that is arranged in the cam member, an elastic biasing member 40 that elastically biases the drive roller in a direction in which the respective cam mechanism elements are brought into pressure contact with each other, and the transport driving member 46 that is fixed to the shaft axially outward of the drive roller or the cam member and rotated and driven by a driving source.

In the friction transport device 2, the drive-side unit 20 is constituted by the single drive roller 25, the single cam member 57, the single elastic biasing member 40, a bush 41, and the transport drive gear 46. The driven roller 102 constituting the driven-side unit 100 has a tapered shape with a short axial length corresponding to a thickness of the single drive roller 25.

The drive roller 25 is capable of relative rotation and axially movable with respect to the shaft 22, and a driving force from the transport drive gear 46 is transmitted to the drive roller 25 via the cam member 57 by bringing the sloped portion 52 of the cam member 57 fixed to the shaft 22 and the cam follower 55 provided in the drive roller, which are at adjacent positions, into pressure contact with each other by the elastic biasing member 40.

In this manner, even if the friction transport device is constituted by a single drive roller 25, the transport grip can be set to be a predetermined strong state to realize reliable transport, at the time of transport in the normal rotation in a state where a transport load is not applied to the drive roller illustrated in FIG. 30(*a*). At the time of transport in the normal rotation in a state where a transport load is applied to the drive roller illustrated in (b), the drive roller axially moves from an initial state in (a) with good responsiveness by an application of a slight transport load to weaken the transport grip, thereby enabling to perform the skew correction.

Further, at the time of reverse transport illustrated in (c), the transport grip can be strengthened to realize reliable return transport. At the time of stop of the drive roller, insertion of a banknote can be prevented by the strong transport grip.

In this manner, the number of drive rollers is not limited to any number, and the number thereof can be one.

Further, it is a matter of course that a cam follower (cam mechanism element) can be provided in the cam member 57, and a sloped portion (cam mechanism element) can be provided in the drive roller.

(11) Tenth Configuration Example

Figure 31:
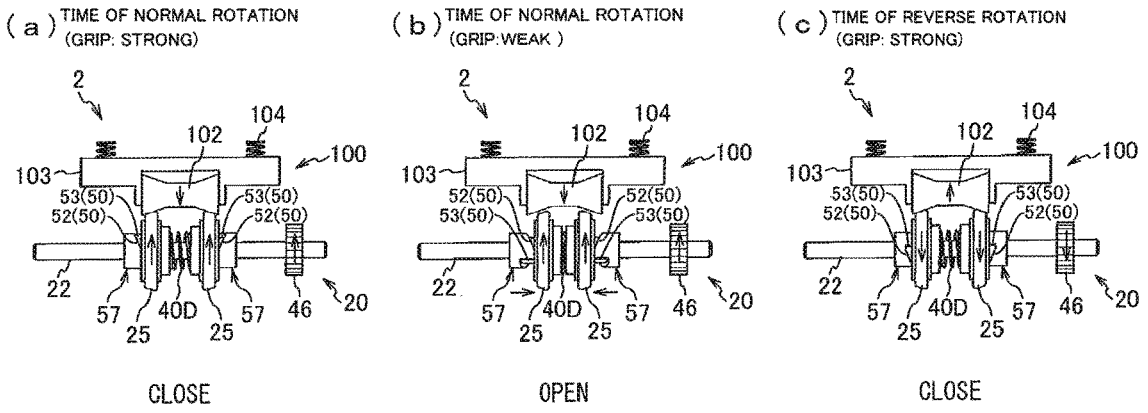
FIGS. 31(*a*), (*b*), and (*c*) are front elevational views illustrating configurations of a friction transport device according to a tenth configuration example of the fourth embodiment and illustrating respective operation modes.

FIG. 31 are explanatory diagrams of a configuration and an operation of a friction transport device according to a tenth configuration example of the fourth embodiment, where (a) is a front elevational view of the friction transport device illustrating a state of a strong transport grip in which drive rollers are closest to each other at the time of normal rotation during which a transport load is not applied (at initial positions), (b) is a front elevational view thereof illustrating a state of a weak transport grip in which an interval between the drive rollers is increased at the time of normal rotation during which a transport load is applied (a cam mechanism operating state), and (c) is a front elevational view thereof illustrating a state of a strong transport grip at the time of reverse rotation.

This friction transport device 2 has a characteristic configuration in which the drive-side unit 20 includes two drive rollers 25 biased in a direction moving away from each other by an elastic biasing member 40D, and cam members 57 that are fixedly arranged respectively to a shaft axially outwards of the respective drive rollers, and one cam mechanism element 52 or the other cam mechanism element 55 is arranged in the respective drive rollers, and the other cam mechanism element 55 or the one cam mechanism element 52 is arranged in the cam member.

Further, the configuration of the driven roller 102 also has a characteristic such that the transport grip between the drive rollers and a banknote when the respective drive rollers are at operating positions where the drive rollers are close to each other becomes lower than that when the respective drive rollers are at initial positions where an interval between the drive rollers is increased.

That is, in the friction transport device 2, the two drive rollers 25 supported by the shaft 22 so as to be capable of relative rotation and axially movable with respect to the shaft 22 are biased in a direction moving away from each other by the elastic biasing member 40D that is arranged between the both drive rollers (at intermediate positions). Axially outward movement of the respective drive rollers is regulated by the cam members 57 and 57 respectively fixed to the shaft 22 axially outward of the respective drive rollers 25. Further, the sloped portion 52 (the cam portion 51) is provided in each cam member, and the cam follower (cam mechanism element) 55 provided in each drive roller and each sloped portion (cam mechanism element) 52 are brought into pressure contact with each other by the elastic biasing member 40D. The transport drive gear 46 is fixed to the shaft 22 axially outward of the one drive roller.

The cam follower 55 can be provided in the cam member 57 and the sloped portion 52 can be provided in the drive roller.

Since the driven roller 102 has a reversed crown shape, as illustrated in FIGS. 31(*a*) and (*c*), when the interval between the respective drive rollers is increased and the drive rollers are at axially outward positions (initial positions), the drive rollers come into contact with a large diameter portion of the driven roller and the transport grip with the banknote becomes strong.

As illustrated in (b), when the respective drive rollers are closest to each other (at the operating positions), a gap is formed between the drive rollers and a small diameter portion of the driven roller so as to weaken the transport grip, thereby enabling to perform skew correction.

At the time of reverse transport illustrated in (c), the state where the both drive rollers are closest to each other is maintained. Therefore, the transport grip can be strengthened to realize reliable return transport. Further, at the time of stop of the drive roller, insertion of a banknote can be prevented by the strong transport grip.

(12) Eleventh Configuration Example

Figure 32:
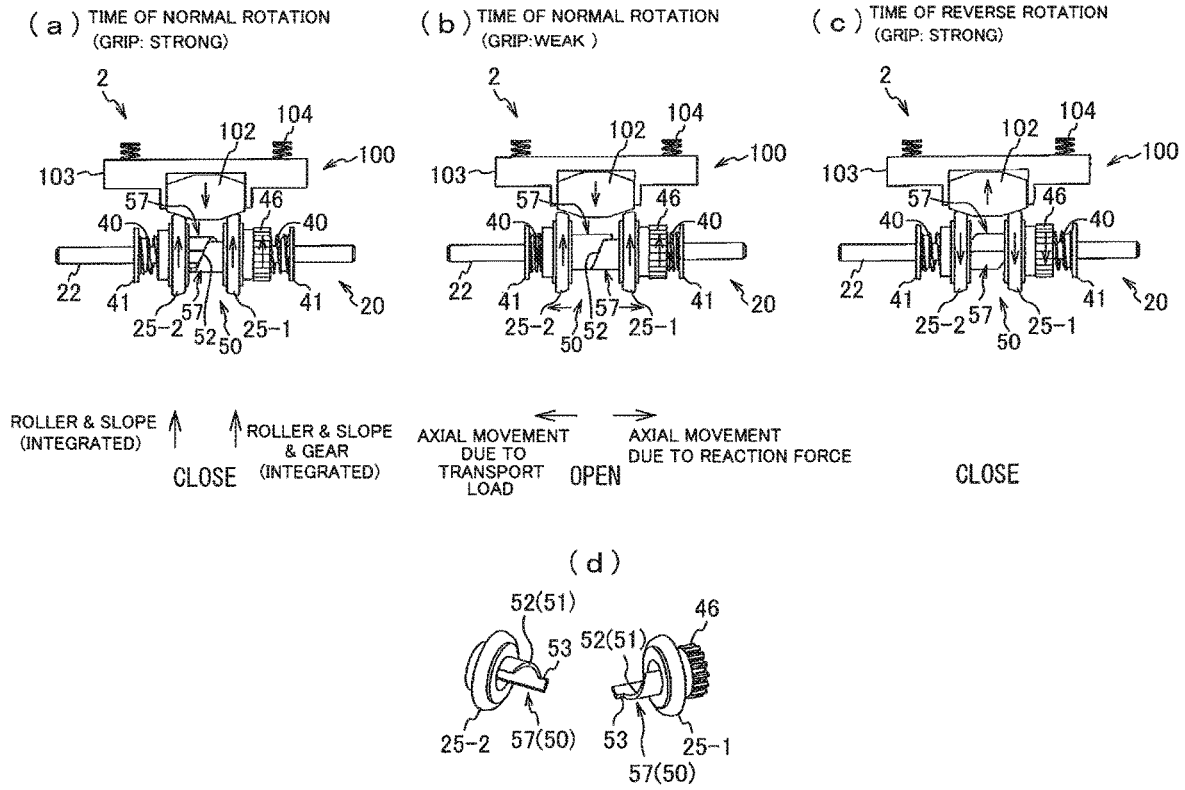
FIGS. 32(*a*), (*b*), and (*c*) are front elevational views illustrating configurations of a friction transport device according to an eleventh configuration example of the fourth embodiment and illustrating respective operation modes, and (d) is an exploded perspective view.
Figure 33:
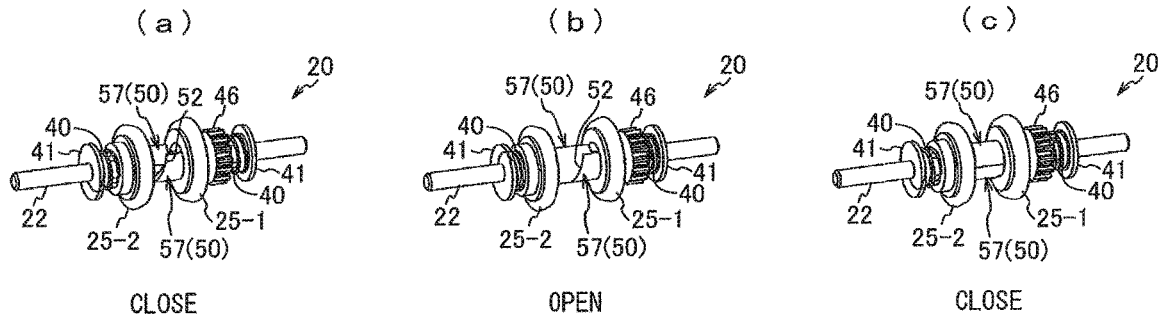
FIGS. 33(*a*), (*b*), and (*c*) are perspective views respectively corresponding to FIGS. 32(*a*), (*b*), and (*c*).

FIG. 32 are explanatory diagrams of a configuration and an operation of a friction transport device according to an eleventh configuration example of the fourth embodiment, where (a) is a front elevational view of the friction transport device illustrating a state of a strong transport grip in which drive rollers are closest to each other at the time of normal rotation during which a transport load is not applied, (b) is a front elevational view thereof illustrating a state of a weak transport grip in which an interval between the drive rollers is increased at the time of normal rotation during which a transport load is applied (a cam mechanism operating state), and (c) is a front elevational view thereof illustrating a state where the respective drive rollers are closest to each other at the time of reverse rotation. Further, FIG. 32(*d*) is an exploded perspective view of the respective drive rollers including a cam member. FIGS. 33(*a*), (*b*), and (*c*) are perspective views respectively corresponding to FIGS. 32(*a*), (*b*), and (*c*).

In this configuration example, the drive-side unit 20 includes at least two drive rollers 25, cam members 57 that are respectively arranged on a surface facing the respective drive rollers, elastic biasing members 40 that elastically bias the respective drive rollers in an axial direction the drive rollers approaching each other to bring the cam members into pressure contact with each other in a sliding manner, and the transport driving member 46 integrally formed with one drive roller on the axial direction side, and this configuration is characterized such that the one cam member includes the other cam mechanism element 52, and the other cam member includes the other cam mechanism element 52 or one cam mechanism element 55 (not illustrated).

That is, this configuration example has a common feature with the respective configuration examples described above that the transport drive gear 46 is arranged at a position avoiding the shaft 22 between the drive rollers 25-1 and 25-2, that is, arranged axially outward of the one drive roller 25-1. However, this configuration example has a different feature therefrom that the transport drive gear 46 is fixed axially outward of the one drive roller 25-1 to directly drive the one drive roller 25-1.

Further, as the cam mechanism 50 that changes an axial interval between the drive rollers so that the drive rollers approach each other or separate from each other, each cam member 57 including the sloped portion 52 is fixedly arranged respectively on an internal surface of each of the drive rollers 25-1 and 25-2.

The cam member 57 has, as illustrated in FIG. 32(*d*), a configuration in which a substantially hollow cylindrical body formed by a thin plate including the sloped portion 52

(the cam portion 51, a cam mechanism element) whose axial position gradually increases (gradually decreases) according to a difference of a circumferential position, and the stopper 53 (cam mechanism element) provided in a protruding state at one end in a circumferential direction of each sloped portion 52 is axially divided into two.

The respective drive rollers 25-1 and 25-2 are assembled to the shaft 22 that does not rotate with a predetermined positional relationship so as to be capable of relative rotation and axially movable with respect to the shaft 22, and are configured in such a manner that the respective sloped portions 52 of the cam members 57 fixed to the internal surface of the respective drive rollers come into alignment and into contact with each other in a sliding manner. The elastic biasing members 40 perform biasing so as to maintain a contact state between the sloped portions. In a state where the stoppers 53 comes into contact with each other, relative rotation of the both drive rollers is regulated.

At the time of normal rotation during which a transport load from a banknote is not applied to the drive rollers illustrated in FIG. 32(*a*) and FIG. 33(*a*), the two drive rollers 25-1 and 25-2 are in a predetermined state with a transport grip being strong. Therefore, at the time of normal rotation, the banknote can be transported forward normally.

When a transport load from the banknote is applied to the drive rollers illustrated in FIG. 32(*b*) and FIG. 33(*b*), the two drive rollers 25-1 and 25-2 move axially outward (in a direction moving away from each other) against the elastic biasing members 40 respectively, and thus the transport grip becomes weak in relation to the shape of the driven roller. Accordingly, the posture of the banknote in a skewed state can be corrected.

However, even if a transport load is applied only to the drive roller 25-1 integrated with the transport drive gear 46, both drive rollers 25-1 and 25-2 do not move axially outward. Only when a transport load is applied to the left drive roller 25-2 or simultaneously to the drive rollers 25-1 and 25-2, the right and left drive rollers move axially outward to shift to a state of a weak transport grip capable of performing skew correction.

Further, at the time of reverse rotation illustrated in FIG. 32(*c*) and FIG. 33(*c*), since the stoppers maintain an engaged state, the transport grip between the respective drive rollers and the banknote becomes strong, and the banknote can be return-transported reliably.

At the time of stop of the drive rollers, insertion of a banknote can be prevented because a nipping force with the driven roller is strengthened.

In this example, a configuration in which each of the cam members 57 having the sloped portion is arranged in each drive roller to face each other is described. However, the configuration can be such that a cam member having the sloped portion (cam mechanism element) is arranged in one of the drive rollers, and a cam member 57 having the cam follower (cam mechanism element) 55 is arranged in the other drive roller to bring the sloped portion and the cam follower into pressure contact with each other in a sliding manner.

Fifth Embodiment

Figure 34:
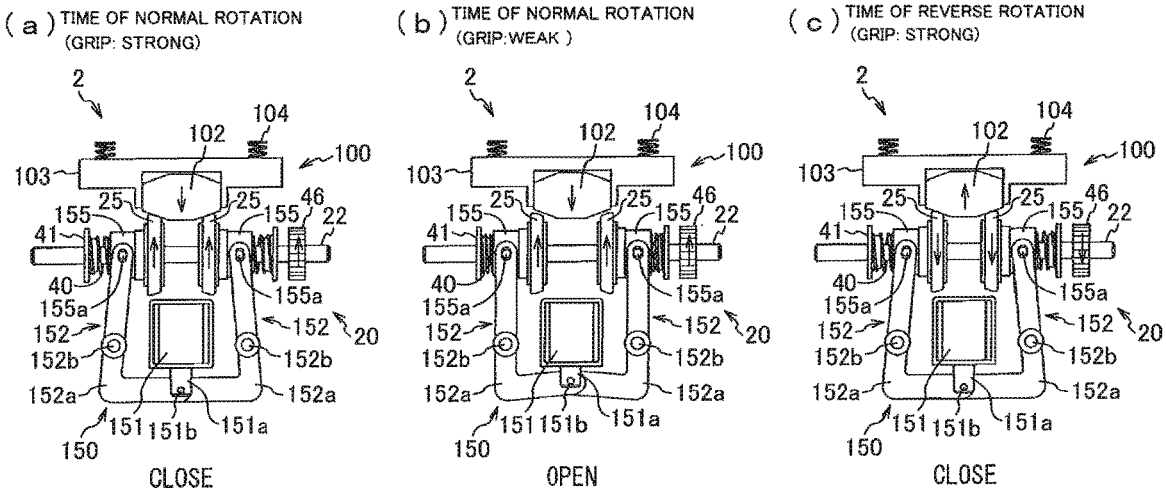

FIG. 34 are configuration examples of a friction transport device according to a fifth embodiment of the present invention, where (a) is an operation explanatory diagram at the time of normal rotation transport (transport grip: strong), (b) is an operation explanatory diagram at the time of skew correction (transport grip: weak), and (c) is an operation explanatory diagram at the time of reverse rotation (transport grip: strong).

Components same as those of the above embodiments are explained as like reference signs are denoted thereto.

The assembly structure of the drive rollers 25, the elastic biasing members 40, the bush 41, and the transport drive gear 46 with respect to the shaft 22, and the arrangement of the driven roller 102 with respect to the drive rollers are identical to those of the configuration example in FIG. 22, and redundant explanations thereof are omitted.

The friction transport device 2 according to this example includes the drive-side unit 20 that transmits a transport driving force to one surface of a banknote transported on the banknote transport path 10, the driving source 60 that supplies a driving force to the drive-side unit, the driven-side unit 100 that is arranged to face the drive-side unit 20 and comes into contact with the other surface of the banknote. The drive-side unit is characterized by including at least one drive roller 25 supported rotatably and axially movably by the shaft 22 orthogonal to (intersecting with) a normal banknote transport direction, an elastic biasing member 40 that elastically biases the drive roller 25 in the axial direction, and an electric actuating mechanism 150 that changes an axial position of the drive roller against an elastic biasing force. The driven-side unit is characterized by including the driven roller 102 that changes a transport grip between the drive roller and a banknote according to a change of the axial position of the drive roller.

In the respective embodiments described above, an external transport load that acts on the normally rotating drive roller 25 via a banknote is used as a power source for axially moving the drive roller 25. However, in the present embodiment, actuators such as a solenoid are used instead of the external transport load to axially move the drive roller 25.

That is, in the present embodiment, the drive rollers 25 and 25 are moved forward and backward axially by using the electric actuating mechanism 150 that actuates respective arms 152 and 152 by using an electric actuator 151 such as a solenoid instead of the cam mechanism 50. One end of an L-shaped arm piece 152*a* constituting the respective arms is pivotally supported turnably by a shaft 151*b* of a plunger 151*a* of the solenoid that is projectable and retractable from the actuator 151, and an intermediate portion of each of the arm pieces 152*a* is pivotally supported turnably by a shaft 152*b* whose position is fixed. The other end of each of the arm pieces 152*a* rotatably supports each drive roller, and is turnably coupled to a pin 155*a* of each bearing member 155 that axially moves with respect to the shaft 22.

When the actuator 151 is turned OFF illustrated in FIG. 34(*a*), since the plunger 151*a* projects, each arm 152*a* turns inward about the shaft 152*b* by a force of the elastic biasing member 40 to position each drive roller inside. In this state, forward transport of a banknote becomes possible by the normal rotation of the drive rollers.

When the actuator 151 is turned ON as illustrated in FIG. 34(*b*), since the plunger 151*a* is retracting, each arm 152*a* turns outward about the shaft 152*b* against the elastic biasing member 40 to position each drive roller outside. In this state, since the transport grip between the drive rollers and the banknote becomes weak, skew correction becomes possible.

In FIG. 34(*c*), since the actuator 151 is turned OFF, the plunger 151*a* projects and each arm 152*a* turns inward about the shaft 152*b* by the force of the elastic biasing member 40. In this state, the drive rollers rotate reversely to enable reliable return of the banknote, a card, or the like. Further, by stopping the drive rollers, it is possible to prevent insertion of a banknote while maintaining a state where the transport grip is strengthened.

According to this configuration, the axial direction of the drive rollers is not automatically changed according to the transport load, and when the actuator is turned OFF, the transport grip remains in a strong state. Further, at the time of skew correction, after an insertion of a banknote is detected by an inlet sensor, the actuator is turned ON beforehand, and the drive rollers are moved axially outward. Accordingly, such an advantage can be provided that the strength of the transport grip can be switched between strong and weak states at an arbitrary timing.

Figure 35:
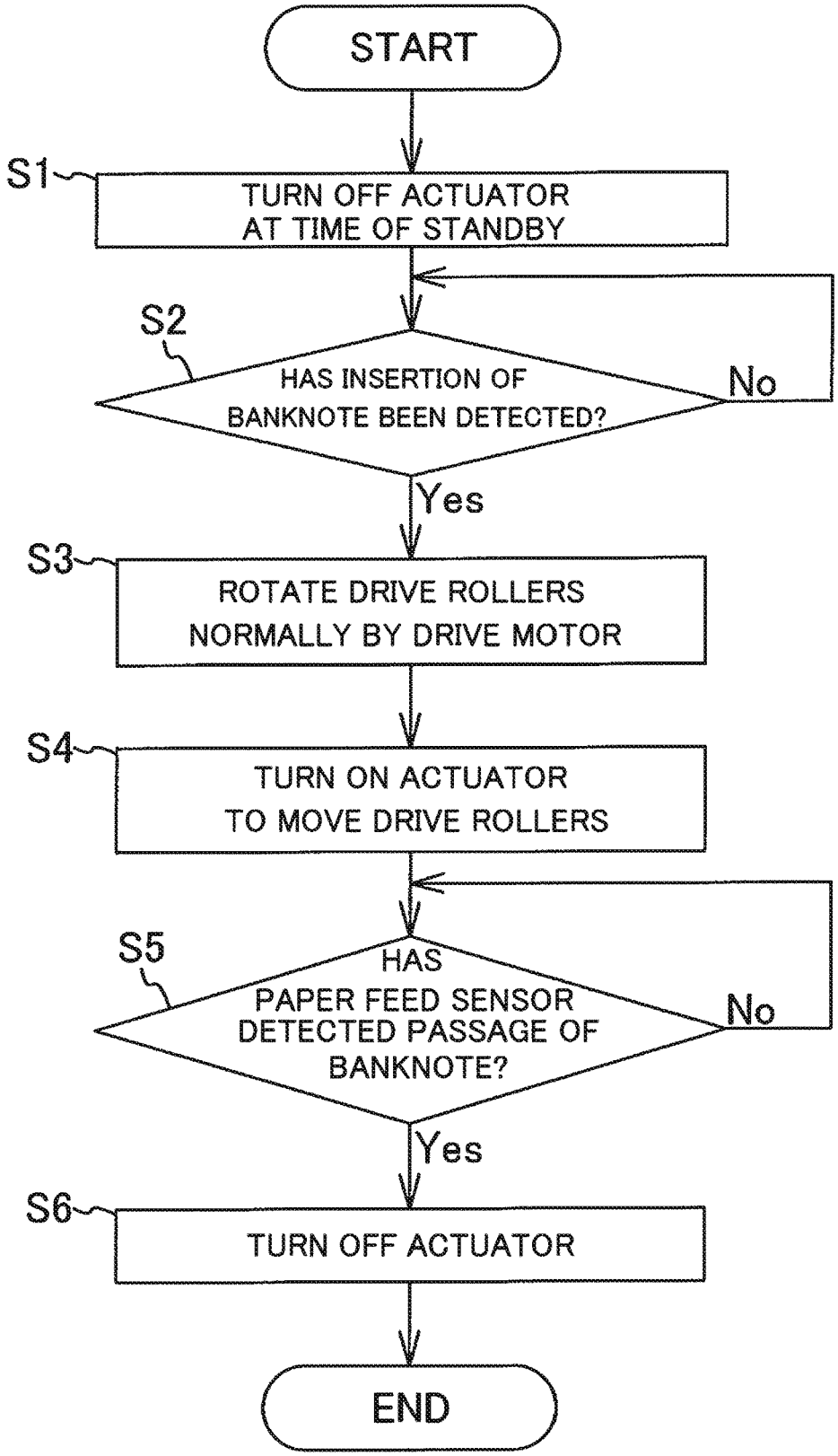
FIG. 35 is a flowchart illustrating a skew correction procedure performed by the friction transport device according to the present embodiment.

FIG. 35 is a flowchart illustrating a skew correction procedure performed by the friction transport device 2 according to the present embodiment.

First, at the time of standby when waiting for an insertion of a banknote by a user, the actuator 151 is turned OFF (step S1). At this time, the transport grip between the drive rollers 25 and the driven roller 102 is set to be strong, thereby enabling to transport the banknote forward stably. Since a configuration corresponding to the cam mechanism 50 is not provided, an operation to decrease the transport grip by axially moving the drive rollers automatically with respect to the transport load cannot be performed, and the strong transport grip is maintained in a period during which the actuator 151 constituting the electric actuating mechanism 150 is turned OFF, and when the actuator 151 is turned ON, the axial positions of the drive rollers are changed to finely adjust the transport grip.

At step S2, when an insertion of a banknote is detected by an inlet sensor 15, the drive rollers 25 are rotated normally by a drive motor (step S3).

At step S4, the actuator 151 is turned ON to move the drive rollers axially outward. That is, after detection of an insertion of a banknote by the inlet sensor, the drive rollers are moved axially to weaken the transport grip. In this state, the transport posture of the banknote in a skewed state passing through the friction transport device is corrected.

Next, at step S5, it is judged whether a paper feed sensor that is arranged on a downstream side with respect to the friction transport device 2 has detected passage of a banknote, and when passage of the banknote is detected, the actuator is turned OFF (step S6).

Whether a predetermined time has passed can be used as a judgment criterion for turning OFF the actuator, instead of detection of the passage of a banknote.

When there is provided a sensor that detects and judges whether a banknote is skewed, the actuator is turned OFF at a time point when it is detected and judged that the skew is canceled out.

At the time of reverse rotation illustrated in (c), by turning OFF the actuator at the time of standby, the transport grip is maintained in a strong state.

The electric actuating mechanism 150 can be applied to other configuration examples such as a configuration example in which one of drive rollers is fixed to a shaft and the other drive roller is arranged so as to be capable of relative rotation and axially movably with respect to a shaft as illustrated in FIG. 23, other than the configuration example in which two drive rollers are arranged respectively so as to be capable of relative rotation and axially movably with respect to a shaft as illustrated in FIG. 22.

Sixth Embodiment

The friction transport device 2 according to a sixth embodiment has a function of preventing double feed of banknotes, while not having a skew correction function.

(1) First Configuration Example

Figure 36:
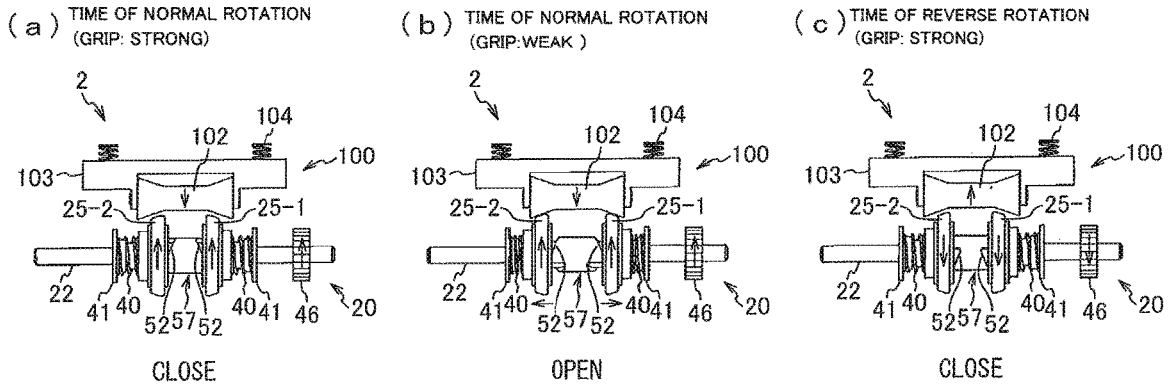
FIGS. 36(*a*), (*b*), and (*c*) are front elevational views illustrating configurations of a friction transport device according to a first configuration example of a sixth embodiment and illustrating respective operation modes.

FIG. 36 are explanatory diagrams of a configuration and an operation of a friction transport device according to a first configuration example of the sixth embodiment, where (a) is a front elevational view of the friction transport device illustrating a state of a weak transport grip in which drive rollers are closest to each other at the time of normal rotation in an initial state where a transport load is not applied, (b) is a front elevational view thereof illustrating a state of a strong transport grip in which an interval between the drive rollers is increased at the time of normal rotation during which a transport load is applied (a cam mechanism operating state), and (c) is a front elevational view thereof illustrating a state of a weak transport grip at the time of reverse rotation.

Since the configuration of the drive-side unit 20 is the same as that of FIG. 22, redundant explanations thereof are omitted. The driven-side unit 100 is different from the configuration example in FIG. 22 in that the driven roller 102 has a reversed crown shape.

In a state of FIG. 36(*a*), since the cam mechanism 50 is not operating, the both drive rollers 25 are biased inward by the elastic biasing members 40, and an outer periphery of each drive roller is at a position near the center of the driven roller 102 in a non-contact state, and thus the transport grip is weak.

In a state of FIG. 36(*b*), the cam mechanism 50 operates due to a transport load from a banknote and thus the drive rollers move axially outward, and the outer peripheries of the drive rollers come into contact with both ends having a large diameter of the driven roller. Therefore, the transport grip is strong.

In a reverse rotation state of FIG. 36(*c*), the drive rollers are at positions near the center of the driven roller, and the grip is weak.

When the friction transport device 2 according to the present embodiment is applied to a paper feed mechanism that feeds banknotes one by one from the banknote on the bottom side of a bundle of stacked banknotes, it has been found that there is an effect of preventing double feed.

That is, when two or more banknotes enter a gap between the drive rollers and the driven roller in the state of (a), the cam mechanism 50 operates susceptibly in response to a transport load with a small value received by the drive rollers from the banknotes, thereby displacing the drive rollers axially outward as illustrated in (b).

In the state of (b), since the transport grip becomes stronger than that in (a) due to the contact between the drive rollers and the driven roller, when the banknotes in a double-feed state pass through a nip portion between the drive rollers and the driven roller, only the lower-side banknote in contact with the drive rollers is transported in a forward direction by the drive rollers, and the remaining banknote(s) are not transported in the forward direction.

(2) Second Configuration Example

Figure 37:
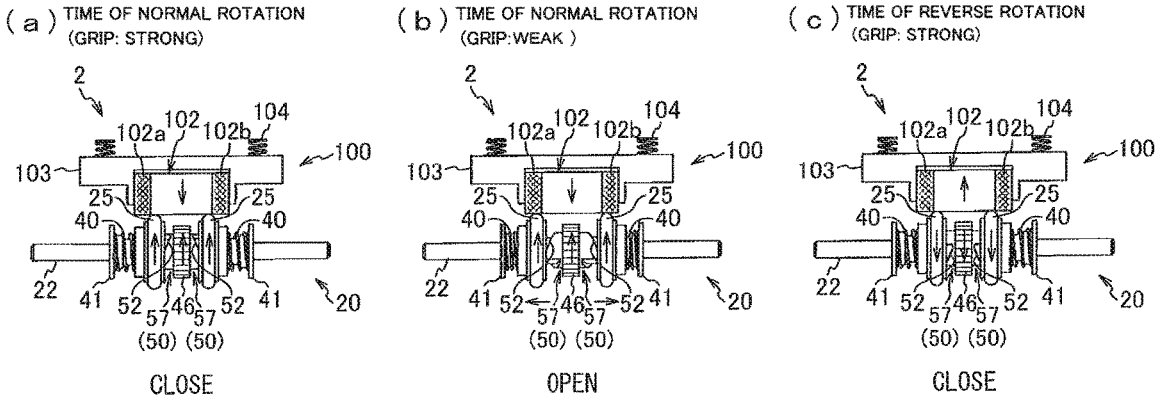
FIGS. 37(*a*), (*b*), and (*c*) are front elevational views illustrating configurations of a friction transport device according to a second configuration example of the sixth embodiment and illustrating respective operation modes.

That is, FIG. 37 are explanatory diagrams of a configuration and an operation of a friction transport device according to a second configuration example of the sixth embodiment, where (a) is a front elevational view of the friction transport device illustrating a state of a weak transport grip at the time of normal rotation during which a transport load is not applied, (b) is a front elevational view thereof illustrating a state of a strong transport grip at the time of normal rotation during which the transport load is applied (a cam mechanism operating state), and (c) is a front elevational view thereof illustrating a state of a weak transport grip at the time of reverse rotation.

Since the configuration of the drive-side unit 20 is the same as that illustrated in FIG. 1 and the like, redundant explanations thereof are omitted. However, in the driven-side unit 100, the driven roller 102 has a different friction coefficient according to the axial position thereof.

In this configuration example, the friction coefficient of a central portion 102*a* of the driven roller 102 having a straight shape is set to be a small value, and the friction coefficients of both end portions 102*b* and 102*b* are set to be a large value.

In a state of FIG. 37(*a*), since the cam mechanism 50 is not operating, the both drive rollers 25 are biased inward by the elastic biasing members 40, and outer peripheries of the respective drive rollers are in contact with the central portion 102*a* having a small friction coefficient of the driven roller 102, and the transport grip is weak.

In a state of FIG. 37(*b*), since the cam mechanism 50 operates due to a transport load from a banknote, the drive rollers move axially outward, and the outer peripheries of the drive rollers are in contact with the both end portions 102*b* of the driven roller having a large friction coefficient. Therefore, the transport grip becomes stronger.

In a reverse rotation state of FIG. 37(*c*), the drive rollers are at positions near the center of the driven roller and the grip is weak.

When the friction transport device 2 according to the present embodiment is applied to a paper feed mechanism that feeds banknotes one by one from the banknote on the bottom side of a bundle of stacked banknotes, it has been found that there is an effect of preventing double feed.

That is, when two or more banknotes enter a gap between the drive rollers and the driven roller in the state of (a), the cam mechanism 50 operates susceptibly in response to a transport load with a small value received by the drive rollers from the banknotes, thereby displacing the drive rollers axially outward as illustrated in (b).

In the state of (b), since the transport grip becomes stronger than that in (a) due to the contact of the drive rollers with the both end portions 102*b* having a large friction coefficient, when the banknotes in a double-feed state pass through a nip portion between the drive rollers and the driven roller, only the lower-side banknote in contact with the drive rollers is transported in a forward direction by the drive rollers, and the remaining banknote(s) are not transported in the forward direction.

Summary of Configurations, Actions, and Effects of Present Invention

The friction transport device 2 according to the first invention is characterized by including the drive-side unit 20 that transmits a transport driving force to one surface of a paper sheet to be transported on the transport path 10, the driving source 60 that supplies a driving force to the drive-side unit, and the driven-side unit 100 that is arranged to face the drive-side unit 20 and comes into contact with the other surface of the paper sheet. The drive-side unit includes at least one drive roller 25 that is supported rotatably about a shaft orthogonal to a normal paper-sheet transport direction and axially movably, an elastic biasing member 40 that elastically biases the drive roller 25 in an axial direction, and the cam mechanism 50 that transmits a driving force from the driving source to the drive roller, and operates when an external force exceeding a predetermined value in a direction other than the normal transport direction is applied to the paper sheet to be transported by the drive roller, so as to change an axial position of the drive roller against the elastic biasing force. The driven-side unit includes the driven roller 102 that changes a transport grip between the drive roller and the paper sheet according to a change of an axial position of the drive roller.

This invention corresponds to all of the first to fifth embodiments.

The friction transport device 2 includes a function as a skew correction device or a transport-grip changing device.

The drive roller 25 is a unit that comes into contact with one surface of a paper sheet such as a banknote on the transport path to transmit a transport driving force thereto. The shape, friction coefficient, and other configurations of the driven roller 102 are selected so that when the axial position of the drive roller changes because the cam mechanism 50 operates due to an external force such as a reaction force applied to the paper sheet, displacement of the paper sheet with respect to the drive roller becomes easy by maintaining the transport grip in a decreased or weak state.

The cam mechanism 50 can have any configuration so long as a function of automatically adjusting the transport grip can be exhibited by changing the axial position of the drive roller when an external force is applied to the paper sheet at the time of normal rotation of the drive roller. The external force exceeding a predetermined value in a direction other than the normal transport direction broadly includes a reaction force applied to the paper sheet moving forward in a skewed posture inclined more than the normal transport posture or in a non-skewed posture due to contact with a side wall or other obstacles on the transport path, or an external force the paper sheet receives, which results from a deformed portion such as a folded portion or a creased portion of the paper sheet itself.

In the initial state where the cam mechanism 50 is not operating, a paper sheet entering an inlet of the transport path is transported forward in the normal transport direction by the drive roller rotating in the normal direction and the driven roller. When the paper sheet comes into contact with an obstacle such as a side wall, the cam mechanism 50 operates to move the axial direction of the drive rollers to loosen the transport grip, thereby weakening the influence from the side wall or the like to perform course correction and directional correction of the paper sheet. The timing when the transport grip decreases due to the operation of the cam mechanism is determined by the biasing force due to the elastic biasing member, the balance between the drive roller and the firmness of the paper sheet, and the shape of the driven roller. It is desired to configure the friction transport device in such a manner that in the initial state where the cam mechanism 50 is not operating, when even a slight external force is applied to a paper sheet being transported with a strong transport grip between the drive roller rotating in the normal direction and the paper sheet, the cam mechanism operates to axially move the drive roller to further decrease the transport grip. In order to achieve this configuration, the transport grip in the initial state when the cam mechanism is not operating is preferably set to be a minimum value only necessary for transporting the paper sheet forward.

A paper sheet inserted diagonally causes a recognition failure, jamming, or deformation such as dog ear. Further, when it is required to stack paper sheets in correct alignment at the time of storing paper sheets in a storage in a paper sheet handling device, skew of the inserted paper sheet causes poor stacking due to deviation in a storing stage. Correction of paper sheets in a skewed state is important for a paper sheet handling device including a paper sheet transport device.

When the drive rollers are rotated in the reverse direction, the cam mechanism moves the drive roller in a direction strengthening the transport grip. Therefore, return of a paper sheet or a card and insertion prevention thereof can be realized effectively.

The friction transport device 2 according to the second invention is characterized such that the cam mechanism 50 includes the cam member 57 that is arranged so as to be capable of relative rotation with respect to an axially movable drive roller 25 and coaxially therewith, one cam mechanism element (the cam follower 55) that is arranged in the drive roller or the cam member, the other cam mechanism element (the cam portion 51) that is arranged in the cam member or the drive roller to come into contact with the one cam mechanism element in a sliding manner by an elastic biasing force and to change an axial direction of the drive roller by changing a circumferential direction of the one cam mechanism element, and the stopper 53 that is provided in (a circumferential end of) the other cam mechanism element to regulate relative movement between the one cam mechanism element and the other cam mechanism element.

This invention corresponds to all of the first to fourth embodiments.

The cam member 57 is a unit that receives transmission of a driving force directly or indirectly from the driving source and transmits the driving force to the drive roller.

When the drive roller having received a transport load from a paper sheet decelerates, the cam mechanism 50 (the cam portion 51 and the cam follower 55 as the cam mechanism elements) operates due to a speed difference generated between the drive roller and the cam member, so that the cam member and the drive roller rotate relatively to each other, thereby performing axial movement of the drive roller.

At the time of reverse rotation of the drive roller for returning a paper sheet due to an occurrence of an error, one stopper 53*a* provided in the cam portion comes into contact with the cam follower 55 to continuously transmit a driving force in the reverse direction from one to the other, the drive roller can maintain the axial position that maximizes the transport grip. As a result, a strong transport grip is maintained, thereby enabling reliable return.

The friction transport device 2 according to the third invention is characterized such that the cam mechanism 50 operates when a speed difference is generated between the drive roller and the cam member due to an external force, thereby changing the axial position of the drive roller.

This invention corresponds to all of the first to fifth embodiments.

The cam mechanism is a unit that automatically adjusts the transport grip by moving the drive roller back and force in the axial direction, when the drive roller and the cam member rotate in forward and reverse directions relatively to each other.

The friction transport device 2 according to the fourth invention is characterized such that the driven roller 102 is configured so that a transport grip when the drive roller is displaced axially from the axial initial position against the elastic biasing member due to an operation of the cam mechanism is lower than a transport grip between a paper sheet and the drive roller that is at the axial initial position because the cam mechanism is not operating.

This invention corresponds to all of the first to fifth embodiments.

The driven roller can change the transport grip of the drive roller by employing a configuration in which an external diameter at axial positions is changed by a method of forming the driven roller in a crown shape or a reversed crown shape, or friction resistance of a cylindrical body is made different according to the axial positions.

The friction transport device 2 according to the fifth invention is characterized such that the drive-side unit 20 includes at least two drive rollers 25, the elastic biasing member 40 that elastically biases each of the drive rollers in an axial direction the drive rollers approaching each other, and the cam member 57 that is arranged so as to be fixed to a shaft between the respective drive rollers (at an intermediate position) capable of relative rotation with respect to the drive rollers and is rotated and driven by the driving source, one cam mechanism element or the other cam mechanism element is arranged in each of the drive rollers, and the other cam mechanism element or the one cam mechanism element is arranged in the cam member. The driven roller is configured so that the transport grip when each of the drive rollers is at an operating position (in an operating state) at which an interval between the drive rollers is increased becomes lower than a transport grip between a paper sheet and the respective drive rollers that are at the axial initial positions at which the drive rollers are close to each other.

The fifth invention corresponds to the first to third embodiments.

By rotatably assembling the cam member to a shaft that cannot rotate, an expensive bearing member or the like that is required at the time of rotating the shaft is not required, and also reduction of energy loss is realized.

The friction transport device 2 according to the sixth invention is characterized such that the drive-side unit 20 includes at least two drive rollers 25, the elastic biasing member 40D that elastically biases each of the drive rollers in an axial direction separating the drive rollers from each other, the transport driving member 46 that is fixed to the shaft axially outward of any one of the drive rollers and rotated and driven by the driving source, and the cam member 57 that is fixedly arranged respectively to the shaft axially outward of each of the drive rollers, one cam mechanism element or the other cam mechanism element is arranged in each of the drive rollers, and the other cam mechanism element or the one cam mechanism element is arranged in the cam member. The driven roller 102 is configured so that the transport grip when each of the drive rollers is at an operating position at which the drive rollers are close to each other becomes lower than a transport grip between a paper sheet and the drive rollers that are at their initial positions (in an initial state) at which an interval between the drive rollers is increased.

This invention represents a configuration corresponding to the embodiment in FIG. 31.

Even if this invention has a configuration such that the direction in which the elastic biasing member biases the two drive rollers is a direction separating the drive rollers from each other, and the transport grip decreases when the drive rollers move in a direction the drive rollers approaching each other, the automatic adjustment mechanism of the transport grip by the cam mechanism 50 can be realized.

The friction transport device 2 according to the seventh invention is characterized such that the drive-side unit 20 includes one drive roller 25, one cam member 57 that is fixedly arranged on the shaft 2, one cam mechanism element or the other cam mechanism element that is arranged in the drive roller, the other cam mechanism element or the one cam mechanism element that is arranged in the cam member, the elastic biasing member 40 that elastically biases the drive roller in a direction in which the respective cam mechanism elements are brought into pressure contact with each other, and the transport driving member 46 that is fixed to the shaft axially outward of the drive roller or the cam member and rotated and driven by the driving source.

This invention has a configuration corresponding to the embodiment in FIG. 30.

There is no limitation in the number of drive rollers, and even if only one drive roller is provided, the automatic adjustment mechanism of the transport grip by the cam mechanism 50 can be realized.

The friction transport device 2 according to the eighth invention is characterized such that the driven roller 102 is provided in the same number as that of the drive rollers.

There is no limitation in the number of driven rollers, and even if the driven roller is provided in the same number as that of the drive rollers, the automatic adjustment mechanism of the transport grip by the cam mechanism 50 can be realized. As illustrated in FIG. 29, a pair of one set of drive rollers and one driven roller can be arranged in plural in series on one shaft.

The friction transport device 2 according to the ninth invention is characterized such that the other cam mechanism element has the sloped portion 52 in which an axially projecting length gradually increases (gradually decreases) according to a difference in a circumferential position.

By constituting the cam portion 51 with an arc-like (annular) sloped portion, which is an inclined surface with the axial projecting length gradually increases or gradually decreases in a curved shape or a straight shape, the axial movement when the cam portion and the driving rollers rotate relatively to each other can be smoothened.

The friction transport device 2 according to the tenth invention is characterized such that the drive-side unit 20 includes at least two drive rollers 25, the cam member 57 that is fixedly arranged on the shaft between the respective drive rollers, the elastic biasing member 40 that elastically biases each of the drive rollers in an axial direction the drive rollers approaching each other, one cam mechanism element or the other cam mechanism element that is arranged in each of the drive rollers, the other cam mechanism element or the one cam mechanism element that is arranged in the cam member, and the transport driving member 46 that is fixed to the shaft axially outward of any one of the drive rollers and rotated and driven by the driving source, and the driven roller has a configuration in which the transport grip decreases when each of the drive rollers moves axially outward.

This invention corresponds to the embodiment in FIG. 22.

The configuration can be such that a pair of cam mechanism elements provided in one cam member arranged between the drive rollers is brought into contact with the cam mechanism element respectively provided in each of the drive rollers. It is possible to employ a configuration in which the transport driving member 46 is fixed to the shaft axially outward of one drive roller, other than the configuration in which the transport driving member 46 is arranged between the two drive rollers.

The friction transport device 2 according to the eleventh invention is characterized such that the drive-side unit 20 includes at least one drive roller (fixed-side drive roller) 25-2 that is fixed to the shaft 22, the other drive roller (movable-side drive roller) 25-1 that is arranged coaxially with the one drive roller so as to be capable of relative rotation with respect to the one drive roller and axially movably, the elastic biasing member 40 that elastically biases the other drive roller toward the one drive roller, one cam mechanism element or the other cam mechanism element that is arranged in the other drive roller, the other cam mechanism element or the one cam mechanism element that is arranged in the cam member, and the transport driving member 46 that is fixed to the shaft axially outward of any one of the drive rollers and rotated and driven by the driving source, and the driven roller has a configuration in which the transport grip decreases when the other drive roller moves axially against the elastic biasing member.

This invention represents a configuration corresponding to the respective embodiments in FIGS. 23 to 28.

Even when one of the drive rollers is fixed to the shaft, and the other one or two drive rollers are configured to be able to move with respect to the shaft, the configuration in which the transport grip is increased or decreased by the operation of the cam mechanism can be realized.

The friction transport device 2 according to the twelfth invention is characterized such that the drive-side unit 20 includes at least two drive rollers 25, the cam member 57 respectively arranged on a surface facing each of the drive rollers, the elastic biasing member 40 that brings the cam members into pressure contact with each other in a sliding manner by elastically biasing each of the drive rollers in a direction the drive rollers approaching each other, and the transport driving member 46 integrally provided on an axial direction side of one drive roller, and the other cam mechanism element 52 is provided in one cam member, and the other cam mechanism element 52 or the one cam mechanism element 55 is provided in the other cam member.

This invention corresponds to the embodiment in FIGS. 32.

When a transport load is applied to the drive rollers from a paper sheet, the drive rollers are axially moved and shifted to a state capable of performing skew correction, also by arranging the cam member respectively in each of the drive rollers and bringing the cam mechanism elements of the cam members into contact with each other in a sliding manner.

The friction transport device 2 according to the thirteenth invention is characterized such that at least one of the drive-side unit 20 or the driven-side unit 100 is elastically biased toward the other.

This invention has a configuration corresponding to all the embodiments.

The friction transport device 2 according to the thirteenth invention is characterized such that the drive rollers at axial initial positions because the cam mechanism 50 is not operating and the driven roller are in a non-contact state.

This invention corresponds to the respective embodiments in FIGS. 18, 23, and 24.

Even in a configuration in which there is a gap between the driven roller and the drive rollers when the drive rollers are at their initial positions, it is possible to normally transport a paper sheet not in a skewed state at the time of non-operation of the cam mechanism and to correct a skewed paper sheet by an operation of the cam mechanism at the time of occurrence of a skew. That is, constant contact between the drive rollers and the driven roller is not an essential condition.

The friction transport device 2 according to the fourteenth invention is characterized such that the drive rollers at axial initial positions because the cam mechanism is not operating and the driven roller are in a non-contact state.

The friction transport device 2 according to the fifteenth invention is characterized by including the drive-side unit 20 that transmits a transport driving force to one surface of a paper sheet to be transported on a transport path, a driving source that supplies a driving force to the drive-side unit, and the driven-side unit 100 that is arranged to face the drive-side unit and comes into contact with the other surface of the paper sheet. The drive-side unit includes at least one drive roller 25 that is supported rotatably about a shaft orthogonal to (intersecting with) a normal paper-sheet transport direction and axially movably, an elastic biasing member 40 that elastically biases the drive roller in an axial direction, and an electric actuating mechanism that changes an axial position of the drive roller against an elastic biasing force. The driven-side unit includes a driven roller that changes a transport grip between the drive roller and a paper sheet according to a change of an axial position of the drive roller.

This invention has a configuration corresponding to the fifth embodiment.

Since the friction transport device 2 moves the drive roller by the electric actuating mechanism including an actuator, a cam mechanism is not required.

The paper sheet transport device 1 according to the sixteenth invention is characterized by including a friction transport device according to any one of the first to fifteenth friction transport devices 2, the transport path 10, the paper sheet detection sensor 15 that detects entry of a paper sheet into the transport path, and a control unit that controls the driving source. The control unit rotates the drive roller in a normal direction by activating the driving source based on a paper-sheet entry detection signal from the paper sheet detection sensor.

A paper sheet transport device such as various kinds of automatic vending machines, change machines, and money dispensers can improve the skew correction function by decreasing the transport grip at the time of occurrence of a skew, return capacity by increasing the transport grip, and capacity of preventing insertion of a paper sheet, which are provided in all the friction transport devices described above.

REFERENCE SIGNS LIST

1 . . . banknote (paper sheet) transport device, 2 . . . friction transport device, 2A . . . first friction transport mechanism, 2B . . . second friction transport mechanism, 3 . . . lower unit, 4 . . . upper unit, 10 . . . banknote (paper sheet) transport path, 10*a* . . . slot, 11 . . . banknote (paper sheet) transport surface, 11A . . . side wall, 11B . . . side wall, 11*a* . . . entry-side transport surface, 11*b* . . . intermediate transport surface, 11*c* . . . inner transport surface, 12 . . . entry-side side wall, 13 . . . intermediate side wall, 14 . . . inner-side side wall, 15 . . . inlet sensor (banknote detection sensor), 16 . . . transport roller, 17 . . . recognition sensor, 20 . . . drive-side unit, 22 . . . shaft, 25, 25-1, 25-2 . . . drive roller, 25A . . . core member, 25B . . . outer peripheral member, 26 . . . drive roller, 30 . . . elastic member, 40 . . . elastic biasing member, 41 . . . bush, 44 . . . transmission gear, 45 . . . transport drive gear, 45*a* . . . gear portion, 45*b* . . . sleeve, 46 . . . transport drive gear, 50 . . . cam mechanism, 51 . . . cam portion (cam mechanism element), 52 . . . sloped portion (cam mechanism element), 53 . . . stopper (cam mechanism element), 55 . . . cam follower (cam mechanism element), 57 . . . cam member, 60 . . . drive motor (driving source), 100 . . . driven-side unit, 102 . . . driven roller, 102A, 102B . . . divided driven roller, 102*a* . . . central portion, 102*b*, 102*c*, 102*d* . . . end portion, 103, 103A, 103B . . . bracket, 103*a* . . . shaft support, 104 . . . elastic member, 104A, 104B . . . elastic member, 130 . . . elastic member, 150 . . . electric actuating mechanism, 151 . . . actuator, 151*a* . . . plunger, 151*b* . . . shaft, 152 . . . arm, 152*a* . . . arm piece, 155 . . . bearing member, 200 . . . control unit

The invention claimed is:

1. A friction transport device comprising: a single drive-side unit that transmits a transport driving force to one surface of a paper sheet to be transported on a transport path; a driving source that supplies a driving force to the drive-side unit; and a single driven-side unit that is arranged to face the single drive-side unit and comes into contact with the other surface of the paper sheet, wherein the transport path includes a paper sheet transport surface that guides a lower surface of the paper sheet by an upper surface thereof and side walls that are arranged in a standing state on both sides in a width direction of the paper sheet transport surface, the single drive-side unit includes at least one drive roller that is supported rotatably about a shaft orthogonal to a normal paper-sheet transport direction and moveable axially, an elastic biasing member that holds the at least one drive roller at an axial initial position by elastically biasing the at least one drive roller in the axial direction, and a cam mechanism that transmits a driving force from the driving source to the at least one drive roller, and operates when an external force exceeding a predetermined value in a direction other than the normal paper-sheet transport direction is applied to the paper sheet to be transported by the at least one drive roller, so as to change an axial position of the at least one drive roller against the elastic biasing force, and the single driven-side unit includes a driven roller that is supported rotatably about a shaft orthogonal to the normal paper-sheet transport direction but not moveable in a direction in which the shaft extends and changes a transport grip between the at least one drive roller and the paper sheet according to a change of an axial position of the at least one drive roller;

the driven roller is configured to change an outer diameter of an outer peripheral surface in contact with the paper sheet according to the axial position, or change a friction coefficient of the outer peripheral surface in contact with the paper sheet according to the axial position, so that a transport grip when the at least one drive roller is displaced axially from an axial initial position against the elastic biasing member becomes lower than a transport grip between the paper sheet and the at least one drive roller that is at the axial initial position;

the drive-side unit and the driven-side unit decrease the transport grip by operating the cam mechanism when the paper sheet receives the external force exceeding the predetermined value in the direction other than the normal paper-sheet transport direction due to contact with the side walls in a process of transportation along the transport path;

the transport grip when decreased has a value which enables the paper sheet to slide horizontally between the at least one drive roller and the driven roller such that skew correction can be performed by guiding the paper sheet toward a center of the transport path or toward one sidewall while the transport posture of the paper sheet is corrected to be in parallel to the normal paper-sheet transport direction by changing the transport posture of the paper sheet in a direction canceling out the external force from the side walls due to cooperation with the side walls;

the at least one drive roller at the axial initial position is configured to transport the paper sheet between the at least one drive roller and the driven roller in a reverse direction by rotating the at least one drive roller in a direction opposite to the normal paper-sheet transport direction, the at least one drive roller at the axial initial position is configured to block the paper sheet from entering from outside between the at least one drive roller and the driven roller when the at least one drive roller has stopped rotating, and the paper sheet is one of a banknote, a marketable security and a ticket.

2. The friction transport device according to claim 1, wherein the cam mechanism includes a cam member that is arranged on the shaft so as to be capable of relative rotation with respect to the at least one drive roller and coaxially therewith, a first cam mechanism element that is arranged in the at least one drive roller or in the cam member, a second cam mechanism element that is arranged in the cam member or the at least one drive roller to come into contact with the first cam mechanism element in a sliding manner by the elastic biasing force of the elastic biasing member and changes an axial direction of the at least one drive roller by changing its own axial direction when the first cam mechanism element changes a circumferential direction, and a stopper that is provided in the second cam mechanism element to regulate relative movement between the first cam mechanism element and the second cam mechanism element.

3. The friction transport device according to claim 2, wherein the single drive-side unit includes a second drive roller that is supported rotatably about the shaft and moveable axially in addition to the at least one drive roller, the elastic biasing member that elastically biases at least one of the drive rollers in an axial direction approaching each drive roller, and the cam member that is arranged so as to be capable of relative rotation with respect to each drive roller with an axial position being fixed to a shaft portion between the respective drive rollers and is rotated and driven by the driving source, the one cam mechanism element or an other cam mechanism element is arranged in each of the drive rollers, and the other cam mechanism element or the one cam mechanism element is arranged in the cam member.

4. The friction transport device according to claim 1, wherein the single drive-side unit includes the at least one drive roller, one cam member that is fixedly arranged on the shaft, the elastic biasing member that holds the at least one drive roller at an axial initial position by elastically biasing the at least one drive roller in the axial direction toward the cam member, and a transport driving member that is fixed to the shaft on a side opposite to the cam member with the at least one drive roller sandwiched therebetween and rotated and driven by the driving source.

5. The friction transport device according to claim 1, wherein the single drive-side unit includes the at least one drive roller and an other drive roller that is supported rotatably about the shaft and moveable axially, the elastic biasing member that holds any one of the drive rollers at the axial initial position by elastically biasing any one of the drive rollers in an axial direction the drive rollers approaching each other, and a transport driving member that is fixed to the shaft axially outward of any one of the drive rollers and rotated and driven by the driving source, and the cam mechanism is arranged so as to span across any one of the drive rollers and the shaft located between the drive rollers that transmits a driving force from the transport driving member to any one of the drive rollers, and operates when an external force exceeding a predetermined value in a direction other than the normal paper-sheet transport direction is applied to the paper sheet to be transported by any one of the drive rollers, so as to change an axial position of any one of the drive rollers against the elastic biasing force.

6. The friction transport device according to claim 1, wherein the at least one drive roller of the single drive-side unit includes a fixed-side drive roller that is fixed to the shaft and a movable-side drive roller that is arranged rotatably about the shaft and movably in a direction that approaches or separates from the fixed-side drive roller along the axial direction of the shaft, the elastic biasing member that holds movable-side drive roller at the axial initial position by elastically biasing the movable-side drive roller toward the fixed-side drive roller, and a transport driving member that is fixed to the shaft axially outward of any one of the at least one drive rollers and rotated and driven by the driving source, and the cam mechanism is arranged so as to span across the shaft located between the fixed-side drive roller and the movable-side drive roller, and operates when an external force exceeding a predetermined value in a direction other than the normal paper-sheet transport direction is applied to the paper sheet to be transported by the at least one drive roller, so as to change an axial position of the at least one drive roller against the elastic biasing force.

7. The friction transport device according to claim 1, wherein the at least one drive roller of the single drive-side unit includes at least two drive rollers arranged so as to be rotatable about the shaft and movable in a direction of approaching or separating from each other along the axial direction of the shaft, the elastic biasing member that holds each of the two drive rollers at the axial initial position by elastically biasing each of the two drive rollers in a direction the two drive rollers approaching each other, and a transport driving member that is integrally provided on an axial direction side of one of the two drive rollers and rotated and driven by the driving source, and the cam mechanism includes cam members arranged on each facing surface of the two drive rollers and in sliding contact with each other, and the cam mechanism transmits a driving force from one of the two drive rollers by each of the cam members to another one of the two drive rollers, and operates when an external force exceeding a predetermined value in a direction other than the normal paper-sheet transport direction is applied to the paper sheet to be transported by the two drive rollers, so as to change an axial position of the two drive rollers against the elastic biasing force.

8. The friction transport device according to claim 1, wherein the at least one drive roller and the driven roller are in a non-contact state when the at least one drive roller is held at the axial initial position by the elastic biasing member and the paper sheet is not positioned between the at least one drive roller and the driven roller.

9. A paper sheet transport device comprising:

the friction transport device according to claim 1; and a control unit that controls the transport path, a paper sheet detection sensor that detects entry of a paper sheet into the transport path, and the driving source, wherein the control unit rotates the at least one drive roller in a normal direction by activating the driving source based on a paper-sheet entry detection signal from the paper sheet detection sensor.

10. The friction transport device according to claim 1, wherein the at least one drive roller of the single drive-side unit includes two movable-side drive rollers arranged so as to be rotatable about the shaft and movable in the direction of approaching or separating from each other along the axial direction of the shaft and a fixed-side drive roller that is fixed to the shaft between the two movable-side drive rollers, the elastic biasing member that holds each drive roller at the axial initial position by elastically biasing the two movable-side drive rollers in an axial direction as the drive rollers approach each other, and a transport driving member that is fixed to the shaft axially outward of any one of the movable-side drive rollers and rotated and driven by the driving source, and the cam mechanism includes cam members arranged on both sides of the fixed-side drive roller in the axial direction that transmits a driving force from the transport driving member by each of the cam members to the movable-side drive rollers, and operates when an external force exceeding a predetermined value in a direction other than the normal paper-sheet transport direction is applied to the paper sheet to be transported by the movable-side drive rollers, so as to change an axial position of the movable-side drive rollers against the elastic biasing force.

11. A friction transport device comprising: a single drive-side unit that transmits a transport driving force to one surface of a paper sheet to be transported on a transport path; a driving source that supplies a driving force to the drive-side unit; and a single driven-side unit that is arranged to face the single drive-side unit and comes into contact with the other surface of the paper sheet, wherein the transport path includes a paper sheet transport surface that guides a lower surface of the paper sheet by an upper surface thereof and side walls that are arranged in a standing state on both sides in a width direction of the paper sheet transport surface, the single drive-side unit includes a first drive roller that is supported rotatably about a shaft orthogonal to a normal paper-sheet transport direction and moveable axially and a second drive roller that is supported rotatably about the shaft and moveable axially, an elastic biasing member that holds each drive roller at an axial initial position by elastically biasing each of the drive rollers in an axial direction separating the drive rollers from each other, a transport driving member that is fixed to the shaft axially outward of any one of the drive rollers and rotated and driven by the driving source, and a cam member that is fixedly arranged respectively to the shaft axially outward of each of the drive rollers, and the single driven-side unit includes a driven roller that is supported rotatably about a shaft orthogonal to the normal paper-sheet transport direction but not moveable in a direction in which the shaft extends and changes a transport grip between the at least one drive roller and a paper sheet according to a change of an axial position of the at least one drive roller, the driven roller is configured to change an outer diameter of an outer peripheral surface in contact with the paper sheet according to the axial position, or change a friction coefficient of the outer peripheral surface in contact with the paper sheet according to the axial position, so that a transport grip when the at least one drive roller is displaced axially from an axial initial position against the elastic biasing member becomes lower than a transport grip between a paper sheet and the at least one drive roller that is at the axial initial position, the drive-side unit and the driven-side unit decrease the transport grip by operating the cam mechanism when the paper sheet receives the external force exceeding the predetermined value in the direction other than the normal paper-sheet transport direction due to contact with the side walls in a process of transportation along the transport path;

the transport grip when decreased has a value which enables the paper sheet to slide horizontally between the drive roller and the driven roller such that skew correction can be performed by guiding the paper sheet toward a center of the transport path or toward one sidewall while the transport posture of the paper sheet is corrected to be in parallel to the normal paper-sheet transport direction by changing the transport posture of the paper sheet in a direction canceling out the external force from the side walls due to cooperation with the side walls;

the at least one drive roller at the axial initial position is configured to transport the paper sheet between the at least one drive roller and the driven roller in a reverse direction by rotating the at least one drive roller in a direction opposite to the normal paper-sheet transport direction, and the at least one drive roller at the axial initial position is configured to block the paper sheet from entering from outside between the at least one drive roller and the driven roller when the at least one drive roller has stopped rotating, and the paper sheet is one of a banknote, a marketable security and a ticket.

12. A friction transport device comprising: a single drive-side unit that transmits a transport driving force to one surface of a paper sheet to be transported on a transport path; a driving source that supplies a driving force to the drive-side unit; and a single driven-side unit that is arranged to face the single drive-side unit and comes into contact with the other surface of the paper sheet, wherein the transport path includes a paper sheet transport surface that guides a lower surface of the paper sheet by an upper surface thereof and side walls that are arranged in a standing state on both sides in a width direction of the paper sheet transport surface, the single drive-side unit includes a first drive roller that is supported rotatably about a shaft orthogonal to a normal paper-sheet transport direction and moveable axially and a second drive roller that is supported rotatably about the shaft and moveable axially, an elastic biasing member that holds each drive roller at an axial initial position by elastically biasing each of the drive rollers in an axial direction approaching the drive rollers from each other, a transport driving member that is fixed to the shaft axially outward of any one of the drive rollers and rotated and driven by the driving source, and a cam mechanism that transmits a driving force from the transport driving member to each of the drive rollers, and operates when an external force exceeding a predetermined value in a direction other than the normal paper-sheet transport direction is applied to the paper sheet to be transported by at least one of the drive rollers, so as to change an axial position of each of the drive rollers against the elastic biasing force, and the single driven-side unit includes a driven roller that is supported rotatably but not moveable in an axial direction and changes a transport grip between each drive roller and a paper sheet according to a change of an axial position of each drive roller, wherein the driven roller is configured to change an outer diameter of an outer peripheral surface in contact with the paper sheet according to the axial position, or change a friction coefficient of the outer peripheral surface in contact with the paper sheet according to the axial position, so that a transport grip when each drive roller is displaced axially from an axial initial position against the elastic biasing member becomes higher than a transport grip between a paper sheet and each drive roller that is at the axial initial position, and the drive-side unit and the driven-side unit perform skew correction by guiding the paper sheet toward a center of the transport path or toward one sidewall while the transport posture of the paper sheet is corrected in parallel to the normal paper-sheet transport direction when the paper sheet receives a reaction force in a direction different from the normal paper-sheet transport direction due to contact with the side walls in a process of transportation along the transport path, and the paper sheet is one of a banknote, a marketable security and a ticket.

* * * * *